US006852479B2

(12) United States Patent
Soejima et al.

(10) Patent No.: US 6,852,479 B2
(45) Date of Patent: Feb. 8, 2005

(54) SILVER HALIDE COLOR PHOTOGRAPHIC PHOTOSENSITIVE MATERIAL AND IMAGE FORMING METHOD

(75) Inventors: Shin Soejima, Kanagawa (JP); Kentaro Okazaki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/420,965

(22) Filed: Apr. 23, 2003

(65) Prior Publication Data

US 2004/0038158 A1 Feb. 26, 2004

(30) Foreign Application Priority Data

| | | |
|---|---|---|
| Apr. 24, 2002 | (JP) | 2002-122385 |
| Apr. 24, 2002 | (JP) | 2002-122386 |
| May 20, 2002 | (JP) | 2002-144810 |
| Jul. 18, 2002 | (JP) | 2002-210039 |
| Jul. 18, 2002 | (JP) | 2002-210151 |

(51) Int. Cl.[7] ..... G03E 1/46
(52) U.S. Cl. ..... 430/553; 430/385
(58) Field of Search ..... 430/553, 385

(56) References Cited

U.S. PATENT DOCUMENTS

| | | | | |
|---|---|---|---|---|
| 4,151,680 A | | 5/1979 | Sena | |
| 4,591,546 A | | 5/1986 | West et al. | |
| 5,492,797 A | * | 2/1996 | Tosaka et al. | 430/505 |

FOREIGN PATENT DOCUMENTS

| | | |
|---|---|---|
| JP | 05-150418 A | 6/1993 |
| JP | 11-212225 A | 8/1999 |
| JP | 2000-007673 A | 1/2000 |

* cited by examiner

*Primary Examiner*—Hoa Van Le
(74) *Attorney, Agent, or Firm*—Sughrue Mion, PLLC

(57) ABSTRACT

An image forming method including a step of imagewise exposing a silver halide color photographic photosensitive material having, on a support, photographic constituent layers including at least one blue sensitive silver halide emulsion layer, at least one green sensitive silver halide emulsion layer, at least one red sensitive silver halide emulsion layer, and at least one non-photosensitive hydrophilic colloid layer, a color developing step, a bleach-fixing step and a rinsing step. At least one of the at least one red sensitive silver halide emulsion layer contains at least one compound represented by the following general formula (IA) and/or at least one coupler represented by the following general formulae (PTA-I) and (PTA-II).

General formula (IA)

General formula (PTA-I)

General formula (PTA-II)

10 Claims, No Drawings

SILVER HALIDE COLOR PHOTOGRAPHIC PHOTOSENSITIVE MATERIAL AND IMAGE FORMING METHOD

BACKGROUND OF THE INVENTION

1. Field of the Invention

The present invention relates to a silver halide color photographic photosensitive material and an image forming method using the silver halide color photographic photosensitive material and it relates to a image forming method improved in an image conservation property during storage, a silver halide photographic material provided with processing stability with ensured rapid high productivity and an image forming method by using the material, a silver halide color photographic photosensitive material with reduced replenishing amount of a processing solution and excellent in rapid processability in a compact laser scanning exposure type silver halide color photographic processing system, as well as an image forming method using the material. More specifically, it relates to an image forming method of stabilizing water washing in a rinsing step (water washing and/or stabilizing step) in a color development processing for a thin-layered silver halide color photographic photosensitive material excellent in the color reproducibility, a image forming method without lowering of a cyan concentration upon conducting continuous processing, as well as a silver halide color photographic photosensitive material at high saturation and with improved unevenness in solid images, and an image forming method using the same.

2. Description of the Related Art

In recent years, in the field of photographic processing services, photographic materials at high image quality which can be processed rapidly have been demanded as forming a part of services for users and as a means for the improvement of the productivity. In order to cope with the demand, rapid processing that is usually adopted these days enables to process a photographic material containing an emulsion at high silver chloride content (hereinafter also referred to as "high silver chloride printing material") for a color developing time of 45 sec and to conduct total processing from the start of the developing step to the end of the drying step in about 4 min (for example, color processing CP-48S, manufactured by Fuji Photo Film Co., Ltd.). However, when compared with the rapid processability in preparing images. of other color image preparation systems (for example, electrostatic transfer system, thermal transfer system, and ink jet system), even this rapid development processing system of the high silver chloride printing material can not be said to provide a satisfactory rapid processability and it has been demanded for a super rapid processing in which the total processing time from the start of the development to the end of the drying for the high silver chloride color printing material is less than 1 min.

For this purpose, various studies and attempts have been made for the improvement of the super rapid processing adaptability in the relevant field of art.

For example, as the means for the improvement of the super rapid processing adaptability, it has been studied (1) to reduce the coating amount of an organic coating material and the coating amount of a hydrophilic binder material by using a highly active coupler or a coupler having a large molecular extinction coefficient of a color dye, and (2) to use a silver halide emulsion of high developing speed. Further, it has also been known a method of making the development processing more rapid by coating a silver halide emulsion layer with lowest color developing speed (yellow coupler containing layer in existent color printing material) on the side remote from a support, which is disclosed, for example, in JP-A Nos. 7-239538 and 7-239539. Further, JP-A No. 2000-7673 defines, with an aim of rapid processing, the amount of binder and the amount of an oil soluble component coated to a silver halide photosensitive material and the concentration of the white area in a rapid processing.

Decrease of gelatin binder contributes to rapid processing since it accelerates intrusion of a color developing agent in the processing solution into a silver halide photosensitive material. However, it deteriorates the protective colloid function of oil droplets present in the silver halide photographic material or dye dispersed oil droplets after coloration, causing bleeding, etc. in color images and worsening the image conservation property. Further, while JP-A No. 2000-7673, etc. disclose addition of a water washing accelerator to a water washing stabilizing bath for decreasing the worsening of the white area due to the residue of a sensitizing dye or an irradiation preventive dye or addition of a brightening agent for suppression of yellow tinted color upon rapid processing, but salts present in the gelatin binder for the acceleration of washing lowers the protective colloid performance to also result in causing bleeding, etc. in color images, and worsening the color conservation property.

On the other hand, it is particularly poor in the color separation performance of a cyan color dye compared with after color image forming systems (for example, electrostatic transfer system, thermal transfer system and ink jet system) and JP-A Nos. 5-150418 and 11-212225 contain description regarding the improvement of color purity while enhancing the color image conservation property. However, an image forming method capable of satisfying the color image stability and, further, the color purity while considering the rapid processability and avoiding color image bleeding while possessing outstanding superiority over other color image methods has not yet been found.

Further, with a view point of stabilizing the performance by continuous processing, the high silver chloride printing material can not be said to have superiority compared with other systems and improvement for the robustness to the continuous processing stability has been demanded long since.

Therefore, various studies and attempts have been made in the relevant field such as for the improvement of the continuous processing stability.

For forming color photographic images, photographic couplers of three colors, i.e., yellow, magenta and cyan are incorporated into three types of photosensitive layers of different color sensitivities and, after imagewise exposure, processed by a color developer containing a color developing agent. In this step, a color dye is provided by coupling reaction with an oxidant form of a primary aromatic amine. Generally, the development processing step for the silver halide color photographic photosensitive material generally comprises a color developing step of forming color images, a desilvering step (bleach-fixing step) of removing developed silver and not developed silver, as well as a water washing and/or stabilizing step (rinsing step). In the desilvering step of removing the developed silver and silver halide, the developed silver is re-oxidized by a bleacher and fixed by a silver halide solubilizing agent, and the step is conducted by a single step using a single solution comprising a combination of a bleacher and a fixing agent. The solution is generally referred to as a bleach-fixing (or blix) solution.

As the silver bleaching agent in the bleach-fixing solution, organic acid complex ferric salts, among all, complex ferric salts of ethylene diamine-N,N,N',N'-tetraacetic acid (hereinafter referred to as EDTA) is usually used. Further, with a view point of rapid processing and decrease for the liquid waste ingredients in the processing solution, complex ferric salts of 1,3-propane diamine-N,N,N',N'-tetraacetic acid (hereinafter referred to as PDTA) are also used generally. On the other hand, in view of intense interest for the discharge of chelate agents with less biodegradability in the natural world and tending to solubilize toxic heavy metal ions along with increasing consciousness for the environmental protection, development for the substitutes thereof has been demanded and, for example, JP-A Nos. 4-313752, 5-265159 and 6-161065 describe chelating agents excellent in the biodegradability.

However, when the complex ferric salt described above is used as the bleaching agent for the color photographic agent, cyan color images with sufficient density can not sometimes be obtained. This phenomenon is generally recognized as reduction discoloration by leuco-transformation of a cyanine dye in a bleach-fixing solution (hereinafter referred to as blix discoloration). U.S. Pat. No. 4,591,548 points out the presence of complex ferrous salts in the bleach-fixing solution as a cause for the transformation of the cyan color dye into a leuco compound.

The effect of the bleach-fixing solution is attained effectively when it is in an oxidative atmosphere and aerial oxygen is supplied into the processing solution. Further, the blix discoloration can also be prevented by preventing lowering of the cyan density by oxidizing the complex ferric salts present in the solution. With the view point described above, the effect can be improved by enlarging a so-called an opening degree, that is, a portion where a processing liquid in a bleach-fixing bath processing tank is in contact with air. However, enlargement for the opening degree promotes evaporation of water during continuous processing to sometimes result in a problem such as deposition by thickening of the processing solution ingredient. Stabilization for the cyan density in a processing machine with reduced opening degree of the bleach-fixing bath is demanded. For this proposes, improvement by the silver halide color photographic photosensitive material is demanded.

On the other hand, in the color photographic development processing in recent years, simplification and rapid processing have been intended such as decrease in the replenishing amount and the shorting of the processing time. Lowering of the replenishing amount and increase in the processing operation efficiency in the desilvering step result in increase in the complex ferric salt tending to worsen the blix discoloration. Further, while lowering of pH in the bleach-fixing solution is effective for the shortening of the time in the desilvering step, lowering of pH in the bleach-fixing solution also results in a disadvantage of promoting blix discoloration of the cyan dye.

The following various approaches have been proposed to overcome the blix discoloration of the cyan dye. For example, U.S. Pat. No. 3,706,561, etc. disclose improvement by the change of the concentration and the composition of the bleach-fixing solution. U.S. Pat. No. 4,366,233 proposes to decrease the total coating amount of silver in the layer disposed below the cyan dye forming layer of a color photographic element. U.S. Pat. No. 3,820,997 describes improvement by various compounds in the processing bath. Further, U.S. Pat. No. 3,774,510 proposes addition of water soluble ionic compounds containing polyvalent elements in bleach-fixing bath. U.S. Pat. Nos. 4,151,680, 4,374,922 and 4,591,546 describe a group of preferred cyan couplers capable of overcoming the problems described above.

As a method of improving the blix discoloration, a method of improvement by using a certain type of hydroquinone or quinine derivatives is described, for example, in JP-A No. 63-316857. However, such prior art involves drawbacks that the effect is insufficient or the photographic performance such as image conservation property is sacrificed, and a great burden is put on the disposal of liquid wastes. Further, in the prior art described above, no sufficient solutions have yet been reached even in a case of using a bleach-fixing solution using EDTA complex ferric salts or PDTA complex ferric salts, as well as complex ferric salts of the biodegradable chelating agents. Accordingly, it has been demanded for the technique free from the foregoing drawbacks and having a greater effect for preventing blix discoloration of the cyan dye, also with a view point of rapid processing or undesired effects on the environment in recent years.

On the other hand, an attempt for the improvement of the blix discoloration of the cyan dye by using a polymer latex has also been conducted so far and, for example, JP-A Nos. 64-52136 and 2-289840 disclose methods of using polymer latexes having alkoxyalkyl groups on the side chains. However, the improving effect is still insufficient even with the compounds and, particularly, in a case of conducting rapid development processing with low replenishing amount rapidly and conveniently, it is necessary to improve the performance.

Polymer latexes formed by copolymerizing monomers having —COOH groups are well known in the field of photographic materials and, for example, U.S. Pat. No. 3,287,289 discloses a copolymer of n-butylacrylate and acrylic acid or methacrylic acid. Further, while JP-A No. 11-84559 describes that the improving effect is increased by controlling the pH of the coating solution to an acidic region, it can not be said that the improved level is at a sufficient level.

Further, in recent years, digital laboratories systems of recording images recorded on photographic films on photographic paper (photosensitive material) have been increased and processing stability can be ensured easily by calibrating correction. However, it is not preferred to conduct calibrating correction each time when coloring property changes, since such frequent corrections lower productivity.

The properties demanded for the photographic paper used for color printing so far have been performances such as image quality, rapid processibility and image conservation property, but in recent years the possibility of printing based on digitalized image information has arisen as one of important properties. This is because systems of preparing color printing by digitalized image data as represented by Frontier series manufactured by Fuji Photo Film Co., Ltd. and infrastructure capable of easily obtaining high image photographic prints by utilizing digital image processing techniques have been established. Since optimization of printed images based on more complicate algorithms will be possible in the future by the improvement of the computer processing performance more and more, it is expected that the image quality of color prints will be improved further. Further, there are subjects for developing digital print systems and improving the digital adaptability of photographic paper such as capability of providing various services depending on users by improvement in the compatibility with input equipments for digital cameras, digital video movies or scanners other than negative films.

On the other hand, commercial production systems for color prints are generally classified into mass-productive, low cost and intensively served, so-called major laboratories, and small-lot productive on-site, community based mini-laboratories. In view of the difference in respective color print production systems, means for solutions can not generally be in common even for common subjects, but selective production of photographic paper specialized to respective systems is not preferred since this will result in loss in the production sites and loss in the distribution process of photographic materials.

Accordingly, various improvements are necessary such that the photographic paper can cope with both systems of analog (surface) exposure in major laboratories and scanning exposure by a solid or semiconductor laser light in the Frontier systems.

In a case of forming images based on digitalized image data such as in CG (computer graphics), an importance resides in capability of reproducing so-called solid image which is uniform, and has an extremely small density difference with relatively large area. However, it has been found that rough unevenness, which is different from banding, tends to occur when scanning exposure is conducted by using a solid or semiconductor laser light in the development processing system of mini-laboratories with less replenishing amount compared with the development processing in large scaled laboratories by using a coupler forming a cyan dye of high saturation.

SUMMARY OF THE INVENTION

The present invention intends to overcome the foregoing problems in the prior art and attain the following purposes.

That is, the invention intends, firstly, to provide a method of forming images excellent in the color purity and excellent in the adaptability for rapid high speed production processing and color image reservation property after processing. More specifically, it intends to provide an image forming method for suppressing color bleeding during storage after color image formation while improving the cyan color purity.

The invention intends, secondly, to provide an image forming method providing color photographs of stabilizing a cyan density in color images, with no deterioration for the cyan coloring density by the blix discoloration when a silver halide photographic material is put to color development processing, as well as a silver halide color photographic photosensitive material.

The invention intends, thirdly, to provide a silver halide photographic material and an image forming method suitable to image output based on the image information (particularly, digital data) and capable of reproducing images at high saturation. More specifically, it intends to provide a silver halide color photographic photosensitive material and an image forming method providing high saturation and less unevenness in solid images when applying scanning exposure by solid and/or semiconductor laser and development processing at low replenishing amount, and an image forming method.

The present inventors have made earnest studies and accomplished the invention based on the findings that purposes of the invention can be attained by the following means.

The first embodiment of an image forming method of the invention provides an image forming method comprising: a step of imagewise exposing a silver halide color photographic photosensitive material having, on a support, photographic constituent layers comprising at least one blue sensitive silver halide emulsion layer containing a yellow dye forming coupler, at least one green sensitive silver halide emulsion layer containing a magenta dye forming coupler, at least one red sensitive silver halide emulsion layer containing a cyan dye forming coupler, and at least one non-photosensitive hydrophilic colloid layer; a color developing step; a bleach-fixing step; and a rinsing step, wherein: at least one of the red sensitive silver halide emulsion layer contains at least one compound represented by the following general formula (IA), the total non-volatile oil soluble component/gelatin ratio of the red sensitive silver halide emulsion layer is in a range of 0.7 to 1.1, a total coating amount of gelatin of the photographic constituent layers is 4.0 g/m$^2$ to 7.0 g/m$^2$, and the calcium content in the rinsing solution in the final processing bath of the rinsing step is 5 mg/liter or less, General formula (IA)

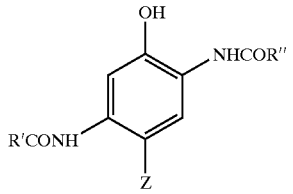

wherein R' and R" each independently represent a substituent, Z represents a hydrogen atom or a group capable of being removed by coupling reaction with an oxidant of an aromatic primary amine color developing agent.

The second embodiment of an image forming method of the invention provides an image forming method of the first embodiment, wherein at least one of the at least one green sensitive silver halide emulsion layer contains at least one compound represented by the general formula (M-II), and the total non-volatile oil soluble component/gelatin ratio in the green sensitive silver halide emulsion layer is in a range of 0.8 to 1.1, General formula (M-II)

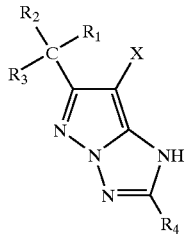

wherein $R_1$, $R_2$, $R_3$ and $R_4$ each independently represent a hydrogen atom or a substituent; and X represents a hydrogen atom or a group capable of being removed by reaction with an oxidant of an aromatic primary amine color developing agent.

The third embodiment of an image forming method of the invention provides an image forming method of the first embodiment, wherein the silver halide color photographic photosensitive material is subjected to scanning exposure with an exposure time of $10^{-3}$ sec or less per pixel.

The fourth embodiment of an image forming method of the invention provides an image forming method of the first embodiment, wherein the total coating amount of silver of the silver halide color photographic photosensitive material is 0.47 g/m$^2$ or less.

The fifth embodiment of an image forming method of the invention provides an image forming method comprising: a step of imagewise exposing a silver halide color photographic photosensitive material having, on a support, photographic constituent layers comprising at least one blue sensitive silver halide emulsion layer containing a yellow dye forming coupler, at least one green sensitive silver halide emulsion layer containing a magenta dye forming coupler, at least one red sensitive silver halide emulsion layer containing a cyan dye forming coupler, and at least one non-photosensitive hydrophilic colloid layer; a color developing step; a bleach-fixing step; and a rinsing step, wherein: at least one of the at least one red sensitive silver halide emulsion layer contains at least one compound represented by the following general formula (IA), and the bleach-fixing step is conducted under the conditions that an average replacement rate Ta for a bleach-fixing solution is 12.0 or less and an opening degree K of a bleach-fixing bath is 0.007 ($cm^{-1}$) or less, General formula (IA)

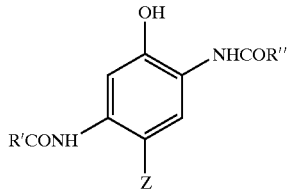

wherein R' and R" each independently represent a substituent, Z represents a hydrogen atom or a group capable of being removed by coupling reaction with an oxidant of an aromatic primary amine color developing agent.

The sixth embodiment of an image forming method of the invention provides an image forming method of the fifth embodiment, wherein the silver halide color photographic photosensitive material is subjected to scanning exposure for an exposure time of $10^{-3}$ sec or less per pixel.

The seventh embodiment of an image forming method of the invention provides an image forming method of the fifth embodiment, wherein the total coating amount of silver in the silver halide color photographic photosensitive material is 0.47g/$m^2$ or less.

The eighth embodiment of an image forming method of the invention provides an image forming method of the fifth embodiment, wherein at least one of the at least one green sensitive silver halide emulsion layer contains at least one compound represented by the following general formula (M-II), General formula (M-II)

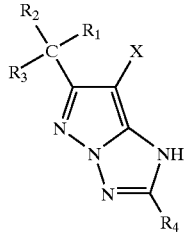

wherein $R_1$, $R_2$, $R_3$ and $R_4$ each independently represent a hydrogen atom or a substituent, X represents a hydrogen atom or a group capable of being removed by reaction with an oxidant of an aromatic primary amine color developing agent.

The ninth embodiment of an image forming method of the invention provides an image forming method of the fifth embodiment, wherein the bleach-fixing step is conducted for 45 sec or less.

The 10th embodiment of an image forming method of the invention provides an image forming method comprising: a step of imagewise exposing a silver halide color photographic photosensitive material having, on a support, photographic constituent layers comprising at least one blue sensitive silver halide emulsion layer containing a yellow dye forming coupler, at least one green sensitive silver halide emulsion layer containing a magenta dye forming coupler, at least one red sensitive silver halide emulsion layer containing a cyan dye forming coupler, and at least one non-photosensitive hydrophilic colloid layer; a color developing step; a bleach-fixing step; and a rinsing step, wherein: the step of imagewise exposing the silver halide color photographic photosensitive material is conducted by a laser scanning exposure system using a solid and/or semiconductor laser modulated on the basis of image information; the color developing step is conducted with a replenishing amount of the color developer of 20 ml to 60 ml per 1 $m^2$ of the sliver halide color photographic photosensitive material; and the at least one red sensitive silver halide emulsion layer contains the cyan dye forming coupler at a coating density of 10 mg/$cm^3$ to 160 mg/$cm^3$.

The 11th embodiment of an image forming method of the invention provides an image forming method of the 10th embodiment, wherein the at least one red sensitive silver halide emulsion layer contains at least one of couplers represented by the following general formulae (PTA-I) and (PTA-II) at a coating density of 10 mg/$cm^3$ to 90 mg/$cm^3$, General formula (PTA-I)

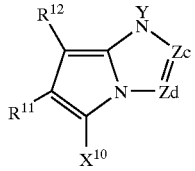

General formula (PTA-II)

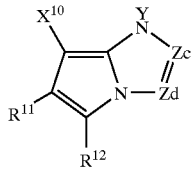

wherein one of Zc and Zd represents —C($R^{13}$)═, and the other represents —N═; $R^{11}$ and $R^{12}$ each represent an electron attractive group having a Hammett's substituent constant σp value of 0.2 or more; the sum of the σp values of $R^{11}$ and $R^{12}$ is 0.65 or more, $R^{13}$ represents a hydrogen atom or a substituent, $X^{10}$ represents a hydrogen atom or a group capable of being removed by coupling reaction with an oxidant of an aromatic primary amine color developing agent; Y represents a hydrogen atom or a group capable of being removed in a color developing process; and the group $R^{11}$, $R^{12}$, $R^{13}$ and $X^{10}$ may each represent a bivalent group bonded with a dimer or higher polymer or a polymeric chain to form a homopolymer or a copolymer.

The 12th embodiment of an image forming method of the invention provides an image forming method as defined in the 10th embodiment, wherein the at least one red sensitive silver halide emulsion layer contains at least one coupler represented by the following general formula (IA) at a coating density of 70 mg/cm$^3$ to 130 mg/cm$^3$, General formula (IA)

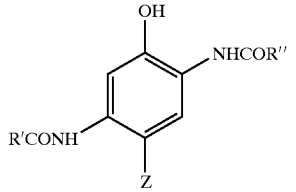

wherein R' and R" each independently represent a substituent; and Z represents a hydrogen atom, or a group capable of being removed by coupling reaction with an oxidant of an aromatic primary amine color developing agent.

The first embodiment of a silver halide color photographic photosensitive material of the invention provides a silver halide color photographic photosensitive material which comprises, on a support, photographic constituent layers including at least one blue sensitive silver halide emulsion layer containing a yellow dye forming coupler, at least one green sensitive silver halide emulsion layer containing a magenta dye forming coupler, at least one red sensitive silver halide emulsion layer containing a cyan dye forming coupler, and at least one non-photosensitive hydrophilic colloid layer, and undergoes an imagewise exposure step, a color developing step, a bleach-fixing step and a rinsing step, wherein: at least one of the at least one red sensitive silver halide emulsion layer contains at least one compound represented by the following general formula (IA); and the silver halide color photographic photosensitive material shows a photographic characteristic such that a cyan density change ΔDc after development processing is 0.02 or less when the bleach-fixing step is conducted under the conditions that an average replacement rate Ta of a bleach-fixing solution is 12.0 or less and an opening degree K of a bleach-fixing bath is 0.007 (cm$^{-1}$) or less, General formula (IA)

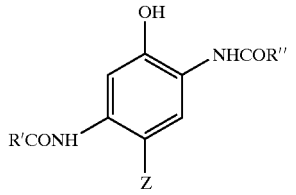

wherein R' and R" each independently represent a substituent, and Z represents a hydrogen atom or a group capable of being removed by coupling reaction with an oxidant of an aromatic primary amine color developing agent.

The second embodiment of a silver halide color photographic photosensitive material of the invention provides a silver halide color photographic photosensitive material of the first embodiment, wherein the silver halide color photographic photosensitive material is subjected to scanning exposure for an exposure time of $10^{-3}$ sec or less per pixel.

The third embodiment of a silver halide color photographic photosensitive material of the invention provides a silver halide color photographic photosensitive material of the first embodiment, wherein the total coating amount of silver in the silver halide color photographic photosensitive material is 0.47 g/m$^2$ or less.

The fourth embodiment of a silver halide color photographic photosensitive material of the invention provides a silver halide color photographic photosensitive material of the first embodiment, wherein at least one of the at least one green sensitive silver halide emulsion layer contains at least one compound represented by the following general formula (M-II), General formula (M-II)

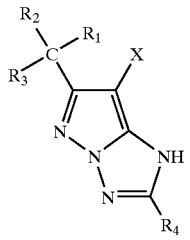

wherein $R_1$, $R_2$, $R_3$ and $R_4$ each independently represent a hydrogen atom or a substituent; and X represents a hydrogen atom or a group capable of being removed by coupling reaction with an oxidant of an aromatic primary amine color developing agent.

The fifth embodiment of a silver halide color photographic photosensitive material of the invention provides a silver halide color photographic photosensitive material of the first embodiment, wherein the bleach-fixing step is conducted for 45 sec or less.

The sixth embodiment of a silver halide color photographic photosensitive material of the invention provides a silver halide color photographic photosensitive material which comprises, on a support, photographic constituent layers including at least one blue sensitive silver halide emulsion layer containing a yellow dye forming coupler, at least one green sensitive silver halide emulsion layer containing a magenta dye forming coupler, at least one red sensitive silver halide emulsion layer containing a cyan dye forming coupler, and at least one non-photosensitive hydrophilic colloid layer, wherein the at least one red sensitive silver halide emulsion layer contains the cyan dye forming coupler at a coating density of 10 mg/cm$^3$ to 160 mg/cm$^3$.

The seventh embodiment of a silver halide color photographic photosensitive material of the invention provides a silver halide color photographic photosensitive material of the sixth embodiment, wherein the at least one red sensitive silver halide emulsion layer contains at least one of couplers represented by the following general formulae (PTA-I) and (PTA-II) at a coating density of 10 mg/cm$^3$ to 90 mg/cm$^3$, General formula (PTA-I)

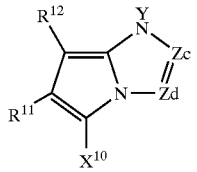

General formula (PTA-II)

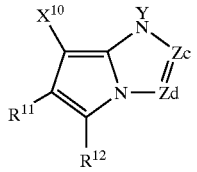

wherein one of Zc and Zd represents —C($R^{13}$)=, and the other represents —N=; $R^{11}$ and $R^{12}$ each represent an electron attractive group having a Hammett's substituent constant σp value of 0.2 or more; the sum of the σp values of $R^{11}$ and $R^{12}$ is 0.65 or more; $R^{13}$ represents a hydrogen atom or a substituent; $X^{10}$ represents a hydrogen atom or a group capable of being removed by coupling reaction with an oxidant of an aromatic primary amine color developing agent; Y represents a hydrogen atom or a group capable of being removed in a color development process; and $R^{11}$, $R^{12}$, $R^{13}$ and $X^{10}$ may each represent a bivalent group bonded with a dimer or higher polymer or a polymeric chain to form a homopolymer or a copolymer.

The eighth embodiment of a silver halide color photographic photosensitive material of the invention provides a silver halide color photographic photosensitive material of the sixth embodiment, wherein the at least one red sensitive silver halide emulsion layer contains at least one coupler represented by the following general formula (IA) at a coating density of 70 mg/cm$^3$ to 130 mg/cm$^3$, General formula (IA)

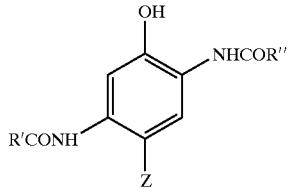

wherein R' and R" each independently represent a substituent; and Z represents a hydrogen atom or a group capable of being removed by coupling reaction with an oxidant of an aromatic primary amine color developing agent.

DETAILED DESCRIPTION OF THE INVENTION

[Image Forming Method—First Embodiment—]

As an image forming method of the present invention, the first embodiment is to be described specifically. In the first embodiment of an image forming method of the invention, a silver halide color photographic photosensitive material is exposed imagewise and then applied to a developing process to form images.

Firstly, the silver halide color photographic photosensitive material is exposed imagewise on the basis of image formation. As the exposure system, a digital scanning exposure system using a monochromatic high density light such as of a gas laser, light emitting diode, semiconductor laser, and a second harmonic light generating optical source (SHG) comprising a combination of a semiconductor laser or a solid laser using a semiconductor laser as the exciting light source and non-linear optical crystals is used preferably. Use of the semiconductor laser or the second harmonic wave generating optical source (SHG) comprising a combination of a semiconductor laser or a solid laser and non-linear optical crystals is preferred in order to make the system compact and inexpensive. Use of the semiconductor laser is particularly preferred for designing a device which is compact and inexpensive and has long life and high stability, and use of the semiconductor laser for at least one of the exposure light sources is preferred.

In the use of the scanning exposure light source, the maximum wavelength for the spectral sensitivity of the photosensitive material can be set optionally according to the wavelength of the scanning exposure light source used. In the SHG light source obtained by the combination of the solid laser using the semiconductor laser as the exciting light source or the semiconductor laser and the non-linear optical crystals, blue light or green light is obtained since the oscillation wavelength of the laser can be reduced to one-half. Accordingly, the maximum spectral sensitivity of the photosensitive material can be provided usually in the three wavelength regions of blue, green and red. When the exposure time per pixel in the scanning exposure is defined as the time for exposing the pixel size at a pixel density of 400 dpi, the preferred exposure time is $10^{-3}$ sec or less and, more preferably, $10^{-4}$ sec or less, and further preferably, $10^{-6}$ sec or less. The effect of the first embodiment of the invention more tends to occur under the condition where the reciprocity law failure is caused upon exposure at high illuminance and silver development less occurs in a shadow area, but similar effect can be obtained also upon exposure at low illuminance.

As the semiconductor laser light source, a blue semiconductor laser at a wavelength of 430 to 450 nm (reported by Nichia Kagaku in Associates Meeting of 48th Applied Physic Conference, in March 2001), a blue laser at about 470 nm obtained by taking out a semiconductor laser (oscillation wavelength: about 940 nm) under wavelength conversion by SHG crystals of $LiNbO_3$ having an inverted domain structure in the form of a waveguide channel, a green laser at about 530 nm obtained by wavelength conversion of a semiconductor laser (oscillation wavelength: about 1060 nm) by SHG crystals of $LiNbO_3$ having an inverted domain structure in the form of a waveguide channel, a red semiconductor laser at a wavelength of about 685 nm (Hitachi type No. HL6738MG), and a red semiconductor laser at a wavelength of about 650 nm (Hitachi type No. HL6501MG), etc. can be used preferably.

Particularly, it is preferred for imagewise exposure by a coherent light of a blue laser at an oscillator wavelength of 430 to 460 nm and, among the blue lasers, the blue semiconductor laser is particularly preferred.

The imagewise exposure may be conducted for plural times to an identical photosensitive layer (emulsion layer) of the silver halide photographic material in which exposure is preferably conducted to at least three times. Particularly preferably, the exposure time is from $10^{-4}$ to $10^{-8}$ sec. In a case where the exposure time is from $10^{-5}$to $10^{-8}$ sec, exposure is applied preferably for at least 8 times. While any of light sources may be used, for example, the gas laser, solid laser, (LD), LED (organic and inorganic), and Xe light source with restricted spot described above, and the solid laser or LED is particularly preferred. It is necessary that the light source is spectralized to the color sensitive wave length of each dye forming layer, and color filters (dyes are contained or vapor deposited) or LD or LED selected to appropriate oscillation wavelength may be used for this purpose. Both of them may be used in combination. There is no particular restriction on the spot diameter of the light source and it is preferably from 5 to 250 $\mu$m and, particularly, 10 to 100 $\mu$m as the half-value width of the light intensity. The shape of the spot may be circular, elliptic or rectangular. The distribution for the optical amount of 1 spot may form a Gaussian distribution or a trapezoidal distribution of a relatively constant intensity. A single light source may be used but a plurality of light sources may be arranged as an array.

Imagewise exposure is preferably conducted by scanning exposure, in which the optical source may be scanned or the photosensitive material may be scanned. Further, both of them may be scanned.

The exposure time for once is defined by the following equation:

Exposure time=spot diameter/light source moving speed (or photosensitive material moving speed)

The spot diameter means a diameter of the spot in the direction where the optical source used for scanning exposure moves upon exposure (semi-value width, unit: μm). The moving speed of the light source means a speed at which the light source used for scanning exposure moves per unit time (unit: μm/sec). Generally, it is not necessary that the spot diameter is equal with the diameter for the pixel but it may be larger or smaller than the pixel diameter. The number of cycles of exposure referred to in the first embodiment of the image forming method according to the invention is the number of cycles of irradiation of light sensitive to an identical color sensitive layer with respect to one point (pixel) on the photosensitive material, and it means the number of cycles of exposure at an intensity of ⅕ or more relative to the exposure at the maximum exposure intensity in the case of irradiation for several cycles. Accordingly, exposure at less than ⅕, stray lights or inter-spot overlaps are not included in the number of cycles of exposure.

An exposure method used for a printing system using a usual negative printer or a scanning exposure system using a cathode ray tube (CRT) can also be conducted not being restricted to the scanning exposure system using the optical source described above. The cathode ray tube exposure apparatus is simple and convenient and compact and requires a lower cost compared with the apparatus using laser. Further, control for the optical axes and colors are also easy. Various kinds of light emitting materials showing emission in spectral regions are used optionally for the cathode ray tube used for imagewise exposure. For example, one of red emission material, green emission material and blue emission material or a mixture of two or more of them is used. The spectral region is not restricted to red, green and blue regions described above but phosphorescent materials emitting light in yellow, orange, purple or infrared region can also be used. Particularly, a cathode ray tube emitting white light by the mixing of the light emission materials is often used.

Further, in a case where the photosensitive material has a plurality of photosensitive layers having different spectral sensitivity distributions and the cathode ray tube also has fluorescent materials exhibiting light emission in plurality of spectral regions, a plurality of colors may be exposed at once, that is, image signals for a plurality of colors may be inputted to the cathode ray tube to emit light from the tube surface. A method of successively inputting image signals on every colors to emit lights for respective colors successively and then conducting exposure through films for cutting colors other than the intended color (successive surface exposure) may also be adopted. Generally, since a cathode ray tube of high resolution can be used, the successive surface exposure is preferred for higher image quality.

Then, the imagewise exposed silver halide color photographic photosensitive material is applied with development processing. The development processing includes a color developing step of developing a silver halide color photographic photosensitive material with a color developer, and a bleach-fixing step of using a bleach-fixing solution, a rinsing step of using a rinsing solution (washing water and/or stabilizing solution) (water washing and/or stabilizing step). The silver halide color photographic photosensitive material is subjected to the development processing by successively dipping the material into each of the processing solutions in each of the steps. The development processing is not restricted only to them but an auxiliary step such as an intermediate water washing step or a neutralization step may be inserted between each of the steps. The bleach-fixing step may be conducted by one step using the bleach-fixing solution or by two steps comprising the bleaching step and fixing step using a bleaching solution and a fixing solution.

The rinsing step is a step of ensuring the performance after processing by washing out processing liquid components deposited to or absorbed in the silver halide color photographic photosensitive material and photosensitive material constituent ingredients which are no more necessary in the course of the processing. The rinsing step is desirably constituted with two or more multi-number of baths and, preferably, 2 to 6 baths and, more preferably, 2 to 4 baths, and it is preferred that the rinsing liquid supplementing solution is supplemented by a multi-stage counter current system by an amount of from 2 to 50 times by volume and, preferably, 3 to 30 times by volume of the amount carried from the preceding bath per unit area of the photosensitive material to be processed.

It is necessary that the calcium content in the rinsing solution in the final processing bath of the rinsing step (washing water and/or stabilizing solution) is 5 mg per liter or less, preferably, 3 mg/liter or less. In a case where the rinsing step is conducted by one processing bath, the calcium content in the rinsing solution used in the processing bath is controlled within the range as described above. In a case of conducting the rinsing step in a multi-stages by using two or more processing baths, the calcium content in the rinsing solution used at least in the final processing bath is controlled within the range as described above and, preferably, the calcium content in the rinsing solution of the processing baths excepting for the uppermost stream bath is preferably defined within the range as described above.

The calcium content in the rinsing solution can be controlled to the range described above by various known methods and, specifically, the range described above can be attained suitably by using an ion exchanging apparatus or reverse osmotic apparatus. Further, a method of decreasing calcium and magnesium as described in JP-A No. 62-288838 can also be applied extremely effectively.

As the ion exchanging apparatus, known apparatus can be used in which various kinds of cationic resins can be used for ion exchange resins to be provided in the apparatus, and use of Na type cationic exchange resins that exchange Ca and Mg with Na are preferred. Further, H type cationic exchange resins can also be used, and it is preferably used together with OH type anionic exchange resins since pH of the rinsing solution becomes acidic in this case.

A strongly acidic cationic exchange resin having a styrene-divinyl benzene polymer as a substrate and having sulfone groups as ionic exchange groups is preferred for the ion exchange resin. Examples of such ion exchange resin can include, for example, DAIYA ION SK-1B or DAIYA ION PK-216, trade name of products manufactured by Mitsubishi Kasei Co. In the substrate of the ion exchange resin, it is preferred that the charging amount of divinyl benzene is 4 to 16% based on the entire amount of the monomer to be charged upon production. The anionic exchange resin that can be used in combination with the H-type cationic exchange resin is preferably a strongly basic anion exchange resin having a styrene-divinyl benzene copolymer as a substrate and tertiary amine or quaternary ammonium groups as exchange groups. Examples of such anionic exchange resin can include, for example, DAIYA ION SA-10A or DAIYA ION PA-418, trade name of products also manufactured by Mitsubishi Kasei Co. Calcium in the rinsing solution can be removed by the ion exchange resins described above using any of the known methods. Preferably, liquid is passed through a column filled with the ion exchange resin. The rinsing solution passing speed is 1 to 100 times, preferably, 5 to 50 times by volume of the resin per 1 hour.

As the reverse osmotic processing apparatus, known apparatus can be used and cellulose acetate films, ethyl cellulose-polyacrylic acid films, polyacrylonitrile films, polyvinylene carbonate films and polyether sulfone films can be used suitably as the reverse osmotic films provided in the apparatus. Further, the reverse osmotic pressure of 5 to 60 kg/cm$^2$ is usually used but a pressure of 30 kg/cm$^2$ or less may suffice in order to control the calcium content within the range described above, and the apparatus referred to as low pressure reverse osmotic apparatus at 10 kg/cm$^2$ or less can also be used satisfactorily.

As the structure of the reverse osmotic membrane, any of spiral, tubular, hollow fiber, pleats or rod type may be used.

Water is used for the solvent of the rinsing solution and the conductivity of water is, preferably, 10 $\mu$S/cm, more preferably, 5 $\mu$S/cm or less. For obtaining water having such a conductivity, ion exchanged water put to ion exchange by the ion exchanging apparatus described above can be used suitably.

A processing agent may be added optionally to the rinsing solution although it shows no remarkable effect. As the processing solution, isothiazolone compounds or thiabendazoles described in JP-A No. 57-8542, chlorine sterilizers such as chlorinated sodium isocyanurate as described in JP-A No. 61-120145, benzotriazole and copper ions described in JP-A No. 61-267761, as well as sterilizers described in "Anti-Bacterial and Anti-Mold Chemistry" written by Hiroshi Horiguchi, edited by Eisei Gijutsukai, published from Sankyo Shuppan (1986), and sterilizers described in "Suppression and Sterilization of Microorganisms and Anti-Mold Technique" edited by Eisei Gijutsukai, published from Kogyo Gijutsukai (1982), and "Anti-Bacterial and Anti-Mold Encyclopedia" edited by Nippon Anti-Bacterial and Anti-Mold Society (1986) can also be used. Further, for inactivating remaining magenta coupler to prevent discoloration of dyes and formation of stains, aldehydes such as formaldehyde, acetoaldehyde and pyruvic aldehyde, methylol compounds and hexamethylenetetramine described in U.S. Pat. No. 4,786,583, hexehydrotriazines described in JP-A No. 2-153348, formaldehyde-hydrogen sulfite addition products described in U.S. Pat. No. 4,921,779 and azolylmethyamines described, for example, in EP-A Nos. 504609 and 519190 may also be added. Further, a surfactant as a draining agent and a chelating agent represented by EDTA as a hard water softening agent can also be used.

Each of the development processing solutions is used usually while being replenished. Preferably, the replenishing amount for the color developer is from 20 ml to 60 ml per 1 m$^2$ of the photosensitive material, the replenishing amount of the bleach-fixing solution is from 20 ml to 50 ml per 1 m$^2$ of the photosensitive material and the replenishing amount of the rinsing solution (washing water and/or stabilizing solution) is from 50 ml to 1,000 ml for the entire rinsing solution and, further, they can be replenished also in accordance with the area of the silver halide color photographic photosensitive material to be developed.

The color development time (that is, the time for conducting the color developing step) is, preferably, 45 sec or less, more preferably, 30 sec or less, further preferably, 28 sec or less and, particularly preferably, 25 sec or less and 6 sec or more and, most preferably, 20 sec or less and 6 sec or more. In the same manner, the bleach-fixing time (that is the time for conducting bleach-fixing step) is, preferably, 45 sec or less, more preferably, 30 sec or less, further preferably, 25 sec or less and 6 see or more, and particularly preferably, 20 sec or less and 6 sec or more. Further, the rinsing time (water washing or stabilizing time) (that is, time for conducting the rinsing step) is preferably 90 sec or less, more preferably 30 sec or less, and further preferably 6 sec or more and 30 sec or less.

The color development time is a time from the dipping of the photosensitive material in the color developer to the dipping of the material in the bleach-fixing solution of the next processing step. For example, in a case of processing by an automatic developing machine, the color development time is the total for a time during which the photosensitive material is being dipped in the color developer (so-called, in-solution time) and a time during which the photosensitive material leaves the color developer and is being conveyed in air to the bleach-fixing solution of the next processing step (so-called, in-air time). In same manner, the bleach-fixing time is a time from the dipping of the photosensitive material in the bleach-fixing solution to dipping of the material in the succeeding water washing or stabilizing bath. Further, the rinsing (water washing stabilizing) time is a time during which the photosensitive material stays in the rinsing solution (water washing and stabilizing solution) from the dipping of the material in the solution till the succeeding drying step (so-called, in-solution time).

Then, for the silver halide color photographic photosensitive material applied with the development processing, a post treatment such as a drying step is applied. In the drying step, drying can be accelerated by absorbing the water content with a squeeze roller or cloth immediately after the development processing (rinsing step) with a view point of decreasing the amount of water carried to the image film of the silver halide color photographic photosensitive material. As a matter of factor, the drying can be accelerated by elevating the temperature or modifying the shape of a blowing nozzle to strengthen the drying blow. Further, as described in JP-A No. 3-157650, drying can be accelerated also by adjusting the angle of blow of the drying blow to the photosensitive material and by the method of removing discharged blow.

As described above, images are outputted to the silver halide color photographic photosensitive material.

Other preferred embodiments in the first embodiment of the image forming method according to the invention are to be described.

The first embodiment of the image forming method of the invention can be used preferably in combination with the exposure and development systems described in the following known documents. The development system can include an automatic printing and a developing system as described in JP-A No. 10-333253, a photosensitive material conveying apparatus as described in JP-A No. 2000-10206, a recording system including an image reading apparatus as described in JP-A No. 11-215312, and exposure systems comprising color image recording systems described in JP-A Nos. 11-88619 and 10-202950, a digital photo-printing system including a remote diagnosis system as described in JP-A No. 10-210206, and an image recording apparatus as described in the specification of U.S. Pat. No. 6,297,873B1.

Further, the scanning exposure system is described in details in the patent documents shown in the following Table 1.

Further, upon imagewise exposure, a band stop filter as described in the specification of U.S. Pat. No. 4,888,0726 is used preferably. This can eliminate optical color mixing to remarkably improve the color reproducibility.

Further, as described in the specifications of EP Nos. 0789270A1 and 0789480A1, a yellow micro dot pattern may be previously pre-exposed before applying the image information and copy regulation may be applied.

Further, processing materials and processing methods described in page 26, lower right column, line 1 to page 34, upper right column, line 9 of JP-A No. 2-207250, and in page 5, upper left column, line 17 to page 18, lower right column, line 20 of JP-A No. 4-97355 are preferably applied for the development processing. Further, for preservative agents used for the developer, those compounds described in patent documents listed in Table 1 to be described later are used preferably.

Typically, processing is conducted using MINILABO "PP350", manufactured by Fuji Photo Film Co., Ltd. as the color development processing and CP48S CHEMICAL as the processing agent, and the photosensitive material is exposed imagewise from a negative film at an average density and using a processing solution, conducting continuous processing till the volume of the color developing replenishing solution reaches twice the volume of the color development tank volume.

Chemicals for the processing agent may be those manufactured by Fuji Photo Film Co., Ltd.

Further, as the development processing method, a wet process such as a method of development by a developer containing an alkali agent and a developing agent and a method of incorporating a developing agent in a photosensitive material and conducting development by an activator solution such as an alkali solution not containing a developing agent, as well as a thermal developing process not using a processing solution known so far can also be used. Particularly, an activator method is preferred since it does not contain the developing agent in the processing solution and easy for the control and handling of the processing solution, as well as it gives less burden on disposal of liquid wastes in view of the environmental protection.

In the activator method, as the developing agent or a precursor thereof incorporated in the photosensitive material, hydrazine type compounds described, for example, in JP-A Nos. 8-234388, 9-152686, 9-152693, 9-211814, and 9-160193 are preferred.

Further, a developing method of decreasing the coating amount of silver of the photosensitive material and applying an image intensifying processing by using hydrogen peroxide (intensified processing) is also used preferably. It is particularly preferred to adopt the method for the activator method. Specifically, image forming methods using activator solutions containing hydrogen peroxide described in JP-A Nos. 8-297354 and 9-152695 are used preferably. In the activator method described above, after the processing by the activator solution, a desilvering treatment is usually applied. In the image intensifying method by using a photosensitive material at low silver content, the desilvering treatment may be saved and a simple method such as water washing or stabilizing processing can be conducted. Further, in a system of reading the image information from the photosensitive material, for example, by a scanner, processing not requiring the desilvering treatment can be adopted also in a case of using a photosensitive material at high silver content such as photographic material.

Processing materials and processing methods for the activator solution, desilvering solution (bleach-fixing solution), water washing and stabilizing solutions known per se can be used. Preferably, those described in the Research Disclosure Item 36544 (September 1994), pp 536–541 and in JP-A No. 8-234388 can be used.

The silver halide color photographic photosensitive material applied to the first embodiment of the image forming method of the invention (hereinafter referred to as photosensitive material) is to be described.

The photosensitive material comprises, on a support, photographic constituent layers including at least one blue sensitive silver halide emulsion layer containing a yellow dye forming coupler, at least one green sensitive silver halide emulsion layer containing a magenta dye forming coupler, at least one red sensitive silver halide emulsion layer containing a cyan dye forming coupler, and at least one non-photosensitive hydrophilic colloid layer. The silver halide emulsion layer containing the yellow forming coupler functions as a yellow color forming layer, the silver halide emulsion layer containing the magenta dye forming coupler functions as a magenta color forming layer, and the silver halide emulsion layer containing the cyan dye forming coupler functions as a cyan color forming layer. The silver halide emulsion contained in each of the yellow color forming layer, the magenta color forming layer and the cyan color forming layer preferably has photosensitivity to the light in the wavelength region different from each other (for example, light in blue region, green region and red region).

The photosensitive material may also have an antihalation layer, an intermediate layer and a colored layer optionally as a non-photosensitive hydrophilic colloid layer to be described later in addition to the yellow color forming layer, the magenta color forming layer and the cyan color forming layer.

The photosensitive material contains at least one member selected from the compounds represented by the general formula (IA) to be described later as a cyan dye forming coupler to the red sensitive silver halide emulsion layer and has a total non-volatile oil soluble component/gelatin ratio in the red sensitive silver halide emulsion layer of 0.7 or more and 1.1 or less and a total coating amount of the photographic constituent layers of 4.0 g/m$^2$ to 7.0 g/m$^2$. Further, the green sensitive silver halide emulsion layer preferably contains at least one member selected from the compound represented by the general formula (M-I) (particularly, general formula (M-II)) to be described later as a magenta dye forming coupler and the preferably has a total non-volatile oil soluble component/gelatin ratio in the green sensitive silver halide emulsion layer of in a range of 0.8 to 1.1.

The non-volatile oil soluble component/gelatin ratio is represented by the number of grams of each of their coating amount and it is necessarily in a range of 0.7 to 1.1, preferably in a range of 0.8 to 1.1, and more preferably in a range of 0.9 to1.0 in a case of the red sensitive silver halide emulsion layer. Further, in a case of the green sensitive silver halide emulsion layer, it is preferably in a range of 0.8 to 1.1, and more preferably in a range of 0.9 to 1.0.

The non-volatile oil soluble component is added to the silver halide color photographic photosensitive material with various purposes and has an amount dissolved per 100 g of water at 27° C. of 0.1 g or less and a boiling point of 150° C. or higher. The non-volatile oil soluble components mean compounds that are reacted with a color developing agent to form a dye (coupler), UV-ray absorbent for cutting unnecessary UV-rays, compounds enhancing the fastness of resultant images and compounds for inactivating the oxidant of the color developing agent.

The total coating amount of gelatin in the photographic constituent layers of the photosensitive material, that is, a total amount of the hydrophilic binder containing in the photosensitive silver halide emulsion layer and not-photosensitive hydrophilic colloidal layer from the support to the hydrophilic colloid layer most remote from the support on the side coated with the silver halide emulsion layer is, necessarily 4.0 g/m$^2$ to 7.0 g/m$^2$, preferably 4.5 g/m$^2$ to 6.5 g/m$^2$, and most preferably 5.0 g/m$^2$ to 6.0 g/m$^2$.

When the amount of the hydrophilic binder is more than the range described above, it sometimes lower the effect in the first embodiment for the image forming method of the invention, for example, by deteriorating the rapid developability, worsening the blix discoloration and deteriorating the rapid processability in the rinsing step (water washing step and/or stabilizing step). Further, when the amount of the gelatin (hydrophilic binder) is less than the range described above, it is not preferred since this tends to cause drawbacks due to insufficiency of film strength such as pressure fog streaks.

An explanation of a silver halide emulsion will be given.

Though a grain shape of the silver halide emulsion is not limited to particular one, the silver halide emulsion is preferably made of cubes essentially having {100} face, tetradecahedral grains (these may be roundish at the grain apices and have a higher dimensional face), octahedral grains, or tabular grains having a principal face of {100} face or {111} face and an aspect ratio of two or more. The aspect ratio means a value obtained by dividing a diameter of a circle equivalent to a projected area by a thickness of the grain. In the first embodiment of an image-forming method according to the invention, cubes or tetradecahedral grains are more preferable.

The silver halide emulsion comprises silver chloride, the content of the silver chloride is preferably 90 mol percent or more, and, from a viewpoint of rapid processing, the content of silver chloride is more preferably 93 mol percent or more, being furthermore preferably 95 mol percent or more.

Furthermore, the silver halide emulsion is preferable to contain one or both of silver bromide and silver iodide. The content of silver bromide, being excellent in the latent image stability in hard tone, is preferably 0.1 to 7 mol percent, and more preferably 0.5 to 5 mol percent. The content of silver iodide, being highly sensitive and exhibiting hard tone under high-illuminance exposure, is preferably 0.02 to 0.50 mol percent, more preferably 0.05 to 1 mol percent, and still more preferably 0.07 to 0.40 mol percent.

Still furthermore, the silver halide emulsion is preferably a silver iodobromochloride emulsion, being more preferably the silver iodobromochloride emulsion having the above halogen composition.

The silver halide emulsion is preferable to have one or both of a silver bromide-containing phase and a silver iodide-containing phase. Here, the silver bromide-containing phase or silver iodide-containing phase means a portion where the concentration of silver bromide or silver iodide is higher than that of the surroundings. The halogen composition between the silver bromide phase or silver iodide phase and the surroundings thereof may change continuously or may change precipitously. Such silver bromide- or silver iodide-containing phase may form, in a certain portion in a grain, a layer having a width in which the concentration is substantially constant, or a maximum point that has not an expanse. A local silver bromide content of the silver bromide phase is preferably 5 mol percent or more, being more preferably from 10 to 80 mol percent, being most preferably from 15 to 50 mol percent. A local silver iodide content of the silver iodide phase is preferably 0.3 mol percent or more, being more preferably from 0.5 to 8 mol percent, being most preferably 1 to 5 mol percent. Furthermore, such silver bromide- or silver iodide-containing phase each may be present plurally in layers in a grain, and the respective silver bromide contents or silver iodide contents may be different. However, it is necessary to have at the lowest at least one of the silver bromide-containing phase and the silver iodide-containing phase, preferably at the lowest one of each of the silver bromide-containing phase and the silver iodide-containing phase.

The silver bromide-containing phase or the silver iodide-containing phase of the silver halide emulsion is preferably in layers so as each of which to surround the grain. Each of the silver bromide-containing phases or the silver iodide-containing phases that are formed in layers so as to surround the grain, in one preferable embodiment, has a uniform concentration distribution in a go-around direction of the grain. However, in each of the silver bromide-containing phases or the silver iodide-containing phases that are formed in layers so as to surround the grain, the maximum point or minimum point of the silver bromide concentration or the silver iodide concentration may be in the go-around direction of the grain, that is, there may be a concentration distribution. For instance, when there are silver bromide-containing phases or silver iodide-containing phases in layers so as to surround the grain in the neighborhood of a grain surface, the concentration of silver bromide or silver iodide at the grain corners or edges may be in some cases different in the concentration from that of the main faces. Furthermore, different from the silver bromide-containing phase or the silver iodide-containing phase that are formed in layers so as to surround the grain, there may be silver bromide phases or silver iodide phases that are present completely isolated at particular portions on a surface of the grain and do not surround the grain.

When the silver halide emulsion contains a silver bromide-containing phase, the silver bromide-containing phases is preferably formed in layers so as to have the silver bromide concentration maximum inside of the grain. Furthermore, in a first embodiment of an image-forming method according to the invention, when the silver halide emulsion contains a silver iodide-containing phase, the silver iodide-containing phases is preferably formed in layers so as to have the silver iodide concentration maximum on a surface of the grain. Such silver bromide-containing phase or silver iodide-containing phase, in order to raise the local concentration thereof at the lower silver bromide concentration or silver iodide concentration, is preferably formed with an amount of silver of 3 percent or more and 30 percent or less of a volume of the grain, being more preferably formed with a silver amount of 3 percent or more and 15 percent or less.

The silver halide emulsion is preferable to contain both of the silver bromide-containing phase and the silver iodide-containing phase. In that case, the silver bromide-containing phase and the silver iodide-containing phase may be at the same position in the grain or may be at different positions thereof, however, these being present in different positions is preferable from a viewpoint of making the grain formation control easier. Furthermore, the silver bromide-containing phase may contain silver iodide, or inversely, the silver iodide-containing phase may contain silver bromide. In general, since iodide that is added during the formation of silver chloride-rich grain is likely to seep out on a grain surface than bromide does, the silver iodide-containing phase tends to be formed in the neighborhood of the grain surface. Accordingly, when the silver bromide-containing phase and the silver iodide-containing phase are present at different positions in the grain, the silver bromide-containing phase is preferably formed more inside of the silver iodide-containing phase. In such case, on more outside of the silver iodide-containing phase in the neighborhood of the grain surface, another silver bromide-containing phase may be disposed.

Since as the silver bromide-containing phase or the silver iodide-containing phase is formed inside of the grain, the silver bromide content or the silver iodide content of the silver halide emulsion increases, there may be caused a danger of unnecessarily reducing the silver chloride content and damaging the rapid processability. Accordingly, in order to collect the functions that control the photographic action in the neighborhood of the grain surface within the grain, the silver bromide-containing phase and the silver iodide-containing phase are preferably formed adjacently. From these points of view, the silver bromide-containing phase is preferably formed at any of positions from 50 to 100 percent of a grain volume measured from the inside of the grain and the silver iodide-containing phase is preferably formed at any of positions from 85 to 100 percent of a grain volume measured from the inside of the grain. Furthermore, the silver bromide-containing phase is more preferably formed at any of positions from 70 to 95 percent of a grain volume and the silver iodide-containing phase is more preferably formed at any of positions from 90 to 100 percent of a grain volume.

The introduction of bromide ions or iodide ions that allows the silver halide emulsion to incorporate silver bromide or silver iodide may be carried out by singly adding a solution of a bromide salt or an iodide salt or by adding, along with the addition of a silver chloride solution and a chloride salt-rich solution, a solution of a bromide salt or an iodide salt. In the latter case, the bromide salt solution or the iodide salt solution and the chloride salt-rich solution may be separately added, alternatively a mixture solution of the bromide salt or the iodide salt and the chloride-rich salt may be added. The bromide salt or the iodide salt is added in the form of a dissolvable salt such as alkali or alkali-earth bromides or iodides. Alternatively, a bromide ion or iodide ion can be split from an organic molecule described in U.S. Pat. No. 5,389,508 and can be introduced. Furthermore, as another bromide or iodide ion source, fine silver bromide particles or fine silver iodide particles may be used.

The solution of the bromide salt or the iodide salt may be added concentrated at one moment of the grain formation or over a certain time period. A position of introducing the iodide ion into the chloride-rich emulsion is restricted from a point of view of obtaining a high sensitivity and low fog emulsion. The introduction of the iodide ion, as introduced more inside of the emulsion grain, results in a smaller increase in the sensitivity. Accordingly, the addition of the iodide salt solution is preferably done more outside than 50 percent of the grain volume, more preferably more outside than 70 percent, most preferably more outside than 85 percent. Furthermore, the addition of the iodide salt solution is preferably terminated more inside than 98 percent of the grain volume, most preferably more inside than 96 percent. When the addition of the iodide salt solution is terminated a little inside from the grain surface, an emulsion having higher sensitivity and lower fog can be obtained.

On the other hand, the bromide salt solution is preferably added more outside than 50 percent of the grain volume, being more preferably added more outside than 70 percent.

A variation coefficient of sphere-equivalent diameters of all grains contained in a silver halide emulsion is preferably 20 percent or less, being more preferably 15 percent or less, being furthermore preferably 10 percent or less. The variation coefficient of the sphere-equivalent diameters is expressed with a percentage of a standard deviation of the sphere-equivalent diameters of individual grains to an average value of the sphere-equivalent diameters. At this time, with an intention of obtaining broader latitudes, the above mono-dispersed emulsions are preferably blended and used in one layer or coated in a multi-layer. The sphere-equivalent diameter of a grain in the specification is expressed with a diameter of a sphere whose volume is equal to that of individual grain. The silver halide emulsion is preferably formed of grains whose grain size distribution exhibits the mono-dispersion.

Here, the sphere-equivalent diameter of a grain in the specification is expressed with a diameter of a sphere whose volume is equal to that of individual grain.

The sphere-equivalent diameters of grains contained in a silver halide emulsion are preferably 0.6 $\mu$m or less, being more preferably 0.5 $\mu$m or less, being furthermore preferably 0.4 $\mu$m or less. The lower limit of the sphere-equivalent diameters of the silver halide grains is preferably 0.05 $\mu$m, being more preferably 0.1 $\mu$m. A grain having a sphere-equivalent diameter of 0.6 $\mu$m corresponds to a cubic grain having an edge length of substantially 0.48 $\mu$m, a grain having a sphere-equivalent diameter of 0.5 $\mu$m corresponds to a cubic grain having an edge length of substantially 0.4 $\mu$m, and a grain having a sphere-equivalent diameter of 0.4 $\mu$m corresponds to a cubic grain having an edge length of substantially 0.32 $\mu$m.

The silver halide emulsion preferably contains iridium. The iridium is preferable to form an iridium complex, and a six-coordinate complex that has six ligands and iridium as a central metal is preferable in order to be uniformly incorporated in a silver halide grain. As one preferable embodiment of the iridium used in the invention, a six-coordinate complex that has Cl, Br or I as the ligands and iridium as the central metal is preferable, and a six-coordinate complex that has Cl, Br or I for all six ligands and iridium as the central metal is more preferable. In this case, in the six-coordinate complex, Cl, Br or I may be present together. The six-coordinate complex that has Cl, Br or I as the ligands and iridium as the central metal is particularly preferably contained in the silver bromide-containing phase in view of obtaining a hard tone under the high-luminance exposure.

As specific examples of the six-coordinate complex that has Cl, Br or I for all six ligands and iridium as the central metal, $[IrCl_6]^{2-}$, $[IrCl_6]^{3-}$, $[IrBr_6]^{2-}$, $[IrBr_6]^{3-}$ and $[IrI_6]^{3-}$ can be cited, however, the invention is not restricted thereto.

As another preferable embodiment of iridium, a six-coordinate complex that has at least one ligand that is different from halogen and cyan and iridium as the central metal is preferable, a six-coordinate complex that has $H_2O$, OH, O, OCN, thiazole or substituted thiazole, or thiadiazole or substituted thiadiazole as the ligand and iridium as the central metal being preferable, a six-coordinate complex that has at least one of $H_2O$, OH, O, OCN, thiazole or substituted thiazole as a ligand and Cl, Br or I as remaining ligands and iridium as the central metal being furthermore preferable. Furthermore, a six-coordinate complex that has one or two of 5-methylthiazole, 2-chloro-5-fluorothiadiazole or 2-bromo-5-fluorothiadiazole as the ligand and Cl, Br or I as remaining ligands and iridium as the central metal is most preferable.

As specific examples of the six-coordinate complex that has at least one of $H_2O$, OH, O, OCN, thiazole or substituted thiazole as the ligand and Cl, Br or I as remaining ligands and iridium as the central metal, $[Ir(H_2O)Cl_5]^{2-}$, $[Ir(OH)Br_5]^{2-}$, $[Ir(OCN)Cl_5]^{3-}$, $[Ir(thiazole)Cl_5]^{2-}$, $[Ir(5\text{-methylthiazole})Cl_5]^{2-}$, $[Ir(2\text{-chloro-5-fluorothiadiazole})Cl_5]^{2-}$, and $[Ir(2\text{-bromo-5-fluorothiadiazole})Cl_5]^{2-}$ can be cited, however the invention is not restricted thereto.

The silver halide emulsion preferably contains, other than the above iridium complexes, a six-coordinate complex that has CN ligands and Fe, Ru, Re or Os as the central metal such as $[Fe(CN)_6]^{4-}$, $[Fe(CN)_6]^{3-}$, $[Ru(CN)_6]^{4-}$, $[Re(CN)_6]^{4-}$ and $[Os(CN)_6]^{4-}$. The silver halide emulsion that is used in the first embodiment in the image-forming method according to the invention preferably further contain a pentachloronitrosyl complex or pentachlorothionitrosyl complex that have Ru, Re or Os as the central metal or a six-coordinate complex that has Cl, Br or I as the ligands and Rh as the central metal. These ligands may be partially aquated.

The above-cited metal complexes are negative ions, and, when formed a salt with a positive ion, as a pairing positive ion, one that can be dissolved in water is preferable. Specifically, alkali metal ions such as sodium ion, potassium ion, rubidium ion, cesium ion and lithium ion, ammonium ion, and alkyl ammonium ion are preferable. The metal complexes can be used, other than in water, dissolved in a solvent mixture with an appropriate organic solvent that can be mixed with water (for instance, alcohols, ethers, glycols, ketones, esters, amides and so on). The metal complexes, though different in the optimum amount depending on the kind, are preferably added by from $1\times10^{-10}$ to $1\times10^{-3}$ mol per mol of silver during the grain formation, being most preferably added by from $1\times10^{-9}$ to $1\times10^{-5}$ mol per mol of silver.

The metal complexes are preferably incorporated in the silver halide grains by directly adding into a reaction solution during the formation of silver halide grains, or by adding into an aqueous solution of halide for forming silver halide grains or into a solution other than that followed by adding into a grain formation reaction solution. Furthermore, it is also preferable to incorporate the metal complex into silver halide grains by applying physical ripening to fine particles that incorporated in advance the metal complex therein. Still furthermore, these methods can be combined to incorporate the metal complex in the silver halide grain.

When the metal complexes are incorporated in the silver halide grains, these are allowed to exist uniformly in the grain. However, as disclosed in JP-A Nos.4-208936, 2-125245 and 3-188437, the metal complexes are preferably allowed to exist only on a grain surface, alternatively the metal complexes are preferably allowed to exist only inside of the grain and to have a layer that does not contain the metal complex on a grain surface. Furthermore, as disclosed in U.S. Pat. Nos. 5,252,451 and 5,256,530, when fine particles therein the complexes are incorporated are subjected to the physical ripening, a grain surface phase is preferably modified. These methods can be combined to use, or a plurality of kinds of complexes may be incorporated in one silver halide grain. There is no particular restriction on a halogen composition at a position where the complexes are incorporated, however the six-coordinate complex that has Cl, Br or I for all six ligands and iridium as the central metal is preferably incorporated in the maximum portion of the silver bromide concentration.

The silver halide emulsion is normally subjected to the chemical sensitization. In the chemical sensitization, sulfur sensitization typical in the addition of an unstable sulfur compound, noble metal sensitization typical in gold sensitization or a reduction sensitization may be used separately or in combination. As compounds used in the chemical sensitization, ones described in JP-A No.62-215272 page 18, right lower column to page 22, right upper column can be preferably used. Among these, in particular, ones that are subjected to the gold sensitization are preferable. This is because, when the gold sensitization is applied, the variation of the photographic performance at the laser scanning exposure or the like can be made further smaller.

In applying the gold sensitization, various kinds of inorganic gold compounds, gold (I) complexes having inorganic ligands and gold (I) compounds having organic ligands can be utilized. As the inorganic gold compounds, for instance, chloroauric acids or salts thereof, as the gold (I) complexes having inorganic ligands, for instance, gold dithiocyanates such as potassium gold (I) dithiocyanates or gold (I) dithiosulfates such as sodium gold (I) dithiocyanates can be used.

As the gold (I) compounds having organic ligands (organic compounds), bis gold (I) meso-ion heterocycles described in JP-A No.4-267249 such as gold (I) bis(1,4,5-trimethyl-1,2,4-triazorium-3-thiorate)aurate tetrafluoroborate, organic mercapto-gold (I) complexes described in JP-A No.11-218870 such as potassium bis(1-[3-(2-sulfonatobenzamido)phenyl]-5-mercaptotetrazole potassium salt)aurate (I) penta-hydrate, and gold (I) compounds to which a nitrogen compound anion is coordinated described in JP-A No.4-268550 such as bis(1-methylhydantoinate)gold (I) sodium salt tetra-hydrate can be used. These gold (I) compounds having organic ligand, other than using previously synthesized and isolated ones, by mixing the organic ligand and the gold compound (for instance, chloroauric acids and their salts), without generating and isolating, can be added to the emulsion. Furthermore, by separately adding an organic ligand and a gold compound (for instance, chloroauric acids and their salts) to the emulsion, thereby a gold (I) compound having the organic ligand may be generated in the emulsion.

Furthermore, gold (I) thiolates described in U.S. Pat. No. 3,503,749, gold compounds described in JP-A Nos.8-69074, 8-69075 and 9-269554, compounds described in U.S. Pat. Nos. 5,620,841, 5,912,112, 5,620,841, 5,939,245 and 5,912,111 can be used. An amount to be added of these compounds, though being able to vary over a wide range according to the cases, is in the range of $5\times10^{-7}$ to $5\times10^{-3}$ mol per mol of silver halide, being preferably in the range of $5\times10^{-6}$ to $5\times10^{-4}$ mol.

Furthermore, colloidal gold sulfides also may be used; its production method is described in Research Disclosure No. 375154, Solid State Ionics, vol. No. 79, 1955, pp. 60–66 and Compt. Rend. Hebt. Seances Acad. Sci. Sect., B vol. 263, 1966, p. 1328. An amount to be added of the colloidal gold sulfides, although it can be changed widely corresponding to the cases, is from $5\times10^{-7}$ to $5\times10^{-3}$ mol as gold atom per mol of silver halide, being preferably from $5\times10^{-6}$ to $5\times10^{-4}$ mol.

The chalcogen sensitization can be applied together with the gold sensitization to the same molecule, and molecules capable of releasing AuCh- can be used. Here, the Au represents Au (I) and the Ch represents sulfur atom, selenium atom and tellurium atom. As the molecules capable of releasing the AuCh-, gold compounds expressed by, for instance, AuCh-L can be cited. Here, the L represents an atomic group that combines with the AuCh and forms a molecule. Furthermore, another one or more ligands may be coordinated to the Au together with the Ch-L. As examples of specific compounds, Au (I) salts of thio-sugars (gold thioglucoses such as alpha gold thioglucose, gold peracetylthioglucose, gold thiomannose, gold thiogalactose, and gold thioarabinose), Au (I) salts of seleno-sugars (gold peracetylselenoglucose, gold peracetylselenomannose and so on), Au (I) salts of telluro-sugars, and so on can be cited. Here, the thio-sugars, seleno-sugars and telluro-sugars represent compounds in which a hydroxy group at an anomer position of a sugar is substituted by a SH group, SeH group and TeH group, respectively. An amount to be added of these compounds, though being able to vary over a wide range according to the cases, is in the range of $5\times10^{-7}$ to $5\times10^{-3}$ mol per mol of silver halide, being preferably in the range of $3\times10^{-6}$ to $3\times10^{-4}$ mol.

To the silver halide emulsion, the above gold sensitization and other sensitization method such as sulfur sensitization, selenium sensitization, tellurium sensitization, reduction sensitization or noble metal sensitization that uses other compounds than gold compounds may be applied in combination. It is particularly preferable to combine with the sulfur sensitization or the selenium sensitization.

Various compounds and their precursors can be added to the silver halide emulsion, in order to avoid being fogged during manufacture, preservation and photographic processing of the photosensitive material, or in order to stabilize the photographic performance. As specific examples of these compounds, ones described in JP-A No.62-215272 page 39 to page 72 can be preferably used. Furthermore, 5-arylamino-1,2,3,4-thiatriazole compounds (the aryl group has at least one electron-withdrawing group) described in EP No.0447647 also can be preferably used.

To the silver halide emulsion, in order to enhance the preservation properties thereof, hydroxamic acid derivatives described in JP-A No.11-109576, cyclic ketones described in JP-A No.11-327094 and having, adjacent to a carbonyl group, a double bond whose both terminals are substituted by amino groups or hydroxy groups (in particular, ones expressed by a general formula (S1); paragraph Nos.0036 to 0071 can be taken in the present specification.), sulfo-substituted catechols and hydroquinones described in JP-A No.11-143011 (for instance, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid and salts thereof), hydroxylamines represented by a general formula (A) in U.S. Pat. No. 5,556,741 (the description in U.S. Pat. No. 5,556,741 the fourth column, line 56 to the eleventh column, line 22 can be preferably applied also to the invention and can be taken in as part of the specification of the invention), and water soluble reductive agents expressed by general formulae (I) through (III) in JP-A No.11-102045 can be preferably applied also to the first embodiment in the image-forming method of the invention.

In order to endow the silver halide emulsion with so-called spectral sensitivity that exhibits the photosensitivity in a desired light wavelength region, a spectral sensitizing dye can be contained in the silver halide emulsion. As the spectral sensitizing dyes used in the spectral sensitization in a blue, green and red region, for instance, ones described in F. H. Harmer, Heterocyclic compounds-Cyanine dyes and related compounds (New York and London: John Wiley & Sons, 1964) can be cited. As examples of specific compounds and spectral sensitization methods, ones described in the JP-A No.62-215272 page 22, right upper column to page 38 can be preferably used. Furthermore, as red spectral sensitizing dyes of silver halide emulsion grains particularly high in the silver chloride content, spectral sensitizing dyes described in JP-A No.3-123340 can be very preferably used from viewpoints of stability, absorption strength, and temperature dependency of the exposure.

An amount to be added of the spectral sensitizing dyes, though covering a wide range according to the cases, is preferably in the range of $0.5\times10^{-6}$ to $1.0\times10^{31\ 2}$ mol per mol of silver halide. It is more preferably in the range of $1.0\times10^{-6}$ to $5.0\times10^{-3}$ mol.

In the following, the photosensitive materials will be more detailed.

A total coating amount of silver in photographic constituent layers in the photosensitive material is preferably 0.47 $g/m^2$ or less, more preferably 0.25 $g/m^2$ to 0.47 $g/m^2$, still more preferably 0.25 $g/m^2$ to 0.45 $g/m^2$, further more preferably 0.25 $g/m^2$ to 0.40 $g/m^2$.

In the photosensitive material, gelatins are used as hydrophilic binder. However, as needs arise, hydrophilic colloids such as other gelatin derivatives, graft polymers between gelatins and other polymers, proteins other than the gelatins, sugar derivatives, cellulose derivatives, and synthetic hydrophilic polymers such as single or copolymers too can be used together with the gelatin. The gelatin used in the silver halide color photographic photosensitive materials involving the first embodiment of the image-forming method according to the invention may be any one of lime-treated gelatins and acid-treated gelatins, furthermore, may be gelatins produced from any one of raw materials such as beef bones, calf skins, and pig skins can be also used. However, the lime-treated gelatins produced from beef bones and pigskins as raw material are preferable.

In the photosensitive material, in order to inhibit the irradiation and halation from occurring and to improve the safety from a safelight, in the hydrophilic colloidal layer, dyes (among these, oxonol dyes and cyanine dyes) capable of decoloring by treatment described in EP No.0337490A2 pages 27 to 76 are preferably added. Furthermore, also dyes described in EP No.0819977 can be preferably added to the first embodiment in the image-forming method according to the invention. Among these water-soluble dyes, there are ones in which an increase in an amount to be used causes the color separation or the deterioration of the safety of the safelight. As the dyes that can be used without causing the color-separation, water-soluble dyes described in JP-A Nos.5-127324, 5-127325 and 5-216185 are preferable.

In the photosensitive material, a colored layer that can substitute for the water-soluble dye or can be decolored by treatment in combination with a water-soluble dye can be used. The colored layer capable of decoloring by the treatment that is employed may be disposed in direct contact with the emulsion layer or may be disposed so as to come into contact with the emulsion layer through an intermediate layer that contains the color-mixing inhibitor such as gelatins and hydroquinones. The colored layer is preferably disposed on a lower layer (on a support side) of the emulsion layer that develops a color in a primary color the same as the colored color. All colored layers corresponding to the respective primary colors may be separately disposed, or some of these may be selected and disposed. Furthermore, a colored layer that is colored corresponding to a plurality of primary color regions may be disposed. The optical reflection density of the colored layer is preferably 0.2 to3.0 in the optical density value at a wavelength most high in the optical density in a wavelength region used in the exposure (a visible light region of 400 to 700 nm in the ordinary printer exposure; a wavelength of a scanning exposure light source being used in the case of the scanning exposure). It is further preferably 0.5 to 2.5, and particularly preferably 0.8 to 2.0.

Known methods can be applied to form a colored layer. For instance, a method in which like dyes described in JP-A No.2-282244 page 3, right upper column to page 8, and dyes described in JP-A No.3-7931 page 3, right upper column to page 11, left lower column, a dye is incorporated in a hydrophilic colloidal layer in a state of solid fine particle dispersion, a method in which an anionic pigment is mordanted with a cationic polymer, a method in which a pigment is absorbed by fine particles such as silver halide particles and fixed in a layer, and a method in which colloidal silver such as described in JP-A No.1-239544 is used can be cited. As the method in which fine particles of pigment are dispersed in a state of solid, a method is described in JP-A No.2-308244 page 4 to page 13 in which fine dye particles that are substantially water-insoluble at least at, for instance, pH 6 or less and substantially water-soluble at least at pH 8 or more are incorporated. Furthermore, the method in which, for instance, an anionic pigment is mordanted with a cationic polymer is described in JP-A No.2-84637 page 18 to 26. A method of preparing colloidal silver as an light absorber is described in U.S. Pat. Nos.2,688,601 and 3,459,563. Among the methods., the method that allows incorporating the fine powder dye and the method that uses the colloidal silver are preferable.

The photosensitive material preferably comprises at least one layer each of yellow developing silver halide emulsion layer, magenta developing silver halide emulsion layer and cyan developing silver halide emulsion layer. In general, these silver halide emulsion layers are arranged, from a side closer to a support, in order of the yellow developing silver halide emulsion layer, the magenta developing silver halide emulsion layer and the cyan developing silver halide emulsion layer.

However, a layer configuration different from the above may be taken.

In the photosensitive material, a silver halide emulsion contained in a blue-sensitive silver halide emulsion layer, from view points of a yellow mask of a negative film and the spectral characteristics of halogen that is a light source in the exposure, is preferably relatively higher in the sensitivity with respect to that of the green-sensitive silver halide emulsion and the red-sensitive silver halide emulsion. Accordingly, a length of particle edge of the blue-sensitive emulsion is preferably longer than that of other layers. Furthermore, since the mol absorption coefficient of generally known yellow coupler color developing pigments is comparatively lower than that of magenta coupler color developing pigments and cyan coupler color developing pigments, as a coating amount of a yellow coupler increases, a coating amount of the blue-sensitive silver halide emulsion tends to increase. Accordingly, a yellow developing blue-sensitive silver halide emulsion layer, in considering the resistance to the pressure from the photosensitive material surface such as scratch and so on, being disadvantageous in comparison with other layers, is preferably located on a side nearer to the support.

That is, though the silver halide emulsion layer that contains the yellow coupler may be disposed on any positions on a support, when the silver halide emulsion layer contains tabular silver halide grains, the silver halide emulsion layer that contains the yellow coupler is preferably disposed at a position more apart from the support than at least one layer of the magenta coupler-containing silver halide emulsion layer or the cyan coupler-containing silver halide emulsion layer. Furthermore, from viewpoints of color development acceleration, desilvering acceleration, and reduction in a residual color due to the sensitizing dye, it is preferable that the yellow coupler-containing silver halide emulsion layer is coated, in comparison with other silver halide emulsion layers, on the furthest position from the support. Furthermore, from the viewpoint of reduction in a blix discoloration, the cyan coupler-containing silver halide emulsion layer is preferably disposed in the middle of other silver halide emulsion layers, on the other hand, from the viewpoint of reduction in a light fading, the cyan coupler-containing silver halide emulsion layer is preferable to be the lowest layer. Furthermore, each of the yellow developing layer, the magenta developing layer and the cyan developing layer may be composed of two or three layers.

As silver halide emulsions and other raw materials (additives and so on) and the photographic constituent layers (layer arrangement and so on) that can be applied to the photosensitive materials, and processing methods and processing additives that are applied for processing the photosensitive materials, ones described in JP-A Nos.62-215272 and 2-33144 and EP No.0,355,660A2, particularly ones described in EP No.0,335,660A2 can be preferably used. Furthermore, silver halide color photographic photosensitive materials and processing methods described in JP-A Nos.5-34889, 4-359249, 4-313753, 4-270344, 5-66527, 4-34548, 4-145433, 2-854, 1-158431, 2-90145, 3-194539 and 2-93641 and EP-A No.0520457A2 are preferable.

Particularly, in the first embodiment of the image-forming method according to the invention, as to the reflective supports and silver halide emulsions, furthermore different kinds of metal ions doped in silver halide grains, preservation stabilizers or anti-foggants of silver halide emulsions, chemical sensitization methods (sensitizers), spectral sensitization methods (spectral sensitizers), cyan, magenta, and yellow couplers and emulsifying dispersion methods thereof, color image preservation improver (stain inhibitor and fading inhibitor), dyes (colored layer), kinds of gelatin, layer configuration of the photosensitive materials and coating pH of the photosensitive materials, ones described in the respective positions of patents shown in the following table can be particularly preferably applied.

TABLE 1

| Element | JP-A No.7-104448 | JP-A No.7-77775 | JP-A No.7-301895 |
|---|---|---|---|
| Reflective support | Column 7, line 12 to column 12, line 19 | Column 35, line 43 to column 44, line 1 | Column 5, line 40 to column 9, line 26 |
| Silver halide emulsion | Column 72, line 29 to column 74, line 18 | Column 44, line 36 to column 46, line 29 | Column 77, line 48 to column 80, line 28 |
| Different kinds of metal ions | Column 74, line 19 to column 74, line 44 | Column 46, line 30 to column 47, line 5 | Column 80, line 29 to column 81, line 6 |
| Preservation stabilizer or anti-foggant | Column 75, line 9 to column 75, line 18 | Column 47, line 20 to column 47, line 29 | Column 18, line 11 to column 31, line 37 (mercaptoheterocyclic compounds, in particular) |
| Chemical sensitization method (Chemical sensitizer) | Column 74, line 45 to column 75, line 6 | Column 47, line 7 to column 47, line 17 | Column 81, line 9 to column 81, line 17 |
| Spectral sensitization method (Spectral sensitizer) | Column 75, line 19 to column 76, line 45 | Column 47, line 30 to column 49, line 6 | Column 81, line 21 to column 82, line 48 |

TABLE 1-continued

| Element | JP-A No.7-104448 | JP-A No.7-77775 | JP-A No.7-301895 |
|---|---|---|---|
| Cyan coupler | Column 12, line 20 to column 39, line 49 | Column 62, line 50 to column 63, line 16 | Column 88, line 49 to column 89, line 16 |
| Yellow coupler | Column 87, line 40 to column 88, line 3 | Column 63, line 17 to column 63, line 30 | Column 89, line 17 to column 89, line 30 |
| Magenta coupler | Column 88, line 4 to column 88, line 18 | Column 63, line 3 to column 64, line 11 | Column 31, line 34 to column 77, line 44 and Column 88, line 32 to column 88, line 46 |
| Emulsifying dispersion method of coupler | Column 71, line 3 to column 72, line 11 | Column 61, line 36 to column 61, line 49 | Column 87, line 35 to column 87, line 48 |
| Color image preservation improver (Stain inhibitor) | Column 39, line 50 to column 70, line 9 | Column 61, line 50 to column 62, line 49 | Column 87, line 49 to column 88, line 48 |
| Anti-fading agent | Column 70, line 10 to column 71, line 2 | | |
| Dye (Coloring agent) | Column 77, line 42 to column 78, line 41 | Column 7, line 14 to column 19, line 42 and Column 50, line 3 to column 51, line 14 | Column 9, line 27 to column 18, line 10 |
| Kinds of gelatin | Column 78, line 42 to column 78, line 48 | Column 51, line 15 to column 51, line 20 | Column 83, line 13 to column 83, line 19 |
| Layer configuration of photosensitive material | Column 39, line 11 to column 39, line 26 | Column 44, line 2 to column 44, line 35 | Column 31, line 38 to column 32, line 33 |
| Coating pH of photosensitive material | Column 72, line 12 to column 72, line 28 | | |
| Scanning exposure | Column 76, line 6 to column 77, line 41 | Column 49, line 7 to column 50, line 2 | Column 82, line 49 to column 83, line 12 |
| Preservatives in developing solution | Column 88, line 19 to column 89, line 22 | | |

In the photosensitive material, a dye forming coupler (in the specification referred to also as a coupler) is added to photographic useful material and other high-boiling point organic solvent and emulsified and dispersed therewith, and thereby is incorporated in the photosensitive material as a dispersion. The solution is emulsified and dispersed, by use of known equipment such as ultrasonic vibrator, colloid mill, homogenizer, MANTON GAULIN, and high-speed dissolver, in hydrophilic colloid, preferably in an aqueous gelatin solution in fine particles together with a dispersant of a surfactant, and thereby a dispersion is obtained.

The high-boiling point organic solvent, without restricting to particular one, can be ordinary ones. For instance, ones described in U.S. Pat. No. 2,322,027 and JP-A No.7-152129 can be cited.

Furthermore, together with the high-boiling point solvent, auxiliary solvent can be used. As examples of the auxiliary solvent, acetates of lower alcohols such as ethyl acetate and butyl acetate, ethyl propionate, secondary butyl acetate, methyl ethyl ketone, methyl isobutyl ketone, s-ethoxy ethyl acetate, methyl cellosolve acetate, methyl carbitol acetate and cyclohexanone can be cited.

Furthermore, as needs arise, organic solvents completely miscible with water such as methyl alcohol, ethyl alcohol, acetone, tetrahydrofuran and dimethyl formamide can be partially used in combination. Still furthermore, two or more kinds of these organic solvents can be used in combination.

Furthermore, from view points of an improvement of stability with time during preservation in an emulsified dispersion state, and a suppression of photographic characteristics variation and an improvement of stability with time in a final coating composition mixed with the emulsion, as needs arise, all or part of the auxiliary solvent can be removed from the emulsified dispersion according to methods such as a reduced-pressure distillation method, noodle washing method or ultra-filtration method.

An average particle size of thus obtained oleophilic fine particle dispersion is preferably in the range of 0.04 to 0.50 μm, being more preferably in the range of 0.05 to 0.30 μm, being most preferably in the range of 0.08 to 0.20 μm. The average particle size can be measured with Coulter Submicron Particle Analyzer Model N4 (available Coulter Electronics Co., Ltd.) or the like.

In the oil-droplet-in-water dispersion method using a high boiling point organic solvent, a mass ratio of the high boiling point organic solvent to a total mass of a used cyan coupler can be arbitrarily selected. However, the ratio is preferably 0.1 and more and 10.0 or less, more preferably 0.3 or more and 7.0 or less, and most preferably 0.5 or more and 5.0 or less. Furthermore, it is also possible to use without using the high boiling point organic solvent.

Furthermore, in order to control the color tone of a white background, a coloring pigment may be co-emulsified in the emulsion that is used in the first embodiment in the image-forming method according to the invention, alternatively, a coloring pigment may be allowed to coexist in an organic solvent that dissolves useful compounds for use in photography such as the coupler and so on used in the photosensitive material in the first embodiment of the image-forming method according to the invention and co-emulsified, and thereby preparing an emulsion.

As the cyan, magenta and yellow couplers used in the photosensitive materials, other than the above, the couplers described in JP-A No.62-215272 page 91, right upper column, line 4 to page 121, left upper column, line 6, JP-A No.2-33144 page3, right upper column, line 14 to page 18, left upper column, the last line and page 30, right upper column, line 6 to page 35, right lower column, line 11, and EP No.0355,660A2 page 4, line 15 to line 27, page 5, line 30 to line page 28, the last line, page 45, line 29 to line 31, and page 47, line 23 to page 63, line 50 are also useful.

Furthermore, in the first embodiment of the image-forming method according to the invention, the compounds represented by general formulae (II) and (III) of WO-98/33760 and a general formula (D) of JP-A No.10-221825 may be preferably added.

As the cyan dye-forming couplers (in some cases, referred to simply as "cyan coupler") that can be used in the photosensitive materials, compounds represented by the following general formula (IA) can be cited. In the photosensitive material, at least one kind selected from the compounds represented by the following general formula (IA) is contained as the cyan dye-forming coupler, however another cyan coupler may be used together. The compounds represented by the following general formula (IA) will be explained.

General formula (IA)

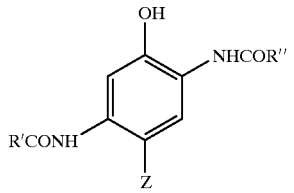

In the general formula (IA), R' and R" each separately express a substituent, and Z a hydrogen atom or a group capable of coupling-off in a coupling reaction with an oxidant of an aromatic primary amine color developing agent.

As far as not particularly mentioned, a term "alkyl" below indicates unsaturated or saturated, whether straight chain or branched chain alkyl groups (including alkenyl and aralkyl), and includes cyclic alkyl groups (including cycloalkenyl) having 3 to 8 carbon atoms, and a term "aryl" specifically includes condensed aryls.

The R' and R" in the general formula (IA) are preferably selected independently from un-substituted or substituted alkyl groups, aryl groups, amino groups or alkoxy groups, or 5- to 10-membered heterocycles (the heterocycles are un-substituted or substituted) containing one kind or more hetero atoms selected from nitrogen, oxygen and sulfur.

When one or both of the R' and R" in the general formula (IA) are amino groups or alkoxy groups, these may be substituted by, for instance, a halogen, an aryloxy group, or an alkyl- or aryl-sulfonyl group. However, the R' and R" are preferably selected independently from un-substituted or substituted alkyl or aryl groups, or 5- to 10-membered heterocycles such as pyridyl, morpholino, imidazoyl or pyridazolyl groups.

The R' in the general formula (IA) is preferably, for instance, a halogen, alkyl, aryloxy, or alkyl- or aryl-sulfonyl group (further substitution is allowable). When the R" is an alkyl group, the alkyl group may be similarly substituted.

However, the R" is preferably a un-substituted aryl, or an aryl group substituted by, for instance, a cyano, chloro, fluoro, bromo, iodo, alkyl- or aryl-carbonyl, alkyl- or aryl-oxycarbonyl, acyloxy, carbonamido, alkyl- or aryl-oxycarbonamido, alkyl- or aryl-oxycarbonamido, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfamoylamino alkyl- or aryl-sulfoneamide, aryl, alkyl, alkoxy, aryloxy, nitro, alkyl- or aryl-ureide, or alkyl- or aryl-carbamoyl group (any one of these may be further substituted). A preferable substituent is a halogen, cyano, alkoxycarbonyl, alkylsulfamoyl, sulfoneamide, alkyl-sulfoneamide, alkylsulfonyl, carbamoyl, alkylcarbamoyl or alkylcarbonamido. When the R' is the aryl or heterocycle, these may be similarly substituted.

Preferably, the R" is 4-chlorophenyl, 3,4-dichlorophenyl, 3,4-difluorophenyl, 4-cyanophenyl, 3-chloro-4-cyanophenyl, pentafluorophenyl, or 3- or 4-sulfoneamidephenyl group.

Z in the general formula (I) represents a hydrogen atom or a group capable of coupling-off in a coupling reaction with an oxidant of an aromatic primary amine color developing agent. The Z may be preferably a hydrogen, chloro, fluoro, substituted aryloxy or mercaptotetrazole, and more preferably may be hydrogen or chloro.

According to the Z, a chemical equivalency of a coupler, that is, whether it is a 2-equivalent coupler or 4-equivalent coupler is determined, and according to the kind of the Z, the reactivity of the coupler can be altered. Such a group, after release from the coupler, by fulfilling the functions such as dye formation, hue adjustment of the dye, development acceleration or inhibition, bleach acceleration or inhibition, electron transfer facilitation, color correction, and the like, can affect a favorable influence on a layer thereon a coupler in the photographic recording material is coated or other layers.

Representative classes of such coupling-off groups include, for example, halogen, alkoxy, aryloxy, heterocyclyloxy, sulfonyloxy, acyloxy, acyl, heterocyclyl, sulfonamido, heterocyclylthio, benzothiazolyl, phosophonyloxy, alkylthio, arylthio, and arylazo. These coupling-off groups are described in, for example, U.S. Pat. Nos. 2,455,169; 3,227,551; 3,432,521; 3,467,563; 3,617,291; 3,880,661; 4,052,212; and 4,134,766; and UKP Nos. 1,466,728; 1,531,927; and 1,533,039; and UK-A Nos. 2,066,755A, and 2,017,704A (these disclosures are taken in the specification as references). Halogen, alkoxy and aryloxy groups are most preferable.

Examples of specific coupling-off groups are as follows. —Cl, —F, —Br, —SCN, —$OCH_3$, —$OC_6H_5$, —$OCH_2C(=O)NHCH_2CH_2OH$, —$OCH_2C(O)NHCH_2CH_2OCH_3$, —$OCH_2C(O)NHCH_2CH_2OC(=O)OCH_3$, —$P(=O)(OC_2H_5)_2$, —$SCH_2CH_2COOH$,

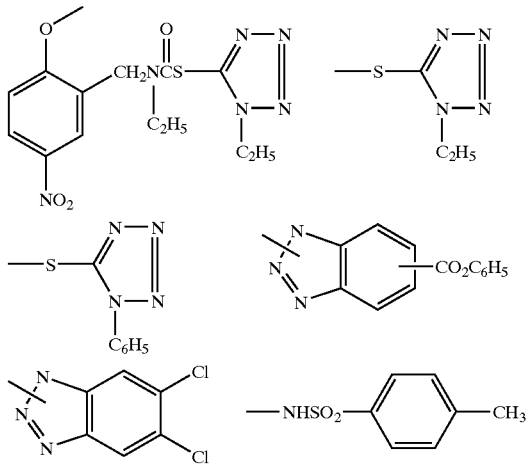

-continued
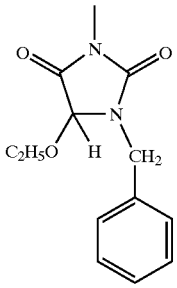
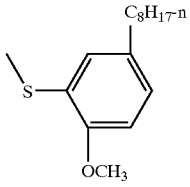
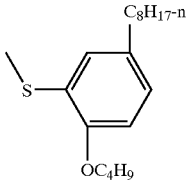
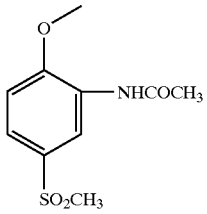
and
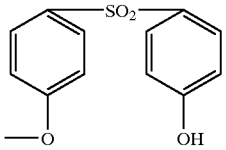
Typically, the coupling-off group is a chlorine atom, hydrogen atom or p-methoxyphenoxy group.
In the following, specific examples of compounds represented by the general formula (IA) are shown, however, the invention is not restricted thereto.
IC-1
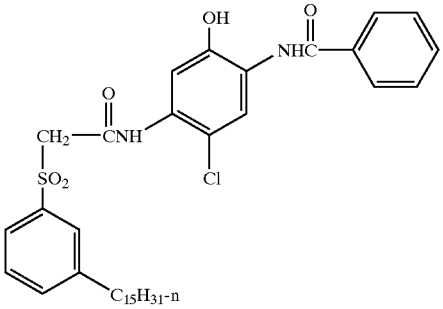
IC-2
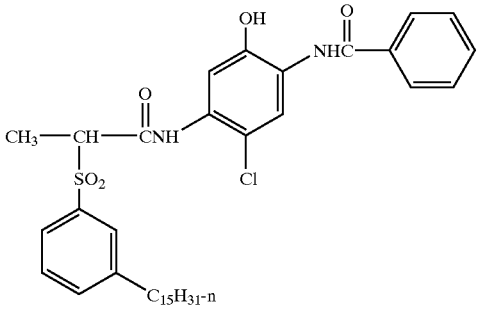
-continued
IC-3
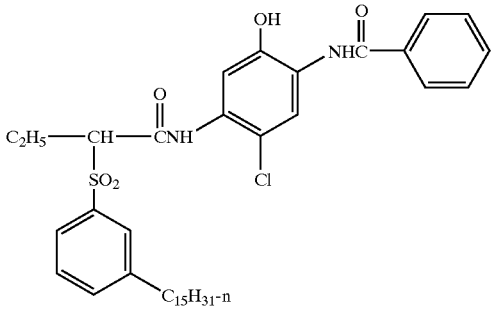
IC-4
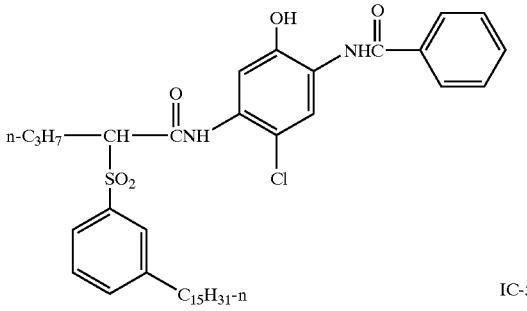
IC-5
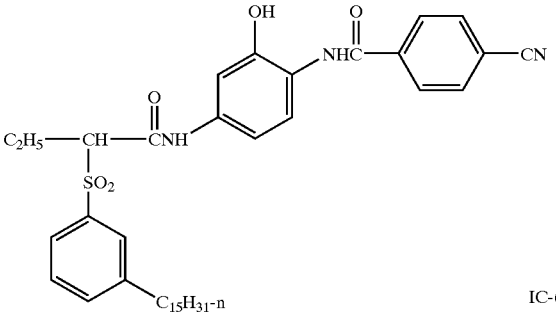
IC-6
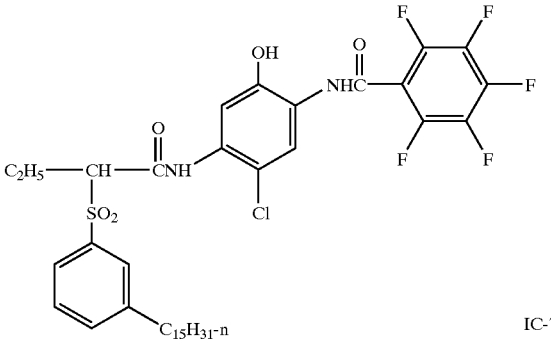
IC-7
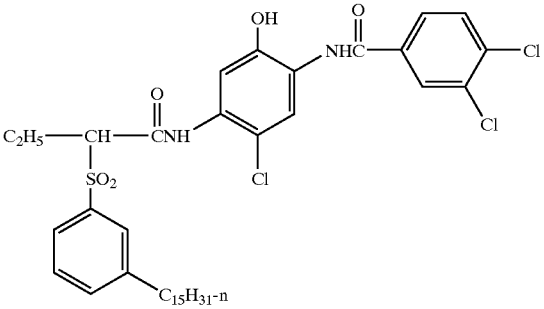

-continued
IC-8
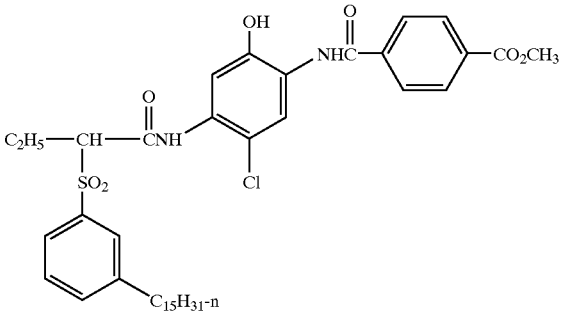
IC-9
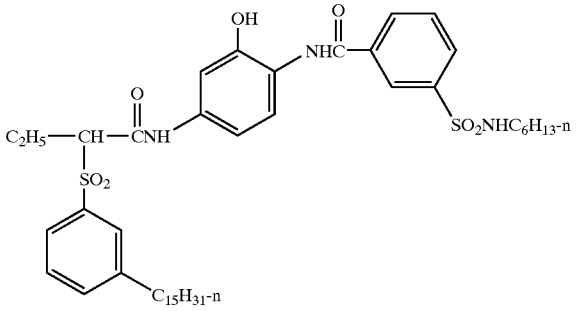
IC-10
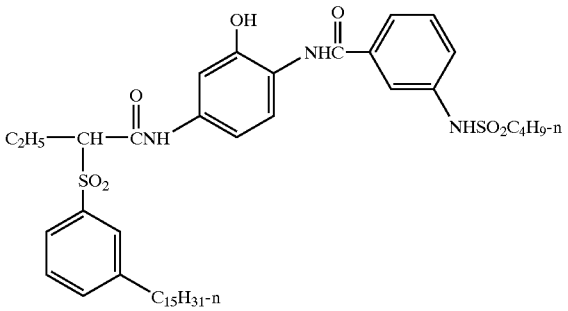
IC-11
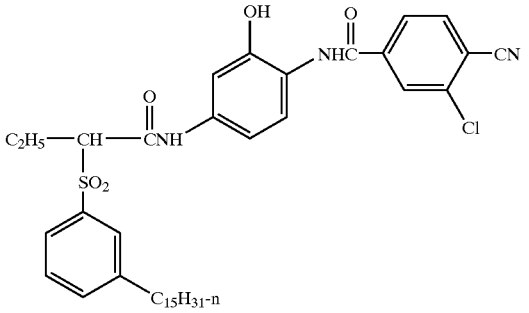
IC-12
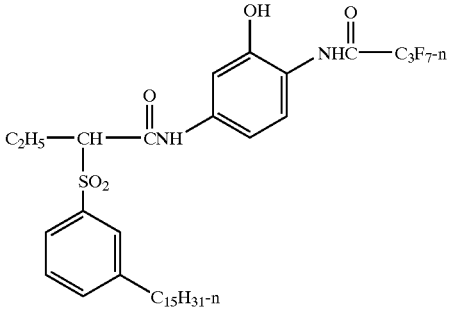
-continued
IC-13
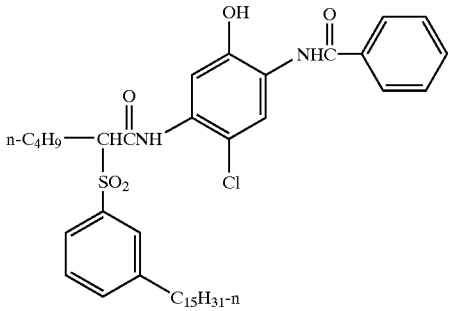
IC-14
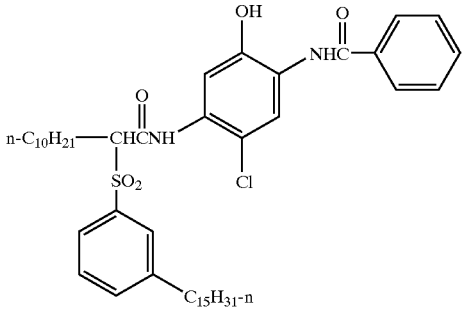
IC-15
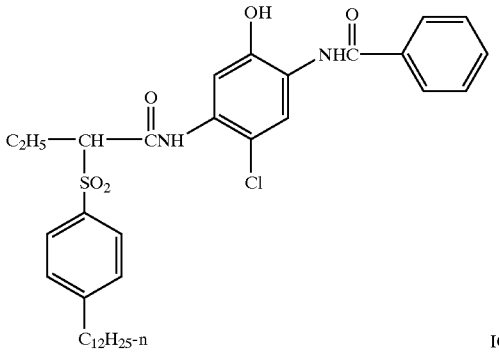
IC-16
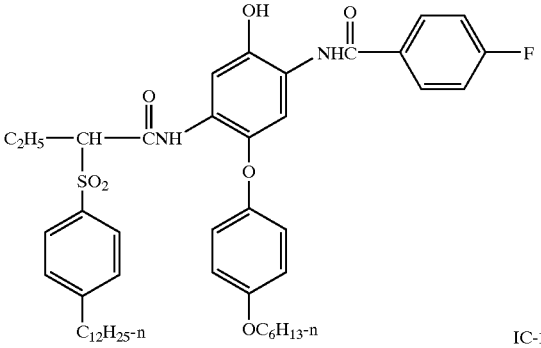
IC-17
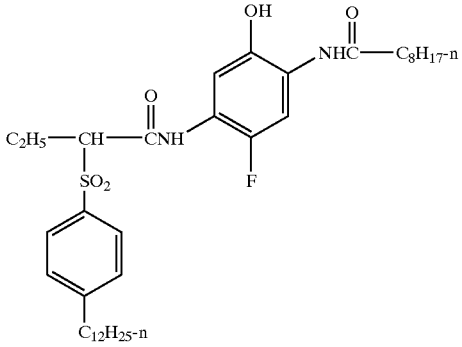

-continued
IC-18
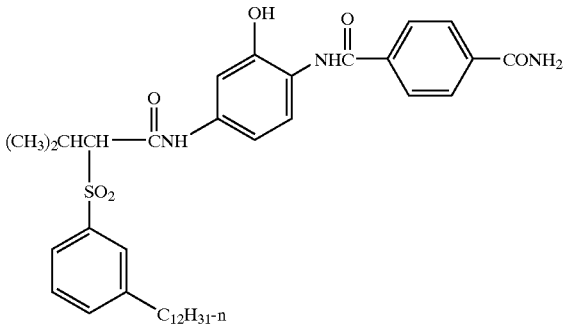
IC-19
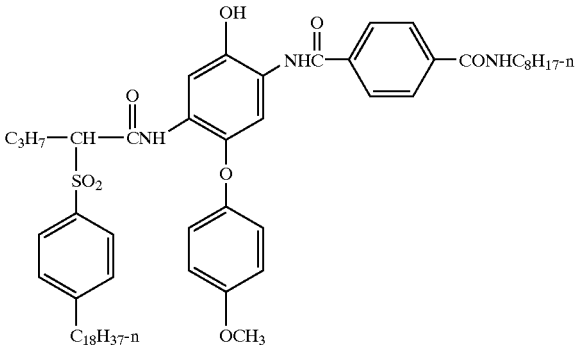
IC-20
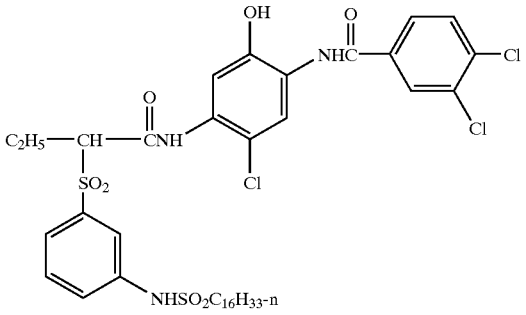
IC-21
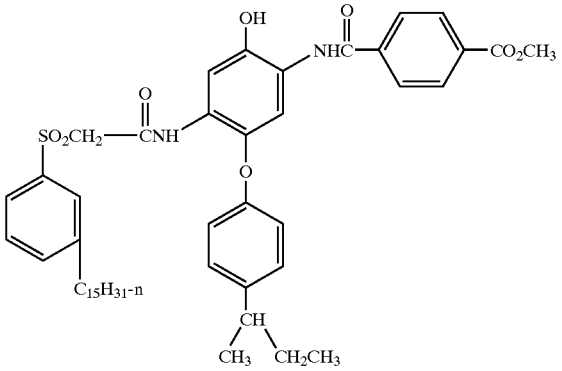
-continued
IC-22
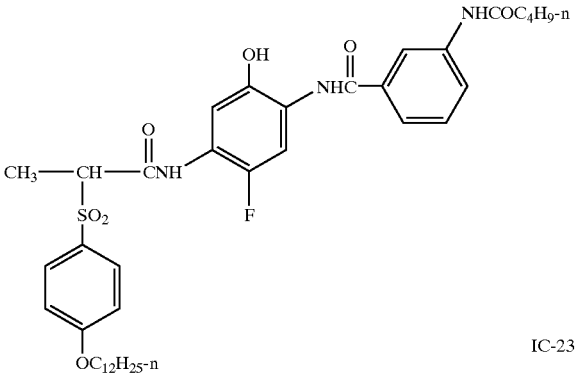
IC-23
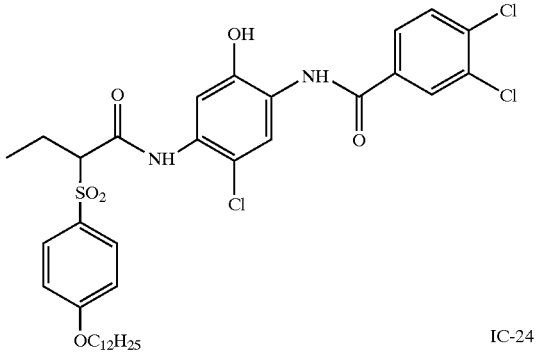
IC-24
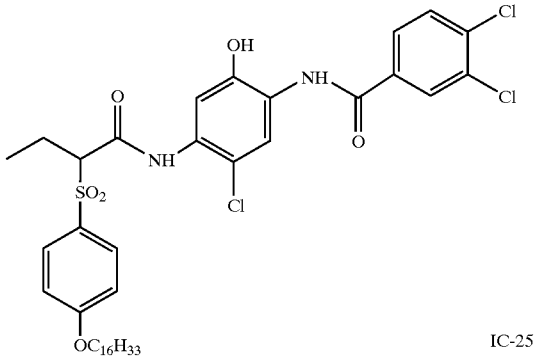
IC-25
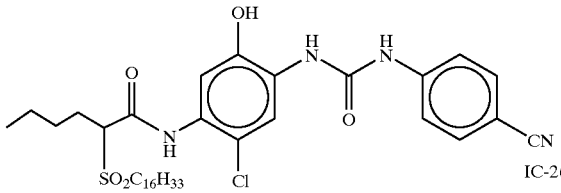
IC-26
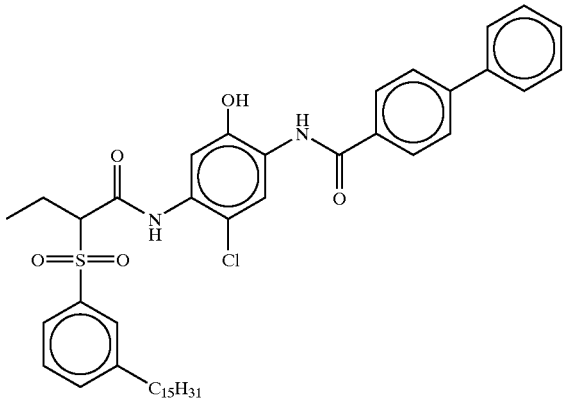

-continued

IC-27

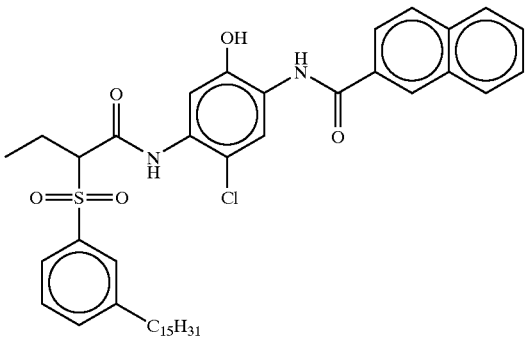

IC-28

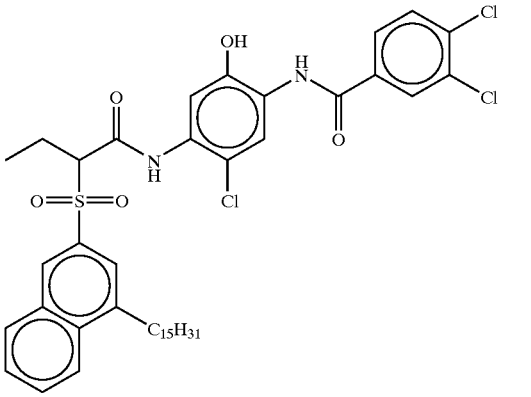

As magenta dye-forming couplers (in some cases simply referred to as "magenta coupler") that can be used in the photosensitive materials, 5-pyrazolone magenta couplers and pyrazoloazole magenta couplers such as described in the known references in the preceding table can be used. For the pyrazoloazole magenta couplers, a structure shown by the following general formula (M-I) is preferable. Compounds represented by the following general formula (M-1) will be detailed.

General formula (M-I)

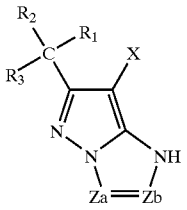

In the general formula (M-I), Za and Zb each represent $=C(R_4)-$ or $=N-$, $R_1$, $R_2$, $R_3$ and $R_4$ represent a hydrogen atom or a substituent. The substituent represents a halogen atom, aliphatic group, aryl group, heterocyclic group, cyano group, hydroxy group, nitro group, carboxy group, sulfo group, amino group, alkoxy group, aryloxy group, acylamino group, alkylamino group, anilino group, ureido group, sulfamoylamino group, alkylthio group, arylthio group, alkoxycarbonylamino group, sulfoneamide group, carbamoyl group, sulfamoyl group, sulfonyl group, alkoxycarbonyl group, heterocyclic oxy group, azo group, acyloxy group, carbamoyloxy group, silyloxy group, aryloxycarbonylamino group, imide group, heterocyclic thio group, sulfinyl group, phosphonyl group, aryloxycarbonyl group, acyl group or azolyl group, and among these groups ones capable of further having a substituent may be substituted by the above substituents.

More specific examples of the substituents include a halogen atom (for instance, chlorine and bromine); aliphatic groups (for instance, a straight-chain, or branched alkyl group, aralkyl group, alkenyl group, alkynyl group, and cycloalkyl group having 1 to 32 carbons, more specifically, for instance, methyl, ethyl, propyl, isopropyl, tert-butyl, tridecyl, 2-methanesulfonylethyl, 3-(3-pentadecylphenoxy) propyl, 3-{4-{2-[4-(4-hydroxyphenylsulfonyl)phenoxy] dodecanamide}phenyl}propyl, 2-ethoxytridecyl, trifluoromethyl, cyclopentyl, and 3-(2,4-di-tert-amylphenoxy)propyl); aryl groups (for example, phenyl, 4-tert-butylphenyl, 2,4-di-tert-amylphenyl, 2,4,6-trimethylphenyl, 3-tridecaneamide-2,4,6-trimethylphenyl, 4-tetradecaneamidephenyl, and tetrafluorophenyl); heterocyclic groups (for example, 2-furyl, 2-thienyl, 2-pyrimidinyl, and 2-benzothiazolyl); cyano group; a hydroxy group; a nitro group; a carboxyl group; a sulfo group; an amino group; alkoxy groups (for instance, methoxy, ethoxy, 2-methylethoxy, 2-dodecylethoxy, and 2-methanesulfonylethoxy): aryloxy groups (for instance, phenoxy, 2-methylphenoxy, 4-tert-butylphenoxy, 3-nitrophenoxy, 3-tert-buthoxycarbamoylphenoxy, and 3-methoxycarbamoylphenoxy); acylamino groups (for instance, acetamide, bezamide, tetradecaneamide, 2-(2,4-di-tert-amylphenoxy)butaneamide, 4-(3-tert-butyl-4-hydroxyphenoxy)butaneamide, and 2-[4-(4-hydroxyphenylsulfonyl)phenoxy]decaneamide); alkylamino groups (for instance, methylamino, butylamino, dodecylamino, diethylamino, and methylbutylamino); anilino groups (for instance, phenylamino, 2-chloroanilino, 2-chloro-5-tetradecaneaminoanilino, 2-chloro-5-dodecyloxycarbonylanilino, N-acetylanilino, 2-chloro-5-[2-(3-tert-butyl-4-hydroxyphenoxy)dodecaneamido]anilino); carbamoylamino groups (for instance, N-phenylcarbamoylamino, N-methylcarbamoylamino, and N,N-dibutylcarbamoylamino); sulfamoylamino groups (for instance, N,N-dipropylsulfamoylamino and N-methyl-N-decylsulfamoylamino); alkylthio groups (for instance, methylthio, octylthio, tetradecylthio, 2-phenoxyethylthio, 3-phenoxypropylthio, and 3-(4-tert-butylphenoxy) propylthio); arylthio groups (for instance, phenylthio, 2-butoxy-5-tert-octylphenylthio, 3-pentadecylphenylthio, 2-carboxyphenylthio, and 4-tetradecaneamidophenylthio); alkyloxycarbonylamino groups (for instance, methoxycarbonylamino and tetradecyloxycarbonylamino); sulfonamide groups (for instance, methanesulfonamide, hexadecanesulfonamide, benzenesulfonamide, p-toluenesulfonamide, octadecanesulfonamide, and 2-methoxy-5-tert-butylbenzenesulfonamide); carbamoyl groups (for instance, N-ethylcarbamoyl, N,N-dibutylcarbamoyl, N-(2-dodecyloxyethyl)carbamoyl, N-methyl-N-dodecylcarbamoyl, and N-[3-(2,4-di-tert-amylphenoxy)propyl]carbamoyl); sulfamoyl groups (for instance, N-ethylsulfamoyl, N,N-dipropylsulfamoyl, N-(2-dodecyloxyethyl)sulfamoyl, N-ethyl-N-dodecylsulfamoyl, and N,N-diethylsulfamoyl); sulfonyl groups (for instance, methanesulfonyl, octanesulfonyl, benzenesulfonyl, and toluenesulfonyl); alkoxycarbonyl groups (for instance, methoxycarbonyl, butoxycarbonyl, dodecyloxycarbonyl, and octadecyloxycarbonyl); heterocyclic oxy groups (for instance, 1-phenyltetrazole-5-oxy and 2-tetrahydropyranyloxy); azo groups (for instance, phenylazo, 4-methoxyphenylazo, 4-pivaloylaminophenylazo, and 2-hydroxy-4-propanoylphenylazo); acyloxy groups (for instance, acetoxy); carbamoyloxy groups (for instance, N-methylcarbamoyloxy and N-phenylcarbamoyloxy); silyloxy groups (for instance, trimethylsilyloxy and dibutylmethylsilyloxy); aryloxycarbonylamino groups (for instance, phenoxycarbonylamino); imide groups (for instance, N-succinimide, N-phthalimide, and 3-octadecenylsuccinimide); heterocyclic thio groups (for instance, 2-benzothiazolylthio, 2,4-di-phenoxy-1,3,5-triazole-6-thio, and 2-pyridylthio); sulfinyl groups (for instance, dodecanesulfinyl, 3-pentadecylphenylsulfinyl, and 3-phenoxypropylsulfinyl); phosphonyl groups (for instance, phenoxyphosphonyl, octylphosphonyl, and phenylphosphonyl); aryloxycarbonyl groups (for instance, phenoxycarbonyl); acyl groups (for instance, acetyl, 3-phenylpropanoyl, benzoyl, and 4-dodecyloxybenzoyl); and azolyl groups (for instance, imidazolyl, pyrazolyl, 3-chloro-pyrazole-1-yl, and triazolyl).

Among these substituents, as preferable ones, the alkyl groups, the cycloalkyl groups, the aryl groups, the alkoxy groups, the aryloxy groups, the alkylthio groups, the carbamoylamino groups, the aryloxycarbonylamino groups, the alkoxycarbonylamino groups, the alkylacylamino groups and the arylacylamino groups can be cited.

The $R_2$, $R_2$, $R_3$ and $R_4$ represent hydrogen atoms or substituents. In the general formula (M-I), X denotes a hydrogen atom or a group capable of coupling-off in a reaction with an oxidant of an aromatic primary amine color developing agent. More specifically, the coupling-off group includes a halogen atom, an alkoxy group, an aryloxy group, an acyloxy group, an alkyl- or aryl-sulfonyloxy group, an acylamino group, an alkyl- or aryl-sulfonamide group, an alkoxycarbonyloxy group, an aryloxycarbonyloxy group, an alkyl, an aryl- or heterocyclic thio group, a carbamoylamino group, a 5- or 6-membered nitrogen-containing heterocyclic group, an imide group, and an arylazo group can be cited. These groups may be further substitute by a permitted group as a substituent of $R_1$ through $R_4$.

Furthermore specifically, the X includes halogen atoms (for instance, fluorine atom, chlorine atom and bromine atom); alkoxy groups (for instance, ethoxy, dodecyloxy, methoxyethylcarbamoylmethoxy, carboxypropyloxy, methysulfonylethoxy, and ethoxycarbonylmethoxy); aryloxy groups (for instance, 4-methylphenoxy, 4-chlorophenoxy, 4-methoxyphenoxy, 4-carboxyphenoxy, 3-ethoxycarboxyphenoxy, 4-methoxycarbonylphenoxy, 3-acetylaminophenoxy, and 2-carboxyphenoxy); acyloxy groups (for instance, acetoxy, tetradecanoyloxy, and benzoiloxy); alkyl- or aryl-sulfonyloxy groups (for instance, methanesulfonyloxy and toluenesulfonyloxy); acylamino groups (for instance, dichloroacetylamide and heptafluorobutylamino); alkyl- or aryl-sulfonamide groups (for instance, methanesulfonamino, trifluoromethanesulfonamino and p-toluenesulfonylamino); alkoxycarbonyloxy groups (for instance, ethoxycarbonyloxy and benziloxycarbonyloxy); aryloxycarbonyloxy groups (for instance, phenoxycarbonyloxy); alkyl-, aryl- or heterocyclic thio groups (for instance, dodecylthio, 1-carboxydodecylthio, phenylthio, 2-buthoxy-5-tert-octylphenylthio, 2-benziloxycarbonylaminophenylthio and tetrazolylthio); carbamoylamino groups (for instance, N-methylcarbamoylamino and N-phenylcarbamoylamino); 5- or 6-membered nitrogen-containing heterocyclic groups (for instance, 1-imidazolyl, 1-pyrazolyl, 1,2,4-triazole-1-yl, tetrazolyl, 3,5-dimethyl-1-pyrazolyl, 4-cyano-1-pyrazolyl, 4-methoxycarbonyl-1-pyrazolyl, 4-acetylamino-1-pyrazolyl, and 1,2-dihydro-2-oxo-1-pyridyl); imide groups (for instance, succinimide and hidantoinyl); and arylazo groups (for instance, phenylazo and 4-methoxyphenylazo). Preferable X's are halogen atoms, alkoxy groups, aryloxy groups, alkyl- or aryl-thio groups, and 5- or 6-membered nitrogen-containing heterocyclic groups that combine through a nitrogen atom with a coupling active site, particularly preferably being halogen atoms, substituted aryloxy groups, substituted arylthio groups or substituted 1-pyrazolyl groups.

In the general formula (M-I), preferable magenta couplers are represented with a general formula (M-II) or (M-III) below. Particularly preferable compounds are ones represented by the general formula (M-II).

General formula (M-II)

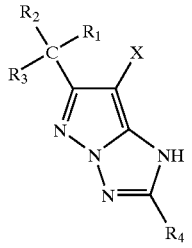

(In the general formula (M-II), $R_1$, $R_2$, $R_3$, $R_4$ and X are the same as that in the general formula (M-I).)

General formula (M-III)

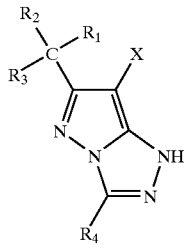

(In the general formula (M-III), $R_1$, $R_2$, $R_3$, $R_4$ and X are the same as that in the general formula (M-I).)

The groups preferable in the general formulae (M-II) and (M-III) are as follows. As the groups preferable as X, halogen atoms, alkoxy groups and aryloxy groups can be cited, among these a chlorine atom being preferable. As the substituents preferable as $R_1$ through $R_4$, alkyl groups, aryl groups, anilino groups and alkoxy groups can be cited, among these the alkyl groups or aryl groups being preferable, in particular $R_1$, $R_2$ and $R_3$ each being preferably a methyl group and $R_4$ being preferably an aryl group (these are preferably substituted). The most preferable $R_4$ is the aryl group in the general formula (M-II) and the alkyl group in the general formula (M-III). The magenta coupler used in the first embodiment of the image-forming method according to the invention is used in the range of 0.001 to 1 mol per mol of photosensitive silver halide in the same layer, preferably being used in the range of 0.003 to 0.3 mol. A molecular weight of the coupler is preferably 600 or less. Specific examples of the magenta couplers represented by the general formula (M-I) are shown below, however, the invention is not restricted thereto.

(Ma-1)
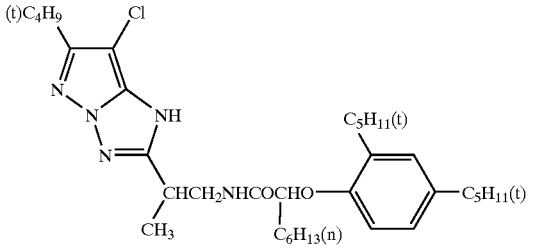
(Ma-2)
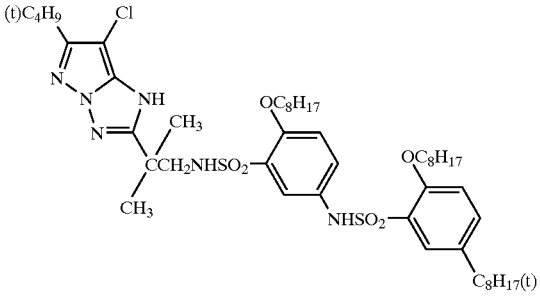
(Ma-3)
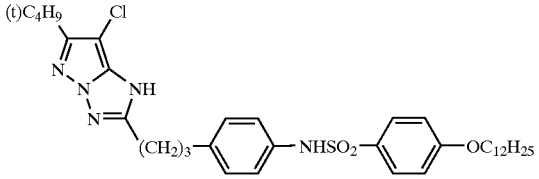
(Ma-4)
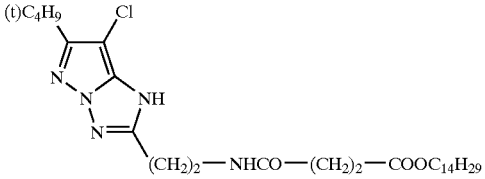
(Ma-5)
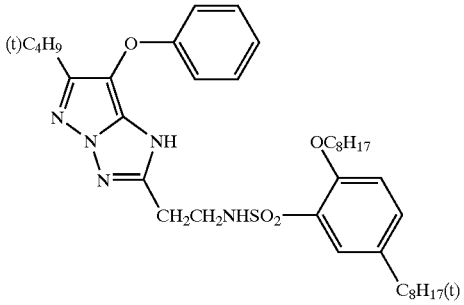
(Ma-6)
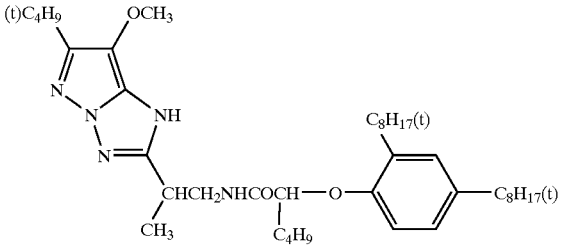
(Ma-7)
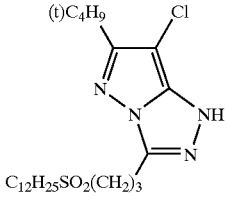
(Ma-8)
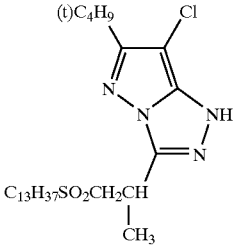
(Ma-9)
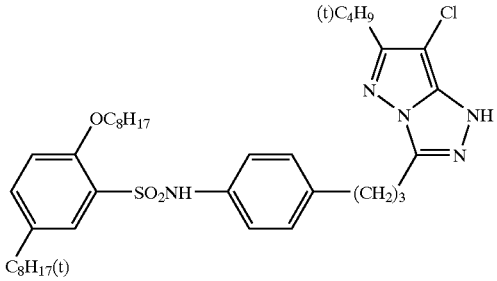
(Ma-10)
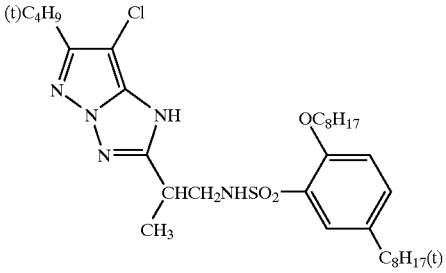
(Ma-11)
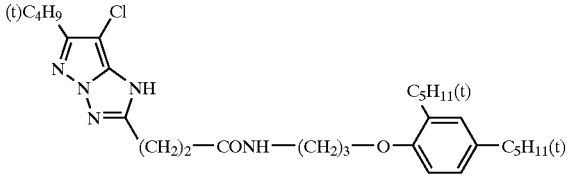

-continued
(Ma-12)
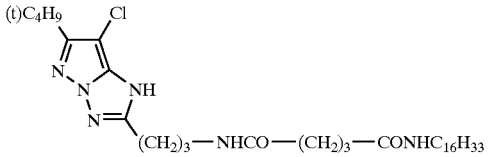
(Ma-13)
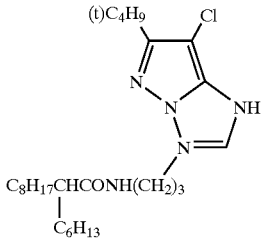
(Ma-14)
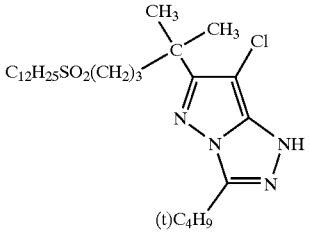
(Ma-15)
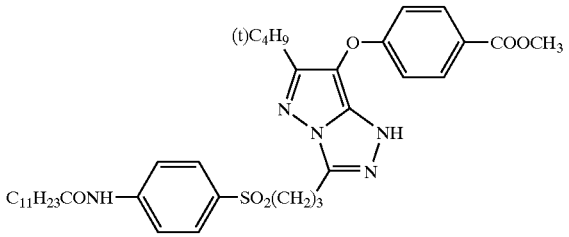
(Ma-16)
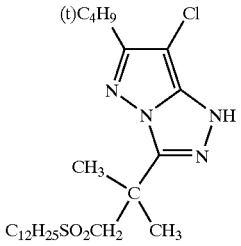
(Ma-17)
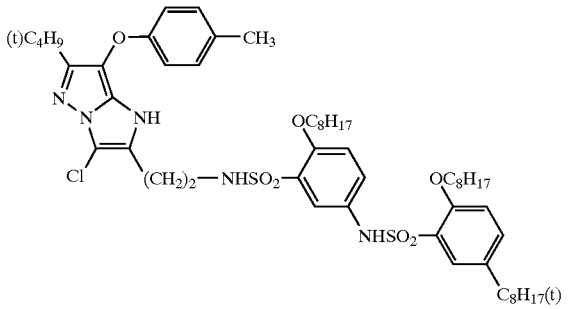
(Ma-18)
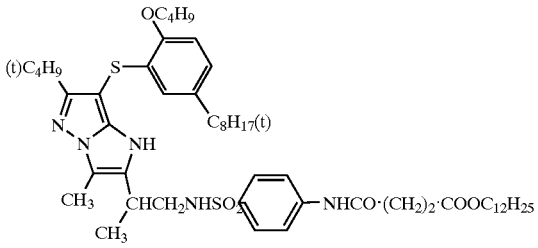
(Ma-19)
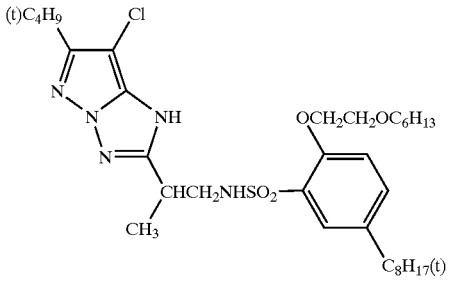

-continued
(Ma-20)
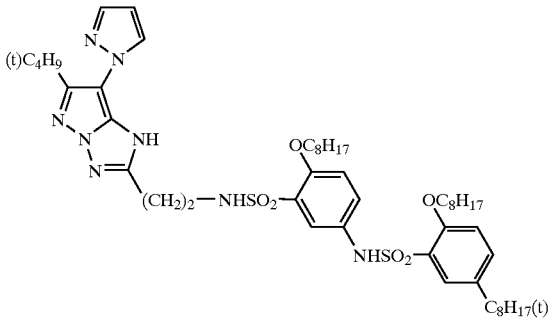
(Ma-21)
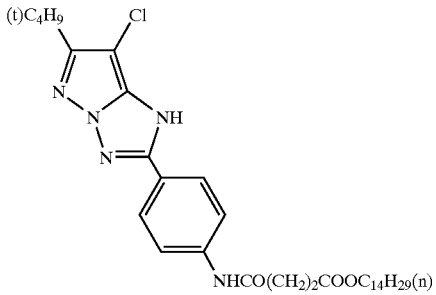
(Ma-22)
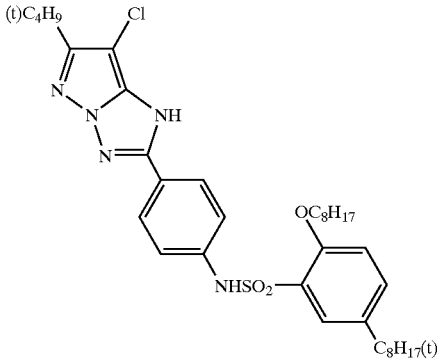
(Ma-23)
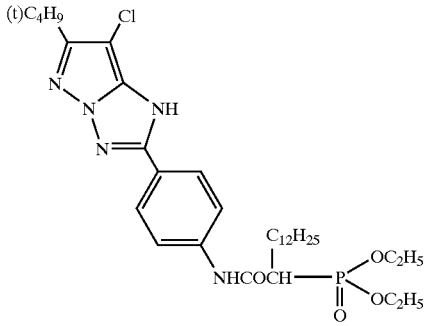
(Ma-24)
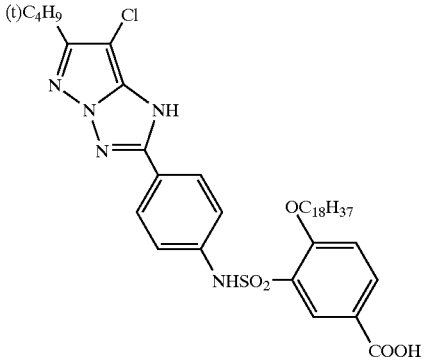
(Ma-25)
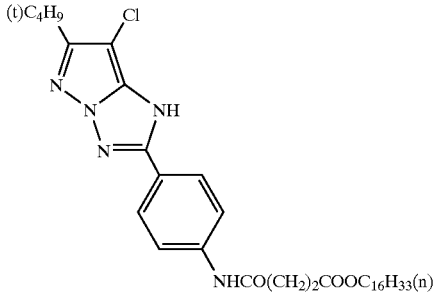
(Ma-26)
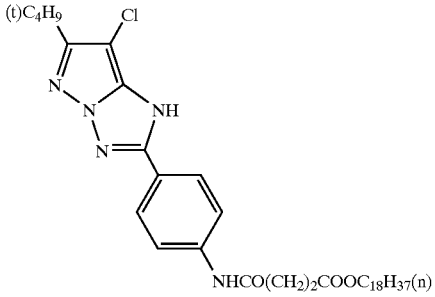
(Ma-27)
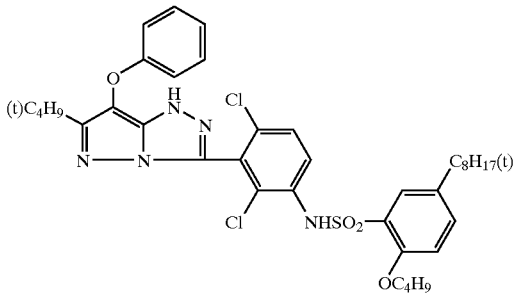

-continued
(Ma-28)
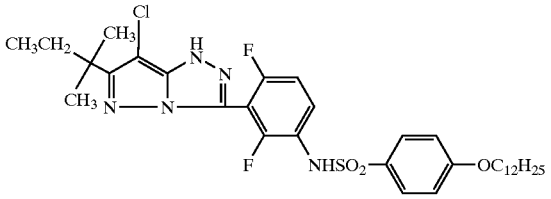
(Ma-29)
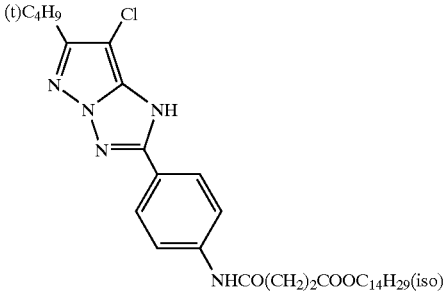
(Ma-30)
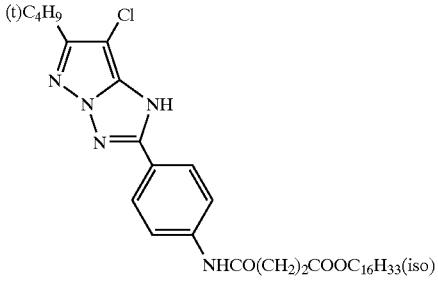
(Ma-31)
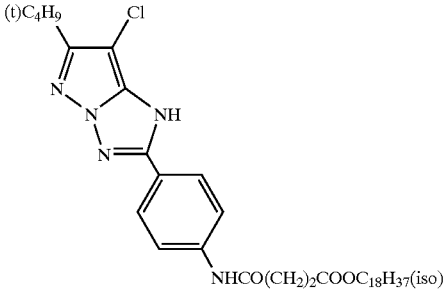
(Ma-32)
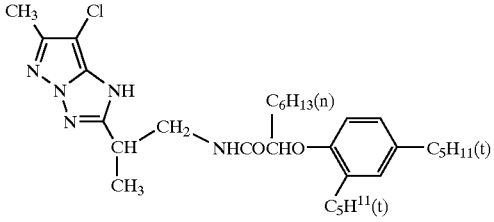
(Ma-33)
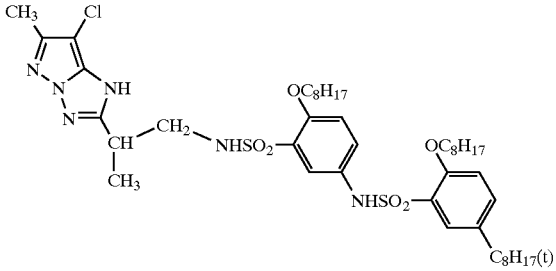
(Ma-34)
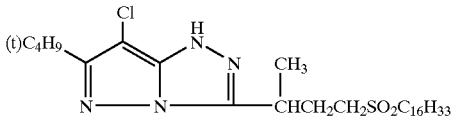
(Ma-35)
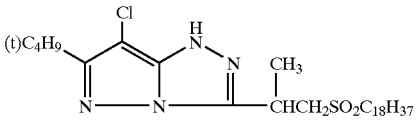
(Ma-36)
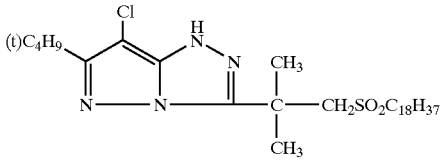
(Ma-37)
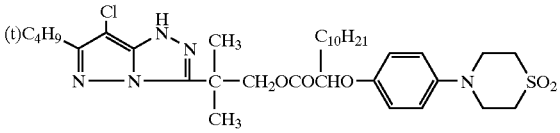

-continued
(Ma-38)
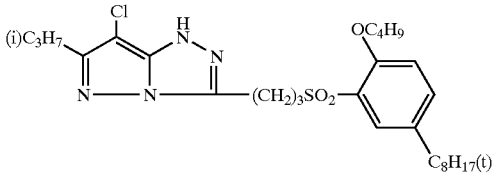
(Ma-39)
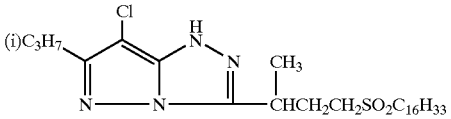
(Ma-40)
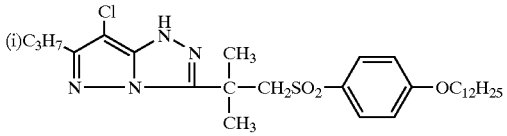
(Ma-41)
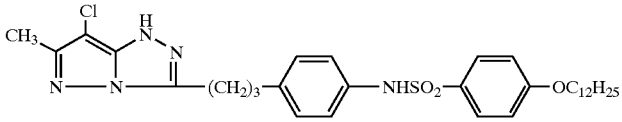
(Ma-42)
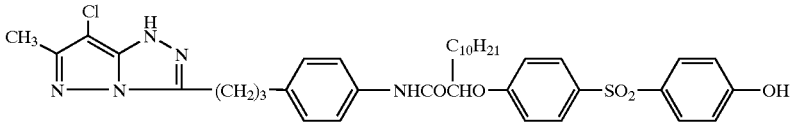
(Ma-43)
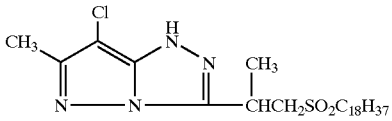
(Ma-44)
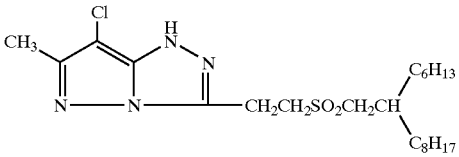
(Ma-45)
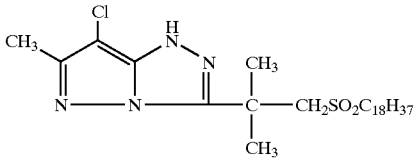
(Ma-46)
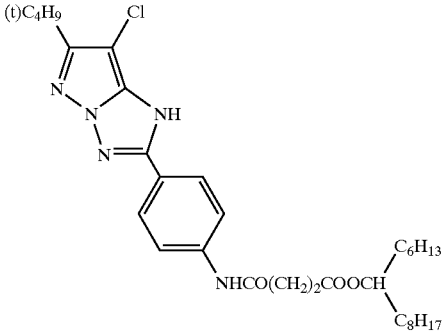
(Ma-47)
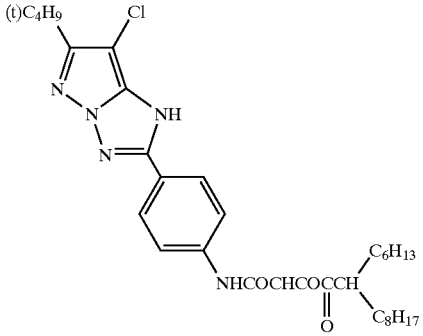
(Ma-48)
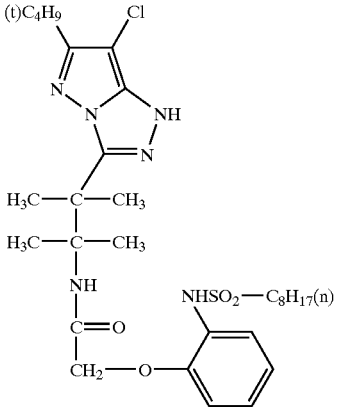

The compounds that are pyrazoloazole magenta couplers and represented by the general formula (M-I), in comparison with the pyrazolone type magenta couplers, contain less unnecessary yellow and cyan components. Accordingly, these are high in the color purity and excellent in the stability with time of the white background, resulting in obtaining stable color images.

As the yellow forming couplers that can be used in the photosensitive materials (in the specification, in some cases, simply referred to as "yellow coupler"), other than the compounds described in the Table, acylacetamide yellow couplers having a 3- to 5-membered cyclic structure to the acyl group described in EP No.0447969A1, malonedianilide type yellow couplers having a cyclic structure described in EP No. 0482552A1, pyrole-2 or 3-yl or indole-2 or 3-yl carbonylacetanilide type couplers described in EP-A Nos.953870A1, 953871A1, 953872A1, 953873A1, 953874A1 nd 953875A1, and acylacetamide type yellow couplers having a dioxane structure described in U.S. Pat. No. 5,118,599 can be preferably used. Among these, the acylacetamide type yellow couplers in which the acyl group is 1-alkylcyclopropane-1-carbonyl group and the malonedianilide type yellow couplers in which one of anilides forms an indoline structure are preferably used. These couplers can be used separately or in combination.

The couplers that can be used in the photosensitive materials, after impregnating with a loadable latex polymer (for instance, U.S. Pat. No. 4,203,716) in the presence (or absence) of a high boiling point organic solvent described in the table, or dissolving together with water insoluble and organic solvent-soluble polymer, are preferably emulsified and dispersed in an aqueous hydrophilic colloidal solution. As water insoluble and organic solvent soluble polymers that can be preferably used, single polymers or copolymers described in U.S. Pat. No. 4,857,449 column 7 to column 15 and WO 88/00723 pages from 12 to 30 can be cited. More preferably, methacrylate-based or acrylamide-based polymers, in particular, acrylamide-based polymers are preferably used from a viewpoint of the dye image stability.

In the photosensitive materials, well-known color-mixing inhibitors can be used. Among these, ones described in the following patents are preferable.

For instance, high-molecular weight redox compounds described in JP-A No.5-333501, phenydone- and hydrazine-based compounds described in WO 98/33760 and U.S. Pat. No. 4,923,787, and white couplers described in JP-A Nos.5-249637 and 10-282615 and GP No.19629142A1 can be used. Furthermore, when the pH is raised to carry out the rapid processing, redox compounds described in GP No.19618786A1, EP Nos.839623A1 and 842975A1, GP No.19806846A1 and FP No.2760460A1 can be also preferably used.

In the photosensitive materials, as the UV absorbers, compounds having a triazine skeleton that is high in the molar absorption coefficient can be preferably used. For instance, compounds described in the following patents can be used. These can be preferably added to one or both of the photosensitive layer and non-photosensitive layer. Compounds described in, for instance, JP-A Nos.46-3335, 55-152776, 5-197074, 5-232630, 5-307232, 6-211813, 8-53427, 8-234364, 8-239368, 9-31067, 10-115898, 10-147577 and 10-182621, GP No.19739797A, EP No.711804A and JP-T No.8-501291 can be used.

As the binders and protective colloids that can be used in the photosensitive materials, gelatins can be advantageously used. However, other hydrophilic colloids can be used separately or along with the gelatin. In the preferable gelatins, heavy metals contained as impurities such as iron, copper, zinc, manganese and so on are preferably 5 ppm or less, being more preferably 3 ppm or less. The content of calcium contained in the photosensitive material is preferably 20 mg/m$^2$ or less, being more preferably 10 mg/m$^2$ or less, being most preferably 5 mg/m$^2$ or less.

In the photosensitive materials, in order to inhibit mold and bacteria from breeding in the hydrophilic colloidal layer to damage images, an anti-bacteria and mold agent such as described in JP-A No.63-271247 can be preferably added. Furthermore, the coating pH of the photosensitive material is preferably from 4.0 to 7.0, being more preferably from 4.0 to 6.5.

In the photosensitive material, from viewpoints of the coating stability improvement, the static electricity generation inhibition, and the charge amount control, a surfactant may be added. As the surfactants, there are anionic surfactants, cationic surfactants, betaine surfactants and nonionic surfactants, and, for instance, ones described in JP-A No.5-333492 can be cited. As the surfactants used in the first embodiment of the image-forming method according to the invention, fluorine-containing surfactants are preferable. In particular, fluorine-containing surfactants can be preferably used. These fluorine-containing surfactants can be used separately or in combination with other known surfactants, however, can be preferably used together with other known surfactants. An amount to be added of these surfactants, though not particularly restricted, is in general in the range of $1\times10^{-5}$ to 1 g/m$^2$, being preferably in the range of $1\times10^{-4}$ to $1\times10^{-1}$ g/m$^2$, being more preferably in the range of $1\times10^{-3}$ to $1\times10^{-2}$ g/m$^2$.

The photosensitive materials can be applied to color negative films, color positive films, color reversal films, color reversal paper and color paper, among these, these can be preferably applied to the color paper.

As photographic supports that can be used in the photosensitive materials, transmissive supports and reflective support can be used. As the transmissive supports, transmissive films such as cellulose triacetate film and polyethylene terephthalate, furthermore, ones provided with an information-recording layer such as a magnetic layer to polyester between 2,6-naphthalenedicarbonic acid (NDCA) and ethylene glycol (EG) and polyester between NDCA, terephthalic acid and EG can be preferably used. As the reflective supports, ones in which a plurality of polyethylene layers or polyester layers are laminated and at least in one layer of such a water-resistive resin layers (laminated layer) a white pigment such as titanium oxide is contained are preferably used.

In addition, in the water-resistive resin layer, a fluorescent whitening agent is preferably contained. Furthermore, the fluorescent whitening agent may be dispersed in a hydrophilic colloidal layer of the photosensitive material. As the fluorescent whitening agents, preferably, benzoxazole-, cumarin-, pyrazoline-based ones can be used, and benzoxazolyl naphthalene- and benzoxazolyl stilbene-based fluorescent whitening agents are more preferable. As specific examples of the fluorescent whitening agents contained in the water-resistive resin layer, for instance, 4,4'-bis(benzoxazolyl)stilbene, 4,4'-bis(5-methylbenzoxazolyl) stilbene and mixtures thereof can be cited. The amount of the fluorescent whitening agent to be used is not particularly restricted and preferably in the range of 1 to 100 mg/m$^2$. A mixing ratio of the fluorescent whitening agent to be used in the water-resistant resin layer is preferably from 0.0005 to 3 percent by mass relative to the resin, and more preferably from 0.001 to 0.5 percent by mass.

As the reflective support, one in which, on the transmissive support or the reflective support as mentioned above, a hydrophilic colloidal layer containing a white pigment is coated, can be used. Furthermore, the reflective support may be a support having a mirror surface that has the mirror reflectivity or secondary diffusion reflectivity.

More preferably as the reflective support, one that has a polyolefin layer having fine pores on a paper base on a side thereon a silver halide emulsion layer is disposed can be cited. The polyolefin layer may be formed of a multilayer, in that case, one whose polyolefin layer adjacent to a gelatin layer on a side of a silver halide emulsion layer does not have fine pores (for instance, polypropylene, polyethylene) and polyolefin layer (for instance, polypropylene, polyethylene) on a side near on the paper base has fine pores is preferable. The density of the multi-layered or one layered polyolefin layer positioned between the paper base and photographic constituent layers is preferably in the range of 0.40 to 1.0 g/ml, being more preferably in the range of 0.50 to 0.70 g/ml. Furthermore, a thickness of the multi-layered or one layered polyolefin layer positioned between the paper base and photographic constituent layers is preferably in the range of 10 to 100 $\mu$m, being more preferably in the range of 15 to 70 $\mu$m. Still furthermore, a ratio of a thickness of the polyolefin layer to that of the paper base is preferably in the range of 0.05 to 0.2, and more preferably in the range of 0.1 to 0.15.

Furthermore, on a side (rear side) opposite to the photographic constituent layers of the paper base, a polyolefin layer is preferably disposed from a viewpoint of enhancing the stiffness of the reflective support. In this case, a polyolefin layer on a rear surface is preferably a surface-frosted polyethylene or polypropylene, the polypropylene being more preferable. A thickness of the polyolefin layer on a rear surface is preferably in a range of 5 to 50 $\mu$m, more preferably in a range of 10 to 30 $\mu$m. Furthermore, the density thereof is preferably in a range of 0.7 to 1.1 g/ml. In a reflective support in the first embodiment of the image-forming method according to the invention, as to preferable embodiments of the polyolefin layer disposed on the paper base, examples described in JP-A Nos.10-333277, 10-333278, 11-52513 and 11-65024, and EP Nos.0880065 and 0880066 can be cited.

[Image Forming Method—Fifth Embodiment—]

Among the image-forming methods according to the invention, the fifth embodiment will be detailed.

In the fifth embodiment of the image-forming method according to the invention, after subjecting a silver halide color photographic photosensitive material to the image-wise exposure, the development processing is applied and thereby an image is formed.

Firstly, the silver halide color photographic photosensitive material is subjected to the image-wise exposure on the basis of image information. An explanation of the image-wise exposure is identical with that of image-wise exposure in the first embodiment of the image-forming method according to the invention.

Then, the silver halide color photographic photosensitive material subjected to the image-wise exposure is developed. The development processing of the silver halide color photographic photosensitive material includes a color-developing step with a color developing solution, a bleach-fixing step with a bleach-fixing solution, and a rinsing step with a rinsing solution (one or both of washing water and a stabilizing solution). The silver halide color photographic photosensitive material, by sequentially immersing in the respective treatment solutions in the respective steps, is developed. The development steps are not restricted thereto, and, between the respective steps, an auxiliary step such as an intermediate washing step or a neutralizing step can be inserted. The bleach-fixing step is performed in one step with a bleach-fixing solution.

The bleach-fixing step is a step by which the silver halide color photographic photosensitive material is desilvered. The bleach-fixing step is carried out under the conditions that an average replacement rate Ta of the bleach-fixing solution is 12.0 or less and an opening rate K of a bleach-fixing bath is 0.007 ($cm^{-1}$) or less.

Here, an average replacement rate Ta of the bleach-fixing solution is given by the following equation.

$$Ta = [\text{a tank volume of the bleach-fixing tank } (L)]/([\text{an amount being processed a day } (m^2/\text{day})] \times [\text{an amount being replinished } (L/m^2)]$$

According to the equation, when, for instance, 6000 pieces of L-size print (89 mm×120 mm) are processed a day, a tank volume is 10 (L), and a replenishment amount is 0.045 ($L/m^2$), Ta becomes 3.46. When the Ta is 12.0 or less, an effect according to the invention can be recognized, and more preferably when the Ta is 8.0 or less, still furthermore preferably when the Ta is 5.0 or less, a more remarkable effect can be exhibited.

On the other hand, an opening rate K of the bleach-fixing bath is defined as a value that is obtained by dividing an area through which the bleach-fixing bath (bleach-fixing) is in contact with an air surface by a tank volume of the bleach-fixing bath. From viewpoints of inhibiting the processing solution from precipitating and securing performance stability, the suppression of water vaporization is demanded. When the K is 0.007 ($cm^{-1}$) or less, an effect according to the invention is recognized, and more preferably when the K is 0.006 ($cm^{-1}$) or less, still more preferably when the K is 0.005 ($cm^{-1}$) or less, an effect according to the invention is more conspicuously exhibited.

The developing solutions are usually used while replenishing. Preferably, an amount being replenished of the color developing solution is 20 to 60 ml per 1 $m^2$ of the photosensitive material, that of the bleach-fixing solution being 20 to 50 ml per 1 $m^2$ of the photosensitive material, and that of the rinse solution (one or both of washing water and stabilizing solution) being 50 to 1000 ml in total of the rinse solution. Furthermore, the developing solutions can be also replenished according to an area of the developed silver halide color photographic photosensitive material.

A color development time (that is, a time period during which the color development step is carried out) is preferably 45 seconds or less, being more preferably 30 seconds or less, being furthermore preferably 25 seconds or less and 6 second or more, being most preferably 20 seconds or less and 6 seconds or more. Similarly, a bleach-fixing time (that is, a time period during which the bleach-fixing step is carried out) is preferably 45 seconds or less, being more preferably 30 seconds or less, being furthermore preferably 25 seconds or less and 6 second or more, being most preferably 20 seconds or less and 6 seconds or more. Furthermore, a rinsing (water washing or stabilization) time (that is, a time period during which the rinsing step is carried out) is preferably 90 seconds or less, being more preferably 30 seconds or less, being furthermore preferably 30 seconds or less and 6 seconds or more.

The color development time denotes a time period from a time when a photosensitive material enters the color developing solution and to a time when the photosensitive material enters a bleach-fixing solution of the following processing step. When the processing is applied with, for instance, an automatic developer and so on, the color development time denotes a total of a time period (so-called in-liquid time period) during which the photosensitive material is immersed in the color developing solution and a time period (so-called in-air time period) during which the photosensitive material leaves the color developing solution and is being transferred in air toward the bleach-fixing solution of the following processing step. Similarly, the bleach-fixing time denotes a time period from a time when the photosensitive material enters the bleach-fixing solution and up to a time when the photosensitive material enters the following washing or stabilizing bath. Furthermore, the rinsing time (water washing or stabilization) denotes a time period (so-called in-solution time period) during which the photosensitive material enters the rinsing solution (water washing or stabilizing solution) and is in the solution on the way to a drying step.

Then, the silver halide color photographic photosensitive material thereto the developing processing is applied is subjected to the post-process such as a drying step. In the drying step, from a viewpoint of reducing an amount of moisture carried over to an image film of the silver halide color photographic photosensitive material, immediately after the developing processing (rinsing step), by absorbing moisture with a squeeze and cloth, the drying can be accelerated. It goes without saying that, by raising a temperature or by altering a shape of a blowing nozzle to make a drying air stronger, the drying can be enhanced. Furthermore, as described in JP-A-No.3-157650, a control of an angle of air blowing of the drying air to the photosensitive material and a removing method of an exhaust air also can accelerate the drying.

Thus, an image is outputted to the silver halide color photographic photosensitive material.

Other preferable embodiments of the fifth embodiment of the image-forming method according to the invention are identical with other preferable embodiments in the first embodiment of the image-forming method according to the invention.

[Silver Halide Color Photographic Photosensitive Material—First Embodiment—]

A first embodiment of a silver halide color photosensitive material (hereinafter referred to as a photosensitive material) according to the invention that is applied to the fifth embodiment of the image-forming method of the invention will be explained.

The first embodiment of the photosensitive material according to the invention comprises, on a support, photographic constituent layers including at least one blue-sensitive silver halide emulsion layer containing a yellow dye-forming coupler, at least one green-sensitive silver halide emulsion layer containing a magenta dye-forming coupler, at least one red-sensitive silver halide emulsion layer containing a cyan dye-forming coupler and at least one non-photosensitive hydrophilic colloidal layer. The silver halide emulsion layer containing a yellow dye-forming coupler functions as a yellow developing layer, the silver halide emulsion layer containing a magenta dye-forming coupler as a magenta developing layer, and the silver halide emulsion layer containing a cyan dye-forming coupler as a cyan developing layer. The silver halide emulsion that is contained in each of the yellow developing layer, the magenta developing layer and the cyan developing layer preferably has the photosensitivity to a light (for instance, light of a blue region, green region and red region) different in the wavelength from each other.

The photosensitive material may have, other than the yellow developing layer, magenta developing layer and cyan developing layer, as needs arise, as a non-photosensitive hydrophilic colloidal layer described later, an anti-halation layer, an interlayer and a colored layer.

The photosensitive material contains, in the red-sensitive silver halide emulsion layer, as the cyan dye-forming coupler, at least one kind selected from compounds represented by a general formula (IA) described below, and exhibits such photographic performance that a cyan concentration change ΔDc after the developing processing is 0.2 or less. Furthermore, in the green-sensitive silver halide emulsion layer, as the magenta dye-forming coupler, at least one kind selected from compounds represented by a general formula (M-I) (in particular a general formula (M-II)) described below is preferably contained.

Here, the cyan concentration change ΔDc will be explained. By use of Frontier 330 manufactured by Fuji Photo Film Co., Ltd., with a processor and a processing solution described in Embodiment 1 of the specification described below, a calibration pattern is outputted, therein a patch of a portion whose cyan X-rite measurement is the highest is measured 10 times within 3 minutes after the processing, an average value thereof is put as Dc (Fr). The patch is preserved for three months in a well-ventilated dark place in an atmosphere of 30 degree centigrade and 55 percent, according to a measurement method similar to Dc (Fr), the patch is measured, and thereby a Dc (3 m) is obtained. From these values, the cyan concentration change ΔDc is defined by an equation $$\Delta Dc = Dc(3\text{ m}) - Dc\ (Fr).$$

The silver halide emulsion will be explained.

An explanation of the silver halide emulsion in the first embodiment of the silver halide color photographic photosensitive material according to the invention is identical with that of the silver halide emulsion of the silver halide color photographic photosensitive material applied to the first embodiment of the image-forming method of the invention.

In the following, the first embodiment of the photosensitive material according to the invention will be detailed.

A total coating amount of silver in photographic constituent layers in the photosensitive material is preferably 0.47 $g/m^2$ or less, more preferably 0.25 $g/m^2$ to 0.47 $g/m^2$, still more preferably 0.25 $g/m^2$ to 0.45 $g/m^2$, and further more preferably 0.25 $g/m^2$ to 0.40 $g/m^2$.

In the photosensitive material, though gelatins are used as hydrophilic binder, as needs arise, hydrophilic colloids such as other gelatin derivatives, graft polymers between gelatins and other polymers, proteins other than the gelatins, sugar derivatives, cellulose derivatives, and synthetic hydrophilic polymers such as single or co-polymer can be used along with the gelatins. The gelatins used in the first embodiment of the silver halide color photographic photosensitive materials of the invention may be any one of lime-treated gelatins and acid-treated gelatins; furthermore, gelatins produced from any one of raw materials such as beef bones, calf skins, pig skins can be also used; however, the lime-treated gelatins produced from beef bones and pig skins as raw material are preferable.

A total coating amount of gelatin in the photographic constituent layers in the photosensitive material, that is, a total amount of a hydrophilic binder contained in the photosensitive silver halide emulsion layers and the non-photosensitive hydrophilic colloidal layers from the support to the hydrophilic colloidal layer remotest from the support on a side where the silver halide emulsion layers are coated is preferably 4.0 g/m$^2$ to 7.0 g/m$^2$, more preferably 4.5 g/m$^2$ to 6.5 g/m$^2$, and most preferably 5.0 g/m$^2$ to 6.0 g/m$^2$. When the amount of the hydrophilic binder is more than the above range, by damaging the rapid processability in the color developing processing, deteriorating the blix discoloration, and damaging the rapid processability in the rinsing processing (one or both of water washing and stabilizing steps), in some cases, the effect of the invention may be lowered. Furthermore, when the amount of the hydrophilic binder is less than the above range, disturbances such as the pressure fog streak caused by deficiency of film strength may be unfavorably caused.

In the photosensitive material, in order to inhibit the irradiation and halation from occurring and to improve the safelight safety, in the hydrophilic colloidal layer, dyes (among these, oxonol dyes and cyanine dyes) capable of decoloring by treatment described in EP No.0337490A2 pages 27 to 76 are preferably added. Furthermore, also dyes described in EP No.0819977 can be preferably added. Among these water-soluble dyes, there are ones in which an increase in an amount to be used causes the color separation or the deterioration of the safelight safety. As the dyes that can be used without causing the color-separation, water-soluble dyes described in JP-A Nos.5-127324, 5-127325 and 5-216185 are preferable.

In the photosensitive material, a colored layer capable of decoloring by treatment in place of the water-soluble dye, or in combination with the water-soluble dye can be used. An explanation of the colored layer and a method of forming the colored layer is identical with that of the colored layer in the photosensitive material that is applied to the first embodiment of the image-forming method of the invention.

The photosensitive material preferably includes at least one layer of each of the yellow developing silver halide emulsion layer, the magenta developing silver halide emulsion layer and the cyan developing silver halide emulsion layer; in general, these silver halide emulsion layers are arranged, from a side nearer to the support, in order of the yellow developing silver halide emulsion layer, the magenta developing silver halide emulsion layer and the cyan developing silver halide emulsion layer.

However, a layer configuration different from the above may be taken. An explanation of the layer configuration is identical with that in the photosensitive material that is applied to the first embodiment of the image-forming method of the invention.

An explanation of the silver halide emulsions and other raw materials (additives and so on) and the photographic constituent layers (layer arrangement and so on) that can be applied to the photosensitive materials, and processing methods and processing additives that are applied for processing the photosensitive materials is identical with that in the photosensitive material applied to the first embodiment of the image-forming method of the invention.

Particularly, in the first embodiment of the photosensitive materials according to the invention, as to the reflective supports and silver halide emulsions, furthermore different kinds of metal ion species doped in silver halide grains, preservation stabilizers or anti-foggants of the silver halide emulsions, the chemical sensitization method (sensitizer), the spectral sensitization method (spectral sensitizer), cyan, magenta, and yellow couplers and emulsifying dispersion methods thereof, the color image preservation improver (stain inhibitor and fading inhibitor), dyes (colored layers), kinds of gelatin, layer configurations of the photosensitive materials and the coating pH of the photosensitive materials, ones described in the respective positions of patents shown in the above Table 1 can be particularly preferably applied.

In the first embodiment of the photosensitive material according to the invention, the dye-forming coupler (in the specification, referred to also as a coupler) is added to photographic useful materials and other high-boiling point organic solvent, emulsified and dispersed therewith, and thereby incorporated in the photosensitive material as a dispersion. The solution is emulsified and dispersed in fine particles in a hydrophilic colloid, preferably in an aqueous gelatin solution together with a dispersant of a surfactant by use of known equipment such as a ultrasonic vibrator, colloid mill, homogenizer, MANTON GAULIN, and high-speed dissolver, and thereby a dispersion is obtained.

An explanation of the high-boiling point organic solvents, an explanation of the auxiliary solvents, an explanation of organic solvents completely miscible with water, an explanation of obtained oleophilic fine particle dispersion, an explanation of masses of the high-boiling point organic solvent and the total cyan coupler to be used, and an explanation of the coloring pigment are identical with that in the first embodiment of the image-forming method according to the invention.

As the cyan, magenta and yellow couplers used in the first embodiment of the photosensitive materials of the invention, other than the above, couplers described in JP-A No.62-215272 page 91, right upper column, line 4 to page 121, left upper column, line 6, JP-A No.2-33144 page 3, right upper column, line 14 to page 18, left upper column, the last line, and page 30, right upper column, line 6 to page 35, right lower column, line 11, and EP No.0355,660A2 page 4, lines 15 to 27, page 5, line 30 to page 28, the last line, page 45, lines 29 to 31, and page 47, line 23 to page 63, line 50 are also useful.

Furthermore, in the invention, compounds represented by general formulae (II) and (III) of WO-98/33760 and a general formula (D) of JP-A No.10-221825 may be preferably added.

As the cyan dye-forming couplers (in some cases, referred to simply as "cyan coupler"), in the first embodiment of the photosensitive materials, at least one kind selected from compounds represented by the general formula (IA) is contained; however, another cyan coupler may be used together.

An explanation of the compounds represented by the general formula (IA), an explanation of preferable coupling-off groups are identical with that in the first embodiment of the image-forming method of the present invention.

As the magenta dye-forming couplers (in some cases, simply referred to as "magenta coupler") that can be used in the photosensitive materials, 5-pyrazolone-based magenta couplers and pyrazoloazole-based magenta couplers such as described in the known references in the Table 1 can be used. As the pyrazoloazole-based magenta couplers, a structure shown by the above general formula (M-I) is preferable. An explanation of the compounds represented by the above general formula (M-I) is identical with that in the first embodiment of the image-forming method according to the invention.

In the general formula (M-I), preferable magenta couplers are represented by the general formula (M-II) or (M-III). Particularly preferable ones are compounds represented by the general formula (M-II). An explanation of the general formulae (M-II) and (M-III) is identical with that in the first embodiment of the image-forming method according to the invention.

Furthermore, specific examples of the magenta couplers represented by the general formula (M-I) are also identical with that in the first embodiment of the image-forming method according to the invention.

The compounds that are pyrazoloazole-based magenta couplers and represented by the general formula (M-I), in comparison with the pyrazolone-based magenta couplers, contain less unnecessary yellow and cyan components. Accordingly, these are high in the color purity and excellent in the stability with time of the white background, resulting in obtaining stable color images.

As the yellow dye-forming couplers that can be used in the photosensitive materials (in the specification, in some cases, simply referred to as "yellow coupler"), other than the compounds described in the Table 1, ones identical with the first embodiment of the image-forming method of the invention can be cited.

The couplers that can be used in the photosensitive materials, after impregnating with a loadable latex polymer (for instance, U.S. Pat. No. 4,203,716) in the presence (or absence) of the high boiling point organic solvent described in Table 1, or dissolving together with a water insoluble and organic solvent-soluble polymer, are preferably emulsified and dispersed in an aqueous hydrophilic colloidal solution. As water insoluble and organic solvent soluble polymers that can be preferably used, ones similar to the first embodiment of the image-forming method according to the invention can be cited.

In the photosensitive material, known color-mixing inhibitors can be used, and ones similar to the first embodiment of the image-forming method of the invention can be preferably cited.

In the photosensitive material, compounds having a triazine skeleton that is high in the optical molar absorption coefficient can be preferably used as UV-light absorber, and as examples thereof, ones similar to the first embodiment of the image-forming method according to the invention can be cited.

An explanation of binders and protective colloids that can be used in the photosensitive material is similar to that in the first embodiment of the image-forming method according to the invention.

In the photosensitive material, in order to inhibit mold and bacteria from breeding in the hydrophilic colloidal layer to damage images, the anti-bacteria agents and anti-mold agents such as described in JP-A No.63-271247 can be preferably added. Furthermore, the coating pH of the photosensitive material is preferably 4.0 to 7.0, being more preferably 4.0 to 6.5.

In the photosensitive material, from viewpoints of an improvement in the coating stability, an inhibition of the static electricity generation, and a control of an amount of electrostatic charges, a surfactant may be added. An explanation of specific examples of the surfactants and amounts to be added are identical with that in the first embodiment of the image-forming method according to the invention.

The photosensitive material can be applied to color negative films, color positive films, color reversal films, color reversal paper and color paper; however, among these, it can be preferably applied to the color paper.

An explanation of the photographic support that can be used in the photosensitive material is similar to that in the first embodiment of the image-forming method according to the invention.

In addition, the water-resistive resin layer is preferable to contain a fluorescent whitening agent. Furthermore, the fluorescent whitening agent may be dispersed in a hydrophilic colloidal layer of the photosensitive material. An explanation of preferable fluorescent whitening agents, specific examples of the fluorescent whitening agents contained in the water-resistive resin layer and an amount to be used is identical with that in the first embodiment of the image-forming method according to the invention.

An explanation of the reflective support and an explanation of polyolefin layer are similar to that in the first embodiment of the image-forming method according to the invention.

[Image Forming Method—Tenth Embodiment—]

An image forming method according to the tenth embodiment of the invention will be described in detail.

The image forming method according to the tenth embodiment of the invention includes the steps of subjecting a silver halide color photographic photosensitive material to image-wise exposure, and forming an image by developing the exposed material.

First, the silver halide color photographic photosensitive material is subjected to imagewise exposure according to image information. The embodiment adopts a laser scanning exposure system using a solid-state or semiconductor laser light modulated on the basis of image information (particularly, digital data). Specifically, there may preferably be employed a digital scanning exposure system using monochromatic high-density light such as from a gas laser, light emitting diode, semiconductor laser or second harmonic generating source (SHG) wherein either a semiconductor laser or a solid-state laser using a semiconductor laser as a pumping source is combined with non-linear optical crystals. From a standpoint of realizing a compact and low-cost system, it is preferred to employ the semiconductor laser or the second harmonic generating source (SHG) wherein the semiconductor laser or solid-state laser is combined with the non-linear optical crystals. In the light of designing a compact, affordable apparatus featuring longevity and stability, the use of the semiconductor laser is particularly preferred, or the light source for exposure particularly preferably employs at least one semiconductor laser.

Where such a scanning light source for exposure is used, the peak wavelength of spectral sensitivity of the photosensitive material can be set as desired according to the wavelength of the scanning light source to be used. In the SHG light source employing either the solid-state laser using the semiconductor laser as the pumping source, or the semiconductor in combination with the non-linear optical crystals, the oscillation wavelength of the laser can be halved and hence, blue light and green light can be obtained. Accordingly, the peaks of spectral sensitivity of the photosensitive material can be present in three ordinary blue, green and red regions. Assumed that a per-pixel exposure time for such a scanning exposure is defined as time required for exposing a pixel size at a pixel density of 400 dpi, the exposure time may preferably be $10^{-3}$ seconds or less, or more preferably $10^{-4}$ seconds or less, or still more preferably of $10^{-6}$ seconds or less.

Details of examples and particularly preferred examples of the semiconductor laser light source are the same as those of the first embodiment of the image forming method of the invention.

Subsequently, the silver halide color photographic photosensitive material thus imagewise exposed is subjected to the development process. The development process includes: a color development step for color-developing the imagewise exposed silver halide color photographic photosensitive material using a color developing solution; a bleach-fixing step using a bleach-fixing solution; and a rinsing step (water-rinsing and/or stabilizing) using a rinsing solution (rinsing water and/or stabilizing solution). The silver halide color photographic photosensitive material is immersed in the individual processing solutions in this order so as to be developed. The development process is not limited to these steps and may further include a supplementary step interposed between the steps, such as an intermediary water-rinsing step or a neutralizing step. The bleach-fixing step may be done in one step using a bleach-fixing solution or otherwise, may be carried out in two separate steps including a bleaching step using a bleaching solution and a fixing step using a fixing solution.

Each of the processing solutions is used as replenished with a replenisher. According to the invention, a replenishing rate of the color developing solution is in the range of 20 to 60 ml per 1 $m^2$ of the photosensitive material, that of the bleach-fixing solution is in the range of 20 to 50 ml or more preferably of 25 to 45 ml per 1 $m^2$ of the photosensitive material. A replenishing rate of the rinsing solution (rinsing water and/or stabilizing solution) is in such a range to make up 50 to 1000 ml of rinsing fluid in total. Furthermore, the replenishing amount of the rinsing solution may be increased according to the area of the silver halide color photographic photosensitive material to be developed.

A color development time (or a period of time during which the color development step is carried out) is preferably 45 seconds or less, more preferably 30 seconds or less, or still more preferably 28 seconds or less, particularly preferably in the range of 6 to 25 seconds, or most preferably in the range of 6 to 20 seconds. A bleach-fix time (a period of time during which the bleach-fixing step is carried out) is preferably 45 seconds or less, more preferably 30 seconds or less, still more preferably in the range of 6 to 25 seconds, or particularly preferably in the range of 6 to 20 seconds. A rinse time (a period of time during which the rinsing step is carried out) for water rinsing or stabilization is preferably 90 seconds or less, more preferably 30 seconds or less, or still more preferably in the range of 6 to 30 seconds.

The color development time means a period of time between when the photosensitive material is immersed in the color developing solution and when the material is immersed in the bleach-fixing solution of the subsequent step. In a case where the photosensitive material is processed by an automatic developing machine, for example, the color development time means the sum of a time period during which the photosensitive material is immersed in the color developing solution (so-called an in-liquid time) and a time period during which the photosensitive material drawn out of the color developing solution is delivered to the bleach-fixing solution of the subsequent step as exposed to the air (so-called an in-air time). Likewise, the bleach-fix time means the time period between when the photosensitive material is immersed in the bleach-fixing solution and when the photosensitive material is immersed in the subsequent water-rinsing or stabilizing bath. The rinse time (water rinsing or stabilization) means the time period (so-called a in-liquid time) between when the photosensitive material is immersed in the rinsing fluid (rinsing water or stabilizing solution) and when the photosensitive material is conveyed in the fluid to be subjected to a drying step.

Then, the silver halide color photographic photosensitive material through the development process is subjected to a post process including the drying step and the like. From a standpoint of reducing the amount of water carried over in an image film of the silver halide color photographic photosensitive material, the drying step may be performed in a manner that the development process (the rinsing step) is immediately followed by squeezing out the water by way of squeeze rolls or by absorbing the water with cloth for accelerating the drying process. As is normal, the drying process can be accelerated by elevating the temperature, or by modifying the configuration of a blow nozzle for intensifying the air blow. As set forth in JP-A No.3-157650, the drying process may also be accelerated by adjusting an angle of the air blow onto the photosensitive material or by devising a method for removing exhaust air.

In this manner, the image is outputted on the silver halide color photographic photosensitive material.

Another preferred embodiments of the image forming method according to the tenth embodiment of the invention will be described as below.

The image forming method of the invention may preferably be practiced in combination with any of the exposure-development systems set forth in the publicly known documents stated in the description of the image forming method according to the first embodiment of the invention.

The details of the scanning exposure system are described in the patent publications listed in the above Table 1.

In the imagewise exposure, a band stop filter disclosed in U.S. Pat. No. 4,880,726 may preferably be used for eliminating optical color mixing thereby dramatically improving the color reproducibility.

Furthermore, prior to the application of the image information, copy control may be provided by forming a yellow micro-dot pattern by pre-exposure, as suggested by EP-A Nos.0789270A1 and 0789480A1.

The development process may preferably use processing materials and processing methods disclosed in JP-A No.2-207250 (from page 26, lower-right column, line 1 to page 34, upper-right column, line 9), and JP-A No.4-97355 (from page 5, upper-left column, line 17 to page 18, lower-right column, line 20). The compounds set forth in the patent publications listed in the above Table 1 are preferred as a preservative for use in the developing solution.

A typical development process employs a Mini-Labo Printer Processor (PP350 commercially available from Fuji Photo Film Co., Ltd.) as a color developing processor and CP48S Chemicals as a processing agent. The development process includes: imagewise exposing the photosensitive material via a negative film having an average density, and processing the photosensitive material using a processing solution given by a continuous processing performed until a replenished amount of a replenisher to the color developing tank reaches twice the capacity of the tank.

The processing chemicals may also be CP47L commercially available from Fuji Photo Film Co., Ltd.

[Sixth Embodiment of Silver Halide Color Photographic Photosensitive Material]

Now, description is made on a silver halide color photographic photosensitive material (hereinafter, referred to as "photosensitive material") according to a sixth embodiment of the invention, the photosensitive material applied to the image forming method according to the tenth embodiment of the invention.

The photosensitive material of the sixth embodiment of the invention has a photographic constitution wherein at least one blue-sensitive silver halide emulsion layer containing a yellow-dye forming coupler, at least one green-sensitive silver halide emulsion layer containing a magenta-dye forming coupler, at least one red-sensitive silver halide emulsion layer containing a cyan-dye forming coupler, and at least one non-sensitive hydrophilic colloid layer are laminated on a support. The silver halide emulsion layer containing the yellow-dye forming coupler functions as a yellow-color developing layer, the silver halide emulsion layer containing the magenta-dye forming coupler functioning as a magenta-color developing layer, the silver halide emulsion layer containing the cyan-dye forming coupler functioning as a cyan-color developing layer. It is preferred that the yellow-color developing layer, the magenta-color developing layer and the cyan-color developing layer are sensitive to lights of different wavelength regions (for example, a region of blue light, a region of green light and a region of red light), respectively.

Additionally to the yellow-color developing layer, magenta-color developing layer and cyan-color developing layer, the photosensitive material may further include an anti-halation layer, intermediate layer and colored layer as the non-sensitive hydrophilic colloid layer.

In order to form a solid image having high chroma and less density variations through the scanning exposure using the solid-state and/or semiconductor laser and through the development using the processing solution replenished at a low rate, the photosensitive material has a requirement that the red-sensitive silver halide emulsion layer contains the cyan-dye forming coupler in a coated density of 10 mg/cm$^3$ to 130 mg/cm$^3$. The coated density of the cyan-dye forming coupler is preferably 50 mg/cm$^3$ to 130 mg/cm$^3$, more preferably 60 mg/cm$^3$ to 120 mg/cm$^3$, and still more preferably 70 mg/cm$^3$ to 90 mg/cm$^3$. It is noted that in a case where plural types of cyan-dye forming couplers are used, the coated density is determined based on the total coating amount of the couplers. If the coated density is too small, problems such as a decreased density of the developed color and an increased layer thickness may result. If, on the other hand, the coated density is too great, an inconsistent laser exposure or the like may result.

In the light of further enhancing the working effects of the invention, it is preferred that the invention employs, as the cyan-dye forming coupler, at least one of couplers represented by general formula (PTA-I) or (PTA-II) and/or at least one of couplers represented by a general formula (IA), which will be described hereinlater. When the coupler represented by the general formula (PTA-I) or (PTA-II) is used, a coated density of the coupler is preferably 10 mg/cm$^3$ to 90 mg/cm$^3$, more preferably 50 mg/cm$^3$ to 90 mg/cm$^3$, and still more preferably 60 mg/cm$^3$ to 80 mg/cm$^3$. When the coupler represented by the formula (IA) is used, a coated density thereof is preferably 70 mg/cm$^3$ to 130 mg/cm$^3$, more preferably 70 mg/cm$^3$ to 100 mg/cm$^3$, and still more preferably 80 mg/cm$^3$ to 90 mg/cm$^3$.

The calculation of the coated density dictates the need for estimating the thickness of the red-sensitive silver halide emulsion layer, which can be determined based on a photographic sectional image of the photosensitive material taken by a scanning beam microscope. The coated density can be calculated based on the estimated thickness of the layer.

Now, the details of the silver halide emulsion are described.

The details of the silver halide emulsion of the silver halide color photographic photosensitive material according to the sixth embodiment of the invention are the same as those of the silver halide emulsion of the silver halide color photographic photosensitive material applied to the image forming method according to the first embodiment, except for the details of sensitization with colloidal gold sulfide and chalcogen sensitization.

The photosensitive material according to the sixth embodiment of the invenion may employ the known photographic materials and additives.

For instance, a transmissive support or a reflective support may be used as the photographic support. Examples of a preferred transmissive support include a transparent film such as cellulose nitrate film and polyethylene terephthalate film; a polyester film of 2,6-naphthalenedicarboxylic acid (NDCA) and ethylene glycol (EG) or of NDCA, terephthalic acid and EG, the films formed with an information recording layer such as of magnetic layer. As the reflective support, particularly preferred is a laminate of water-proof resin layers such as polyethylene layers or polyester layers, at least one of which contains a white pigment such as titanium oxide.

The reflective support may preferably have an arrangement wherein a polyolefin layer having micropores is provided on a side of a paper base where the silver halide emulsion layer is formed. The polyolefin layer may have a multi-layered structure. In this case, it is more preferred that a polyolefin layer (such as of polypropylene or polyethylene) adjoining a gelatin layer bearing the silver halide emulsion layer is free from the micropores, whereas a polyolefin layer (such as of polypropylene or polyethylene) close to the paper base contains the micropores. The multiple or single polyolefin layer interposed between the paper base and the photographic layer may preferably have a density in the range of 0.40 to 1.0 g/ml, or more preferably of 0.50 to 0.70 g/ml. The multiple or single polyolefin layer interposed between the paper base and the photographic layer may preferably have a thickness of 10 to 100 $\mu$m, and more preferably 15 to 70 $\mu$m. A thickness ratio of the polyolefin layer to the paper base is preferably 0.05 to 0.2, and more preferably 0.1 to 0.15.

The silver halide emulsion, the other materials (such as additives) and photographic layers (layer structure and the like) of the photosensitive material, as well as the processing method or the processing additives used for processing the photosensitive material are the same as those of the silver halide color photographic photosensitive material applied to the image forming method according to the first embodiment of the invention.

According to the invention, particularly preferred reflective supports; silver halide emulsions; types of foreign metal ions doped in the silver halide grains; preservatives or antifoggants for the silver halide emulsion; chemical sensitization methods (sensitizers); spectral sensitization methods (spectral sensitizers); cyan-, magenta- and yellow-couplers and emulsification/dispersion methods therefor; color image storability modifiers (stain inhibitors and color fade inhibitors); dyes (colored layers); types of gelatin; layer structure of the photosensitive material; pH of the coating films on the photosensitive materials and the like are those described in the patent publications listed in the above Table 1.

Other preferred cyan-, magenta- and yellow-couplers for use in the photosensitive material according to the sixth embodiment of the invention are those set forth in JP-A No.62-215272 (from page 91, upper-right column, line 4 to page 121, upper-left column, line 6), JP-A No.2-33144 (from page 3, upper-right column, line 14 to page 18, upper-left column, last line and from page 30, upper-right column, line 6 to page 35, lower-right column, line 11), EP-A No.0355, 660A2 (from page 4 line 15 to line 27, from page 5 line 30 to page 28 last line, from page 45 line 29 to line 31, from page 47 line 23 to page 63 line 50).

The invention may use, as additives, compounds represented by general formulae (II) and (III) in WO No.98-33760 and a general formula (D) set forth in JP-A No.10-221825. It is preferred to add such a compound.

A preferred cyan-dye forming coupler (sometimes referred to simply as "cyan coupler") includes pyrrolotriazole cyan couplers. Particularly preferred are couplers represented by general formulae (I) and (II) in JP-A No.5-313324, a coupler represented by a general formula (I) in JP-A No.6-347960 and specific examples of these couplers set forth in these patent publications. Further, phenol and naphthol cyan couplers are also preferred. A cyan coupler represented by a general formula (ADF) in JP-A No.10-333297, for example, is preferred. Other preferred cyan couplers than the above include pyrroloazole cyan couplers set forth in EP-A Nos.0488248 and 0491197A1; 2,5-diacylaminophenol couplers set forth in U.S. Pat. No. 5,888,716; and pyrazoloazole cyan couplers having an electron attractive group or a hydrogen bonding group at the 6-position set forth in U.S. Pat. Nos. 4,873,183 and 4,916,051. Particularly, pyrazoloazole cyan couplers having a carbamoyl group at the 6-position set forth in JP-A Nos.8-171185, 8-311360 and 8-339060 are also preferred.

Other usable cyan couplers include: diphenylimidazole cyan couplers set forth in JP-A No.2-33144; 3-hydroxypyridine cyan couplers set forth in EP No.0333185A2 (particularly preferred are a cyan coupler prepared by converting a four-equivalent coupler (42) into a two-equivalent one by introducing a chlorine-linked coupling-off group, and couplers (6) and (9) listed as specific examples); cyclic active methylene cyan couplers set forth in JP-A No.64-32260 (particularly preferred are coupler examples 3, 8, 34); pyrrolopyrazole cyan couplers set forth in EP-A No.0456226A1; and pyrroloimidazole cyan couplers set forth in EP-A No.0484909.

Among these cyan couplers, pyrroloazole cyan couplers represented by a general formula (I) in JP-A No.11-282138 are particularly preferred. The cyan couplers including specific examples thereof (1) to (47) are directly applied to the invention to constitute a part thereof, thus preferably incorporated herein.

The cyan coupler may be any coupler that forms the cyan dye and may include the aforementioned phenol cyan couplers, naphthol cyan couplers, heterocyclic couplers and the like. Above all, pyrroloazole couplers are preferably employed by the invention. Particularly preferred are couplers represented by the following general formulae (PTA-I) and (PTA-II).

General formula (PTA-I)

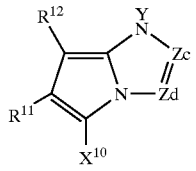

General formula (PTA-II)

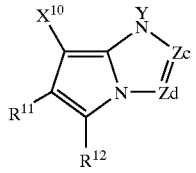

In the formulae (PTA-I) and (PTA-II), one of Zc and Zd represents —C($R^{13}$)═, and the other represents —N═; $R^{11}$ and $R^{12}$ each denote an electron attractive group having a Hammmett substituent constant σp of at least 0.2 and the sum of the σp values of $R^{11}$ and $R^{12}$ is at least 0.65; $R^{13}$ denotes a hydrogen atom or substituent; $X^{10}$ denotes a hydrogen atom or a group removable by coupling reaction with the oxidized product of an aromatic primary amine developing agent; Y denotes a hydrogen atom or a group removable by the color developing process; a group of $R^{11}$, $R^{12}$, $R^{13}$ or $X^{10}$ may be oxidized to become a divalent group which is combined with a polymer having two or more monomer units or with a macromolecular chain to form a homopolymer or copolymer.

Among these, a cyan coupler represented by the following general formula (PTA-III) is more preferred from the viewpoint of quick processability and color reproducibility of photosensitive material, and storage stability thereof in an unexposed state.

General formula (PTA-III)

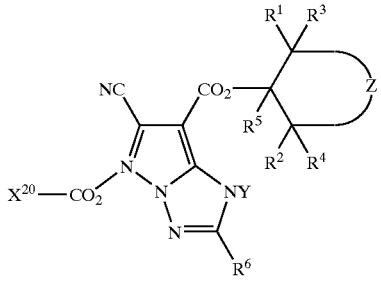

In the general formula (PTA-III), $R^1$ and $R^2$ each independently denote an alkyl group or aryl group; $R^3$, $R^4$ and $R^5$ each independently denote a hydrogen atom, alkyl group or aryl group; Z denotes a nonmetallic atom group necessary for forming a saturated ring; $R^6$ denotes a substituent; $X^{20}$ denotes a heterocyclic group, substituted amino group or aryl group; and Y denotes a hydrogen atom or a group removable by the color developing process.

In the general formula (PTA-III), the alkyl group represented by $R^1$ to $R^5$ is a linear, branched or cyclic alkyl group having 1 to 36 carbon atoms, preferably a linear, branched or cyclic alkyl group having 1 to 22 carbon atoms, or particularly preferably a linear or branched alkyl group having 1 to 8 carbon atoms. Examples of the preferred alkyl group include methyl, ethyl, n-propyl, isopropyl, tert-butyl, tert-amyl, tert-octyl, decyl, dodecyl, cetyl, stearyl, cyclohexyl and 2-ethylhexyl.

In the general formula (PTA-III), the aryl group represented by $R^1$ to $R^5$ is an aryl group having 6 to 20 carbon atoms, preferably an aryl group having 6 to 14 carbon atoms, or particularly preferably an aryl group having 6 to 10 carbon atoms. Examples of the preferred aryl group include phenyl, 1-naphthyl, 2-naphthyl and 2-phenanthryl.

In the general formula (PTA-III), the nonmetallic atom group necessary for forming the saturated ring, as represented by Z, is a nonmetallic atom group necessary for forming a 5- to 8-membered ring, which ring may optionally be substituted or optionally be saturated. The nonmetallic atom for forming the ring includes a carbon atom, oxygen atom, nitrogen atom and sulfur atom. Preferably, the ring is a 6-membered saturated carbon ring. Particularly preferred is a cyclohexane ring substituted in the 4-position by an alkyl group having 1 to 24 carbon atoms.

Examples of the substituents represented by $R^6$ in the general formula (PTA-III) include halogen atoms (such as fluorine atom, chlorine atom and bromine atom); aliphatic groups (such as linear or branched alkyl groups, aralkyl groups, alkenyl groups, alkynyl group, cycloalkyl groups and cycloalkenyl groups having 1 to 36 carbon atoms, specific examples of which include methyl, ethyl, propyl, isopropyl, tert-butyl, tridecyl, tert-amyl, tert-octyl, 2-methanesulfonyl ethyl, 3-(3-pentadecylphenoxy)propyl, 3-{4-{2-[4-(4-hydroxyphenylsulfonyl)phenoxy]dodecaneamide}phenyl}propyl, 2-ethoxytridecyl, trifluoromethyl, cyclopentyl and 3-(2,4-di-tert-amylphenoxypropyl; aryl groups (aryl groups having 6 to 36 carbon atoms, such as phenyl, 4-tert-butylphenyl, 2,4-di-tert-amylphenyl and 4-tetradecaneamidophenyl and 2-methoxyphenyl); heterocyclic groups (heterocyclic groups having 1 to 36 carbon atoms, such as 2-furyl, 2-thienyl, 2-pyrimidinyl and 2-benzothiazolyl); cyano groups; hydroxyl groups; nitro groups; carboxy groups; amino groups; alkoxy groups (such as linear, branched or cyclic alkoxy groups having 1 to 36 carbon atoms, examples of which groups include methoxy, ethoxy, butoxy, 2-methoxyethoxy, 2-dodecyloxyethoxy and 2-methanesulfonylethoxy); aryloxy groups (aryloxy groups having 6 to 36 carbon atoms, such as phenoxy, 2-methylphenoxy, 4-tert-butylphenoxy, 3-nitrophenoxy, 3-tert-butyloxycarbamoylphenoxy and 3-methoxycarbamoyl); acylamino groups (acylamino groups having 2 to 36 carbon atoms, such as acetamide, benzamide, tetradecaneamide, 2-(2,4-di-tert-amylphenoxy) butaneamide, 4-(3-tert-butyl-4-hydroxyphenoxy) butaneamide and 2-{4-(4-hydroxyphenylsulfonyl) phenoxy}decaneamide); alkylamino groups (alkylamino groups having 1 to 36 carbon atoms, such as methylamino, butylamino, dodecylamino, diethylamino and methylbutylamino); anilino groups (anilino groups having 6 to 36 carbon atoms, such as phenylamino, 2-chloroanilino, 2-chloro-5-tetradecaneaminoanilino, 2-chloro-5-dodecyloxy carbonylanilino, N-acetylanilino and 2-chloro-5-{2-(3-tert-butyl-4-hydroxyphenoxy) dodecaneamide}anilino); ureido groups (ureido groups having 2 to 36 carbon atoms, such as phenylureido, methylureido and N,N-dibutylureido); sulfamoylamino groups (sulfamoylamno groups having 1 to 36 carbon atoms, such as N,N-dipropylsulfamoylamino and N-methyl-N-decylsulfamoylamino); alkylthio groups (alkylthio groups having 1 to 36 carbon atoms, such as methylthio, octylthio, tetradecylthio, 2-phenoxyethyltio, 3-phenoxypropylthio and 3-(4-tert-butylphenoxy)propylthio); arylthio groups (arylthio groups having 6 to 36 carbon atoms, such as phenylthio, 2-butoxy-5-tert-octylphenylthio, 3-pentadecylphenylthio, 2-carboxyphenylthio and 4-tetradecaneamidophenylthio); alkoxycarbonylamino groups (alkoxycarbonylamino groups having 2 to 36 carbon atoms, such as methoxycarbonylamino and tetradecyloxycarbonylamino); sulfonamide groups (such as alkylsulfonamide or arylsulfonamide groups having 1 to 36 carbon atoms, examples of which gruops include methanesulfonamide, butanesulfonamide, octanesulfonamide, hexadecanesulfonamide, benzenesulfonamide, p-toluenesulfonamide, octadecanesulfonamide and 2-methoxy-5-tert-butylbenzenesulfonamide); carbamoyl groups (carbamoyl groups having 1 to 36 carbon atoms, such as N-ethylcarbamoyl, N,N-dibutylcarbamoyl, N-(2-dodecyloxyethyl)carbamoyl, N-methyl-N-dodecylcarbamoyl and N-{3-(2,4-di-tert-amylphenoxy) propyl}carbamoyl); sulfamoyl groups (sulfamoyl groups having 1 to 36 carbon atoms, such as N-ethylsulfamoyl, N,N-dipropylsulfamoyl, N-(2-dodecyloxyethyl) sulfamoyl, N-ethyl-N-dodecylsulfamoyl and N,N-diethylsulfamoyl); sulfonyl groups (such as alkylsulfonyl or arylsulfonyl groups having 1 to 36 carbon atoms, examples of which groups include methanesulfonyl, octanesulfonyl, benzenesulfonyl and toluenesulfonyl); alkoxycarbonyl groups (alkoxycarbonyl groups having 2 to 36 carbon atoms, such as methoxycarbonyl, butyloxycarbonyl, dodecyloxycarbonyl and octadecyloxycarbonyl); heterocyclicoxy groups (heterocyclicoxy groups having 1 to 36 carbon atoms, such as 1-phenyltetrazole-5-oxy and 2-tetrahydropyranyloxy); azo groups (such as phenylazo, 4-methoxyphenylazo, 4-pivaloylaminophenylazo and 2-hydroxy-4-propanoylphenylazo); acyloxy groups (acyloxy groups having 2 to 36 carbon atoms, such as acetoxy); carbamoyloxy groups (carbamoyloxy groups having 1 to 36 carbon atoms, such as N-methylcarbamoyloxy and N-phenylcarbamoyloxy); silyloxy groups (silyloxy groups having 3 to 36 carbon atoms, such as trimethylsilyloxy and dibutyl methylsilyloxy); aryloxycarbonylamino groups (aryloxycarbonylamino groups having 7 to 36 carbon atoms such as phenoxycarbonylamino); imido groups (imido groups having 4 to 36 carbon atoms, such as N-succinimido, N-phthalimido and 3-octadecenyl succinimido); heterocyclic thio groups (heterocyclic thio groups having 1 to 36 carbon atoms, such as 2-benzothiazolylthio, 2,4-diphenoxy-1,3,5-triazole-6-thio and 2-pyridylthio); sulfinyl groups (sulfinyl groups having 1 to 36 carbon atoms, such as dodecanesulfinyl, 3-pentadecylphenylsulfinyl and 3-phenoxypropylsulfinyl); alkylaryl or heterocyclic oxycarbonyl groups (such as methoxycarbonyl, butoxycarbonyl, dodecyloxycarbonyl, octadecyloxycarbonyl, phenyloxycarbonyl and 2-pentadecyloxycarbonyl); alkylaryl or heterocyclic oxycarbonylamino groups (such as methoxycarbonylamino, tetradecyloxycarbonylamino, phenoxycarbonylamino and 2,4-di-tert-butylphenoxycarbonylamino); sulfonamide groups (such as methanesulfonamide, hexadecanesulfonamide, benzenesulfonamide, p-toluenesulfonamide, octadecanesulfonamide and 2-methoxy-5-tert-butylbenzenesulfonamide); carbamoyl groups (such as N-ethylcarbamoyl, N,N-dibutylcarbamoyl, N-(2-dodecyloxyethyl)carbamoyl, N-methyl-N-dodecylcarbamoyl and N-[3-(2,4-di-tert-amylphenoxy) propyl]carbamoyl); sulfamoyl groups (such as N-ethylsulfamoyl, N,N-dipropylsulfamoyl, N-(2-dodecyloxyethyl) sulfamoyl, N-ethyl-N-dodecylsulfamoyl and N,N-diethylsulfamoyl); phosphonyl groups (such as phenoxyphosphonyl, octyloxyphosphonyl and phenylphosphonyl); sulfamide groups (such as dipropylsulfamoylamino); imido groups (such as N-succinimido, hydantoinyl, N-phthalimido and 3-octadecenylsuccinimido); azolyl groups (such as imidazolyl, pyrazolyl, 3-chloro-pyrazole-1-yl and triazolyl); hydroxy groups; cyano groups; carboxy groups; nitro groups; sulfo groups; unsubstituted amino groups and the like.

Examples of a preferred $R^6$ include alkyl groups, aryl groups, heterocyclic groups, cyano groups, nitro groups, acylamino groups, arylamino groups, ureido groups, sulfamoylamino groups, alkylthio groups, arylthio groups, alkoxycarbonylamino groups, sulfonamide groups, carbamoyl groups, sulfamoyl groups, sulfonyl groups, alkoxycarbonyl groups, aryloxycarbonyl groups, heterocyclicoxy groups, acyloxy groups, carbamoyloxy groups, aryloxycarbonylamino groups, imido groups, heterocyclicthio groups, sulfinyl groups, phosphonyl groups, acyl groups and azolyl groups.

An alkyl group or aryl group is more preferred and still more preferred is an aryl group substituted at least in the p-position by an alkyl group.

$X^{20}$ denotes a heterocyclic ring, substituted amino group or aryl group. A preferred heterocyclic ring includes 5- to 8-membered heterocyclic rings of nitrogen atoms, oxygen atoms or sulfur atoms having 1 to 36 carbon atoms. More preferredly, the heterocyclic ring is a 5- or 6-membered ring bonded together by nitrogen atoms with a 6-membered ring being particularly preferred.

Specific examples of the preferred heterocyclic ring include imidazole, pyrazole, triazole, lactase compounds, piperidine, pyridine, pyrrole, morphine, pyrazolidine, thiazolidine, pyrazoline and the like. Among these, morpholine and pyperidine are preferred.

Examples of the substituent of the substituted amino group include an aliphatic group, aryl group and heterocyclic group. Examples of the usable aliphatic group include the aforementioned substituents represented by $R^6$ which may further be substituted with a cyano group, alkoxy group (such as methoxy), alkoxycarbonyl group (such as ethoxycarbonyl), chloro, hydroxyl group or carboxyl group. As to the subsituted amino group, a disubstituted amino group is more preferred than a monosubstituted amino group. A preferred aryl group may have 6 to 36 corbon atoms and more preferred aryl group may have a monocyclic structure. Specific examples of the preferred aryl group include phenyl, 4-tert-butylphenyl, 2-methylphenyl, 2,4,6-trimethylphenyl, 2-methoxyphenyl, 4-methoxyphenyl, 2,6-dichlorophenyl, 2-chlorophenyl, 2,4-dichlorophenyl and the like.

Preferred examples of the substituted amino group represented by $X^{20}$ are shown as below.

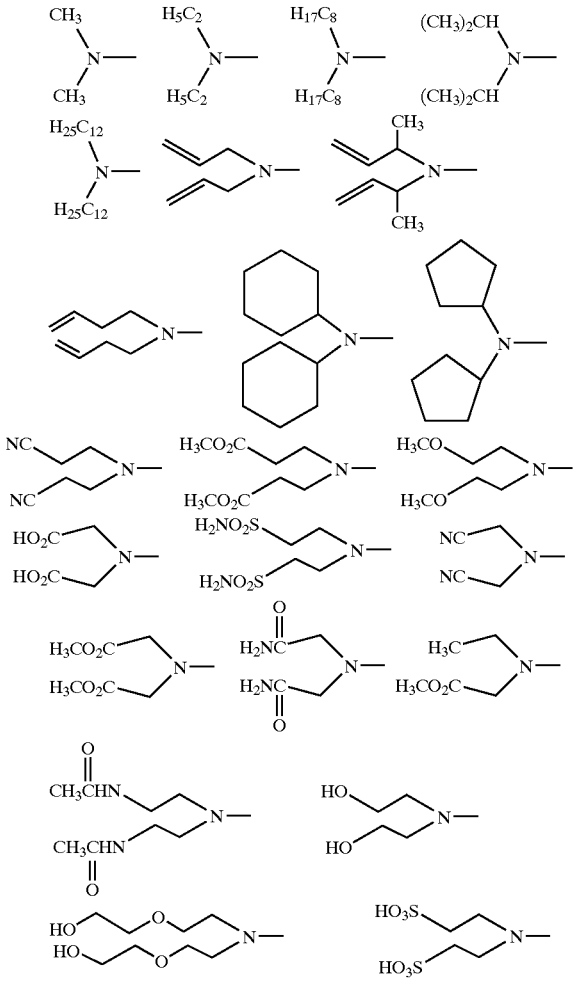

-continued

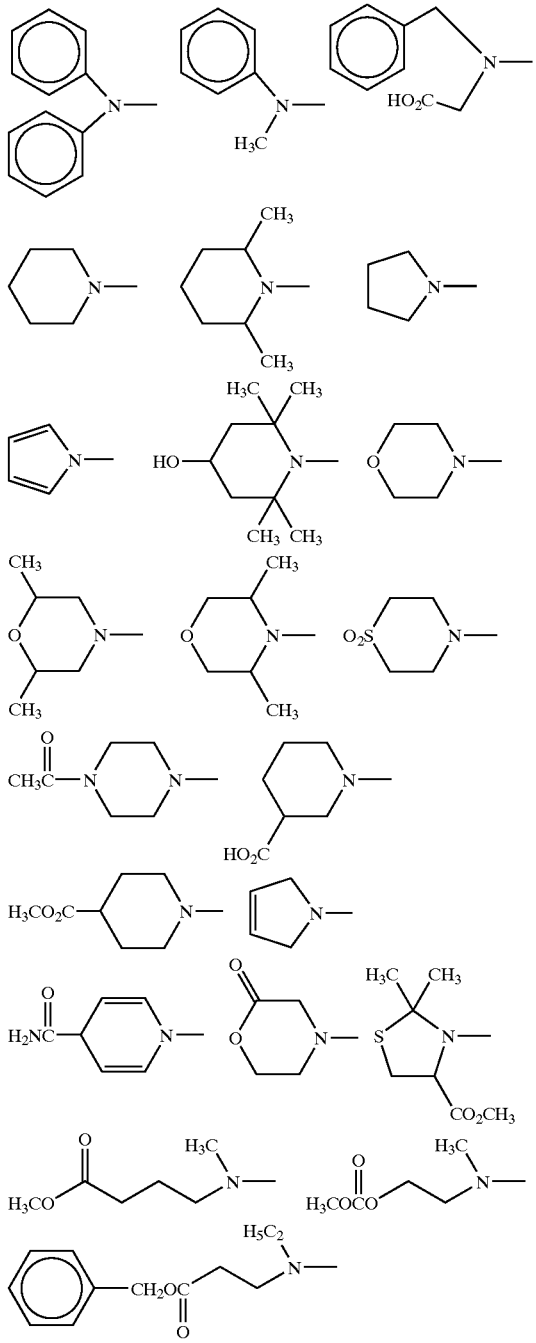

Y denotes a hydrogen atom or a group removable by the color developing process. Examples of the substituent represented by Y include those groups removable under an alkaline condition as disclosed in JP-A No.61-228444, and coupling-off groups removable by the coupling reaction with the main component of the developing agent as disclosed in JP-A No.56-133734. However, hydrogen atom is more preferred.

The coupler represented by the general formula (PTA-III) may contain a coupler residue represented by the general formula (PTA-III) at $R^6$, so as to form a polymer having two or more monomer units, or may contain a macromolecular chain at $R^6$, so as to form a homopolymer or copolymer. The homopolymer or copolymer containing the macromolecular chain is typically exemplified by an addition polymerized ethylenically unsaturated compound or a copolymer thereof, which contains a coupler residue represented by the general formula (PTA-III). In this case, the polymer may contain one or more types of cyan color forming repeat units having the coupler residue represented by the general formula (PTA-III). On the other hand, the copolymer may contain, as a copolymer component, one or more types of non-color-forming ethylene monomers which are not coupled with an oxidization product of aromatic primary amine developing agent such as an acrylic ester, methacrylic ester and maleic ester. A mixing amount of the compound represented by the general formula (PTA-III) may preferably be in the range of 0.01 to 1.0 mol, more preferably of 0.12 to 1.0 mol, or particularly preferably of 0.2 to 0.5 mol per mol of photosensitive silver halide in the same layer.

While specific examples of the couplers represented by the general formulae (PTA-I) and (PTA-II) are shown as below, the invention is not limited to these.

PTA-(1)

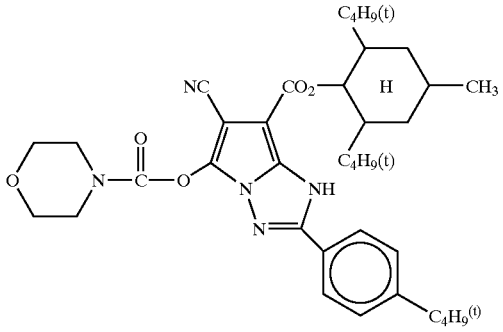

PTA-(2)

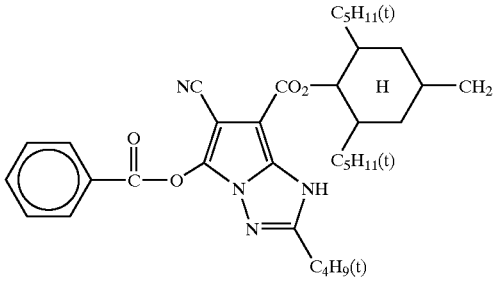

PTA-(3)

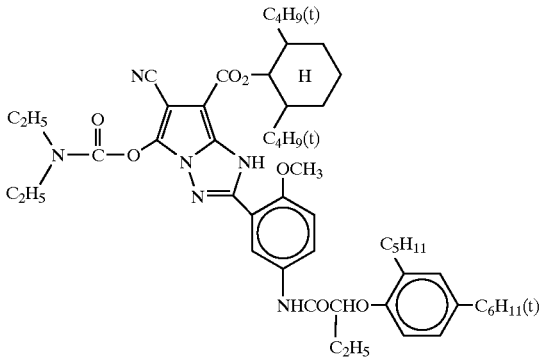

PTA-(4)

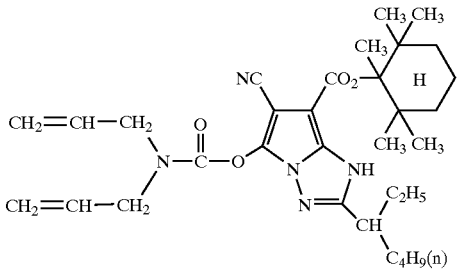

PTA-(5)

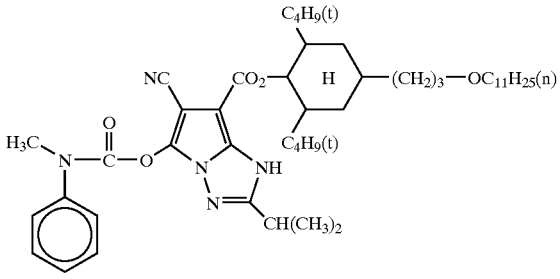

PTA-(6)

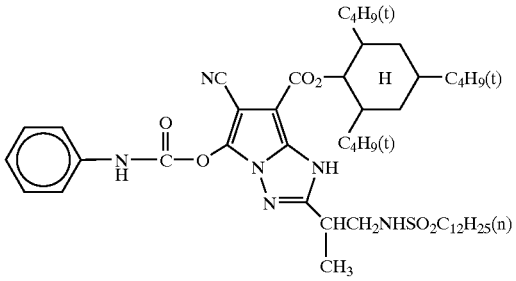

PTA-(7)

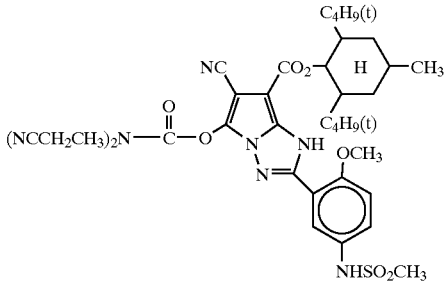

PTA-(8)

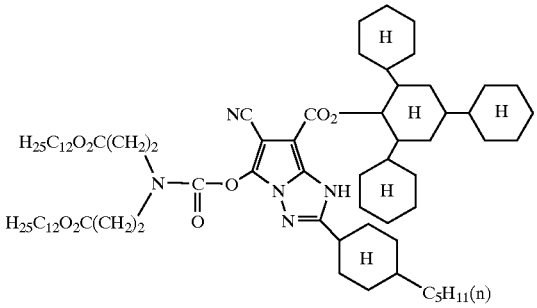

-continued
PTA-(9)
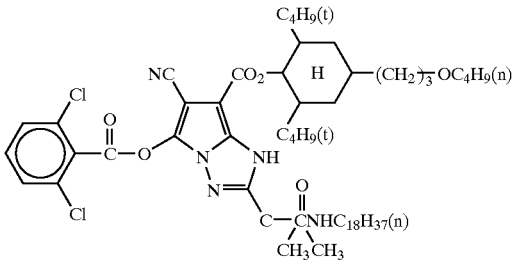
PTA-(10)
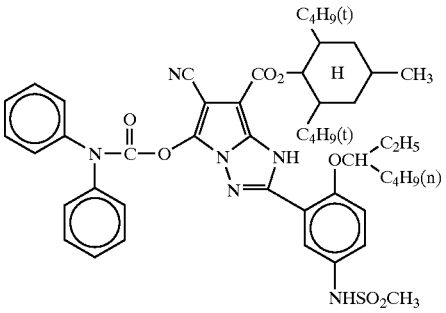
PTA-(11)
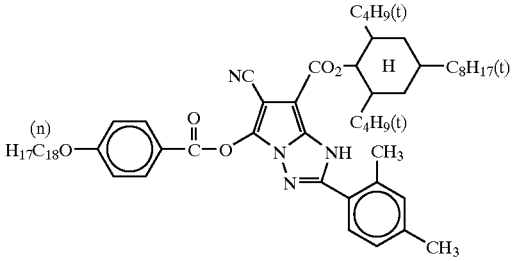
PTA-(12)
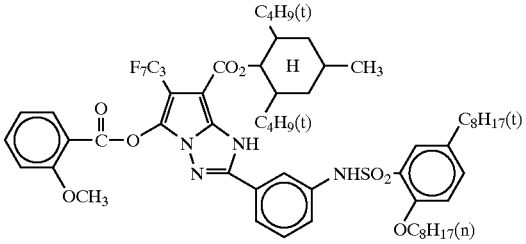
PTA-(13)
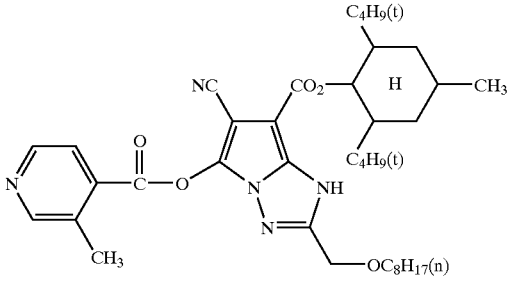
PTA-(14)
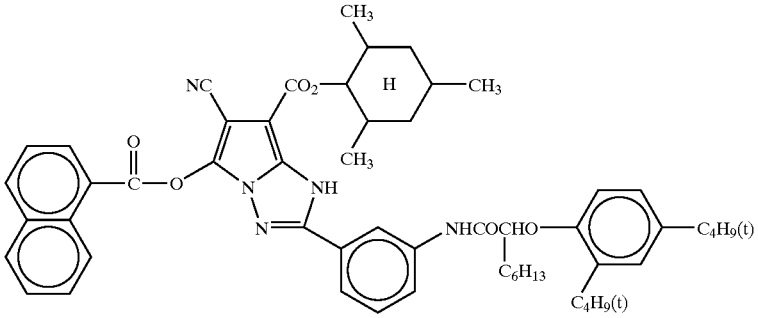
PTA-(15)
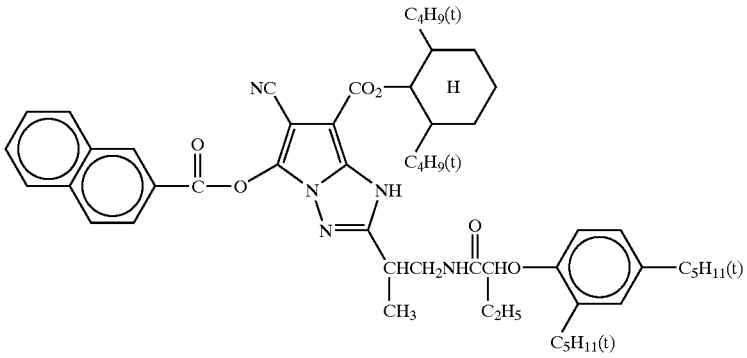

-continued
PTA-(16)
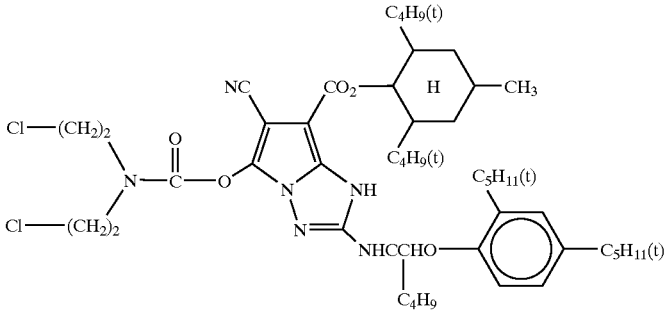
PTA-(17)
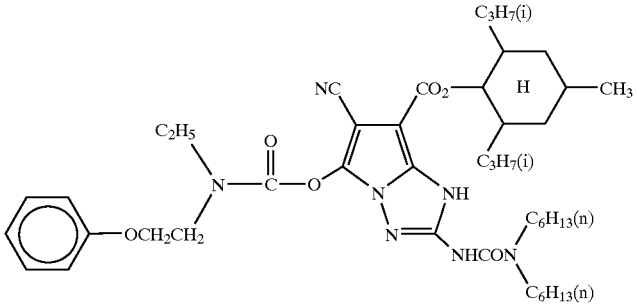
PTA-(18)
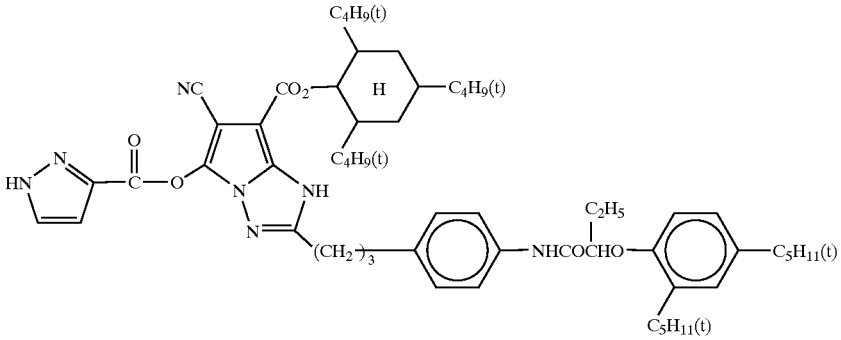
PTA-(19)
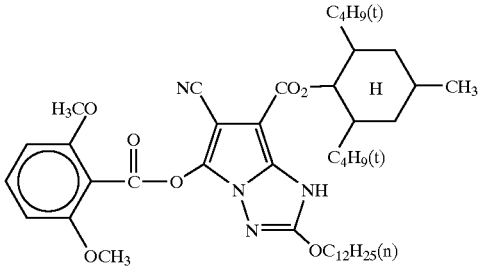
PTA-(20)
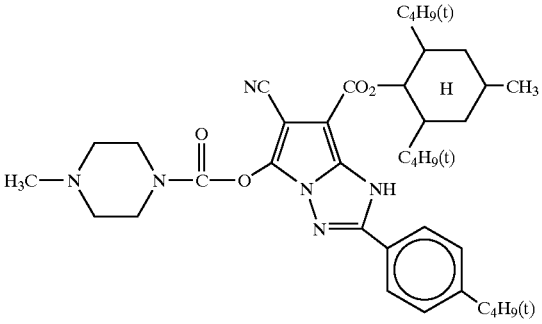
PTA-(21)
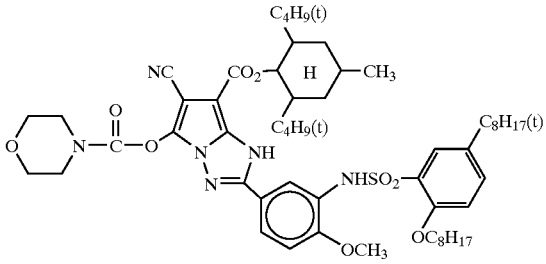
PTA-(22)
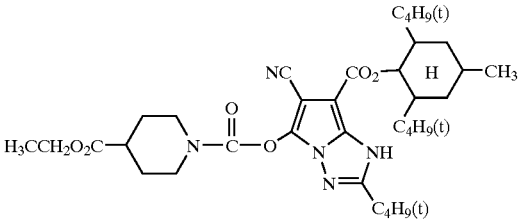

-continued
PTA-(23)
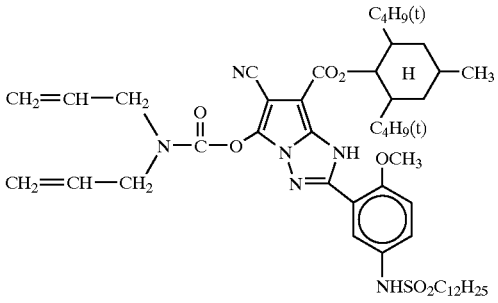
PTA-(24)
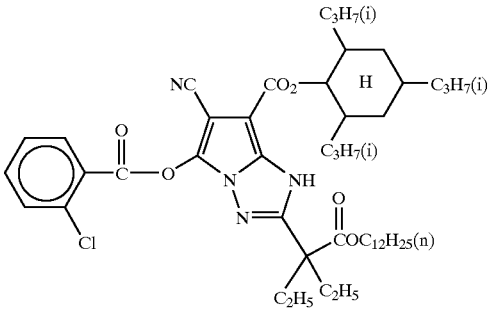
PTA-(25)
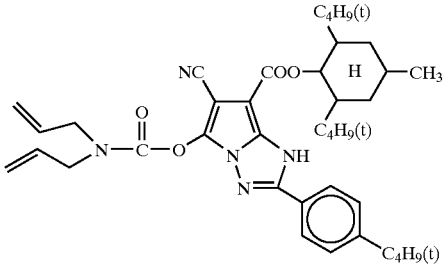
PTA-(26)
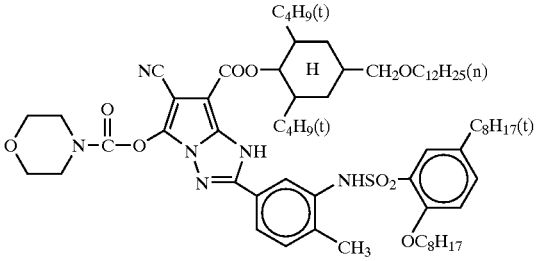
PTA-(27)
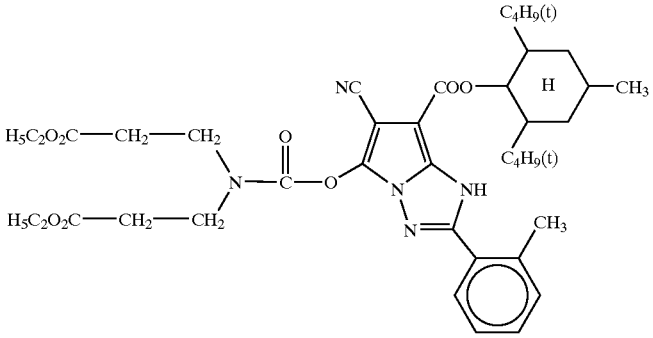
PTA-(28)
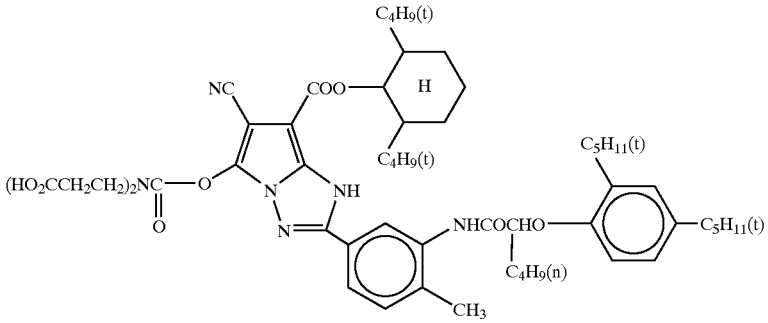
PTA-(29)
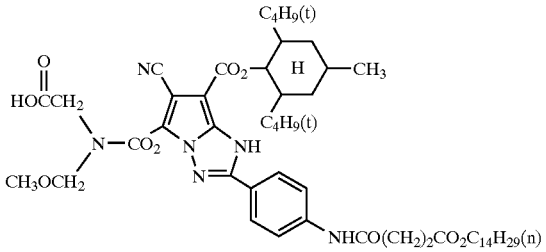
PTA-(30)
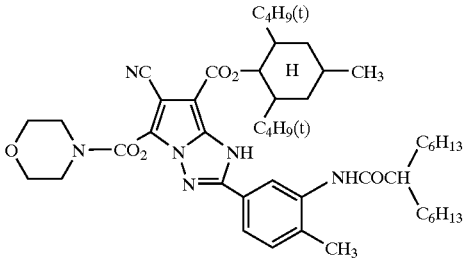

-continued

PTA-(31)

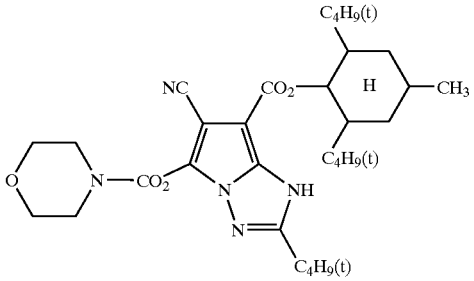

PTA-(32)

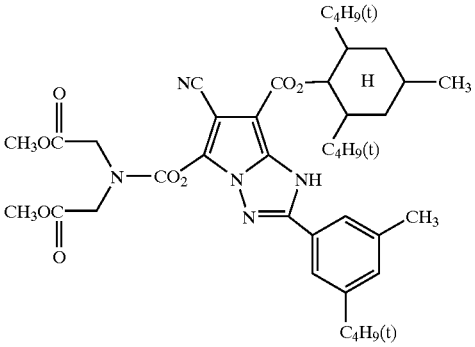

PTA-(33)

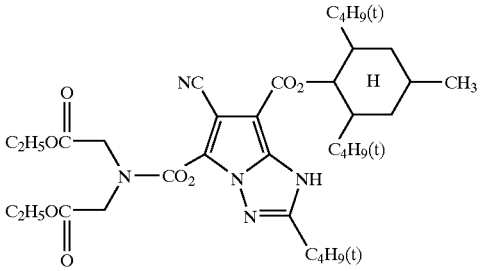

PTA-(34)

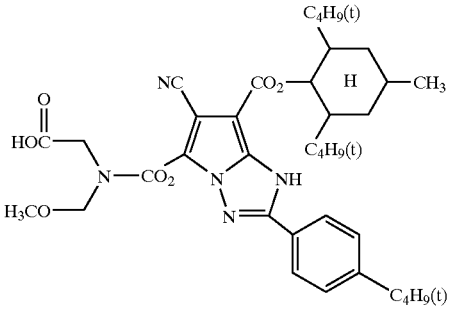

PTA-(35)

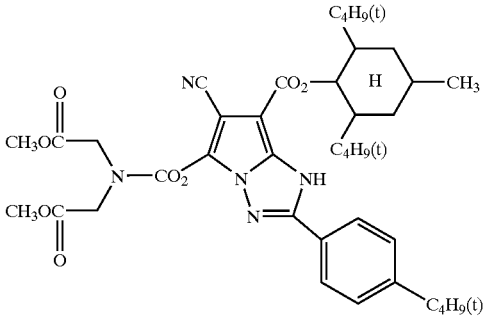

PTA-(36)

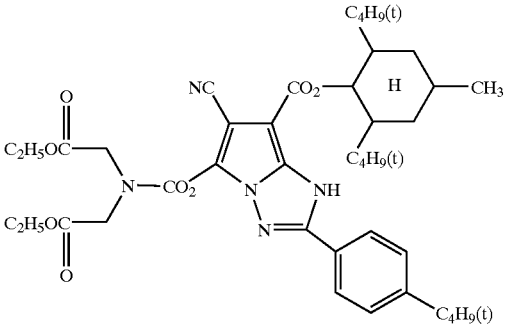

PTA-(37)

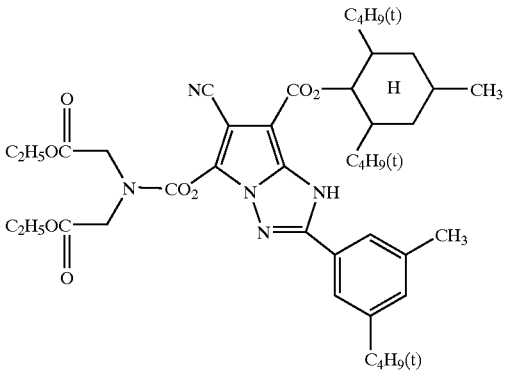

The compounds represented by the general formula (PTA-III) may be synthesized by any of the known methods such as disclosed in JP-A Nos.5-255333, 5-202004, 7-48376 and 8-110623.

The compounds represented by the above general formula (IA) may also be particularly preferredly used as the cyan couplers. The details of the compounds represented by the general formula (IA), the preferred coupling-off groups, and the specific examples of the compounds represented by the general formula (IA) are the same as those of the image forming method according to the first embodiment of the invention.

A usable magenta-dye forming coupler (sometimes referred to simply as "magenta coupler") includes 5-pyrazolone magenta couplers and pyrazoloazole magenta couplers as set forth in the known documents listed in the above Table 1. Above all, pyrazolotriazole couplers having a secondary or tertiary alkyl group directly linked to the 2-, 3- or 6-position of the pyrazolotriazole ring as disclosed in JP-A No.61-65245; pyrazoloazole couplers containing a sulfonamide group in the molecule as disclosed in JP-A No.61-65246; pyrazoloazole couplers having an alkoxyphenyl-sulfonamide ballast group as disclosed in JP-A No.61-147254; and pyrazoloazole couplers having an alkoxy or aryloxy group at the 6-position as disclosed in EP Nos.226,849A and 294,785A may be preferredly used in the light of hue, image stability, coloration and the like. Particularly preferred as the magenta coupler is a pyrazoloazole coupler represented by a general formula (M-I) in JP-A No.8-122984, paragraphs to of which are directly applied to the invention and thus, incorporated herein. In addition, pyrazoloazole couplers having sterically hindering groups at both the 3- and 6-positions as disclosed in EP Nos.854384 and 884640 are also preferred.

Examples of a usable yellow-dye forming coupler (sometimes referred to simply as "yellow coupler") include those compounds listed in the above Table 1 and those mentioned in the image forming method according to the first embodiment hereof.

The couplers may preferably be impregnated into a loadable latex polymer in the presence (or absence) of any one of high-boiling point organic solvents listed in the above Table 1 (see, for example, U.S. Pat. No. 4,203,716) or otherwise dissolved with a polymer insoluble to water but soluble to an organic solvent and then emulsified and dispersed in a hydrophilic colloidal aqueous solution. Preferred polymers insoluble to water but soluble to organic solvent include those set forth in the description of the image forming method according to the first embodiment hereof.

Although gelatin may be advantageously used as a binder or protective colloid for the photosensitive material, other hydrophilic colloids may be used alone or in combination with gelatin. Preferred gelatin contains impurities of heavy metals, such as iron, copper, zinc and manganese, in concentrations of 5 ppm or less, or more preferably of 3 ppm or less. The photosensitive material may preferably contain calcium in concentrations of 20 mg/m$^2$ or less, more preferably of 10 mg/m$^2$ or less, or most preferably of 5 mg/m$^2$ or less.

The total amount of gelatin present in the photographic layers of the photosensitive material may preferably be in the range of 3 g/m$^2$ to 6 g/m$^2$, or more preferably of 3 g/m$^2$ to 5 g/m$^2$. In order to ensure the promoted development, bleaching and fixing and the reduction of residual color even in an ultra-quick processing, the overall photographic layers may preferably have a thickness of 3 $\mu$m to 7.5 $\mu$m, or more preferably of 3 $\mu$m to 6.5 $\mu$m. The dry film thickness of the photographic layers can be determined based on difference between a pre-peel film thickness and a post-peel film thickness, or from a sectional image of the photographic layers taken by an optical microscope or electron microscope. According to the invention, the swell film thickness may preferably be in the range of 8 $\mu$m to 19 $\mu$m, or more preferably of 9 $\mu$m to 18 $\mu$m in the light of increasing both the development speed and the drying speed. The swell film thickness can be determined as follows. A dry photosensitive material is immersed in an aqueous solution at 35° C. for moisture equilibrium. In this state, the film thickness is measured by a depression bar type recorder. The total amount of silver present in the photographic layers of the photosensitive material may preferably be 0.55 g/m$^2$ or less, more preferably 0.47 g/m$^2$ or less, still more preferably in the range of 0.2 g/m$^2$ to 0.45 g/m$^2$, and most preferably of 0.2 g/m$^2$ to 0.40 g/m$^2$.

Hereinbelow, description is made on the development processing solutions (the color-developing solution, bleach-fixing solutions and rinsing fluid) used in the image forming method according to the tenth embodiment.

Now, the color-developing solution is described.

The color-developing solution contains a color developing agent, a preferred example of which is the known aromatic primary amine color developing agent or particularly P-phenylenediamine derivatives. Although typical examples of the p-phenylenediamine derivatives are listed as below, the invention is not limited to these.

1) N,N-diethyl-p-phenylenediamine
2) 4-amino-3-methyl-N,N-diethylaniline,
3) 4-amino-N-(β-hydroxyethyl)-N-methylaniline
4) 4-amino-N-ethyl-N-(β-hydroxyethyl)aniline
5) 4-amino-3-methyl-N-ethyl-N-(β-hydroxyethyl) aniline
6) 4-amino-3-methyl-N-ethyl-N-(3-hydroxypropyl)aniline
7) 4-amino-3-methyl-N-ethyl-N-(4-hydroxybutyl)aniline
8) 4-amino-3-methyl-N-ethyl-N-(β-methane sulfonamidoethyl)aniline
9) 4-amino-N,N-diethyl-3-(β-hydroxyethyl)aniline
10) 4-amino-3-methyl-N-ethyl-N-(β-methoxyethyl)aniline
11) 4-amino-3-methyl-N-(β-ethoxyethyl)-N-ethylaniline
12) 4-amino-3-methyl-N-(3-carbamoylpropyl-N-n-propyl-aniline
13) 4-amino-N-(4-carbamoylbutyl-N-n-propyl-3-methylaniline
14) N-(4-amino-3-methylphenyl)-3-hydroxypyrrolidine
15) N-(4-amino-3-methylphenyl)-3-(hydroxymethyl) pyrrolidine
16) N-(4-amino-3-methylphenyl)-3-pyrrolidinecarboxamide Out of the above p-phenylenediamine derivatives, particularly preferred compounds are Nos.5, 6, 7, 8 and 12, of which the compound Nos. 5 and 8 are more preferred. As solid materials, these p-phenylenediamine derivatives are normally in the form of salts, such as sulfate, hydrochloride, sulfite, naphthalene disulfonate, p-toluene sulfonate and the like.

The above aromatic primary amine developing agent is added to constitute 2 to 200 millimole, preferably 6 to 100 millimole, or more preferably 10 to 40 millimole per liter of developing solution.

Next, the bleach-fixing solution (including the bleaching solution and the fixing solution) is described.

The bleach-fixing solution of the invention may employ any of the known bleaching agents for bleaching. Examples of particularly preferred bleaching agent include organic complex salts of iron (III) such as iron aminopolycarboxylate complexes; organic acids such as citric acid, tartaric acid, malic acid and the like; persulfate; peroxide and the like.

Among these, the organic complex salts of iron (III) are particularly preferred from the viewpoint of high-speed processing and prevention of environmental contamination. Examples of a useful aminopolycarboxylic acid and aminopolycarboxylates for forming the iron (III) aminopolycarboxylate complexes include biodegradable compounds such as ethylenediamine succinate (SS compound), N-(2-carboxylateethyl)-L-aspartic acid, β-alaninediaceatic acid and methyliminodiacetic acid; ethylenediaminetetraacetic acid; diethylenetriaminepentaacetic acid; 1,3-diaminopropanetetraacetic acid; propylenediaminetetraacetic acid; nitrilotriacetaic acid; cyclohexanediaminetetraacetic acid; iminodiacetic acid; glycol ether diaminetetraacetate; and compounds represented by general formulae (I) and (II) in EP No.0789275. These compounds may be in the form of any one of sodium salt, potassium salt, lithium salt and ammonium salt. Among these compounds, ethylenediamine succinate (SS compound), N-(2-carboxylateethyl)-L-aspartic acid, β-alaninediaceatic acid, ethylenediaminetetraacetic acid, 1,3-diaminopropanetetraacetic acid, methyliminodiacetic acid are more preferred because iron (III) complex salts thereof present good photographic performances. These ferric ion complex salts may be used in the form of complex salt. Otherwise, the ferric salt, such as ferric sulfate, ferric chloride, ferric nitrate, ferric ammonium sulfate or ferric phosphate, may be chelated with a chelating agent such as aminopolycarboxylic acid to form ferric ion complex salt in the solution. The chelating agent may be used in an excess of that required for forming the ferric ion complex salt. Among the ferric complexes, iron aminopolycarboxylate complexes are more preferred and may be used in an amount of 0.01 to 1.0 mol/l, preferably of 0.05 to 0.50 mol/l, more preferably of 0.10 to 0.50 mol/l, or still more preferably of 0.15 to 0.40 mol/l.

The bleach-fixing solution may employ any of the known fixing agents, which include water-soluble silver halide-dissolving agents including thiosulfates such as sodium thiosulfate and ammonium thiosulfate; thiocyanates such as sodium thiocyanate and ammonium thiocyanate; thioether compounds such as ethylenebisthioglycolic acid and 3,6-dithia-1,8-octanediol; and thioureas. These compounds may be used alone or in combination of plural types. Alternatively, a special bleach-fixing solution including any one of the fixing agents disclosed in JP-A No.55-155354 in combination with a large amount of halide such as potassium iodide may also be used. According to the invention, thiosulfate or ammonium thiosulfate is particularly preferred. The amount of fixing agent may preferably be in the range of 0.3 to 2 mol/l or more preferably of 0.5 t0 1.0 mol/l.

Next, the rinsing fluid (including the rinsing water and/or the stabilizing solution) is described.

In order to prevent the growth of bacteria or the adherence of the resultant suspended matters to the photosensitive material, the rinsing fluid may contain an isothiazolone compound or thiabendazole disclosed in JP-A No.57-8542; chlorine-based fungicides such as chlorinated sodium isocyanate as disclosed in JP-A No.61-120145; benzotriazoles and copper ions as disclosed in JP-A No.61-267761; and other microbiocides set forth in "Chemistry of Biocides and Fungicides" by Hiroshi, Horiguchi, published by Sankyo Press (1986), in "Microorganism Sterilization, Disinfection and Fungicide Techniques" published by the Japanese Health Technical Society(1982), and in "A Dictionary of Biocides and Fungicides" published by the Japanese Biocide and Fungicide Society (1986). Furthermore, the method for reducing calcium or magnesium content as disclosed in JP-A No.62-288838 may be used as an extremely effective solution to the above problem.

To the rinsing fluid, there may be added aldehydes such as formaldehyde, acetaldehyde, pyruvic aldehyde; methylol compounds and hexamethylenetetramine as disclosed in U.S. Pat. No. 4786583; hexahydrotriazines as disclosed in JP-A No.2-153348; formaldehyde/bisulfite adducts as disclosed in U.S. Pat. No. 4921779; and azolylmethylamines as disclosed in forfeited application Nos. 504609 and 519190. These compounds are effective to inhibit color fade or stain production by inactivating the remaining magenta coupler.

The rinsing fluid (particularly rinsing water) may further contain a surfactant as a hydro-extracting agent, or a chelating agent as a water softener typically exemplified by EDTA. The rinsing fluid (particularly the stabilizing solution) may further contain a compound functioning to stabilize image. Examples of such a compound include aldehyde compounds typically exemplified by formalin; a buffering agent for controlling a suitable film pH for dye stabilization; and ammonium compounds.

EXAMPLES

Hereinafter, the invention will be described in greater details with reference to examples thereof. It is noted, however, that the examples do not limit the invention.

Examples for First Embodiment of Image Forming Method

Now, description will be made on the examples of the first embodiment of the image forming method.

Example 1

Preparation of Blue-Sensitive Emulsion A

A 10% NaCl solution (46.3 ml) was added to 1.06 l of deionized distilled water containing 5.7% by mass of deionized gelatin, followed by addition of 46.4 ml of $H_2SO_4$ (1N) and further addition of 0.012 g of a compound represented by X. The solution temperature was adjusted to 60° C., and 0.1 mol of silver nitrate and 0.1 mol of NaCl were immediately added to a reaction vessel with vigorous stirring over a period of 10 minutes. Subsequently, 1.5 mol of silver nitrate and 1.5 mol of an NaCl solution were added over a period of 60 minutes by a flow rate accelerating method such that the final adding rate was 4 times as high as the initial adding rate. Then, 0.2 mol % of silver nitrate and 0.2 mol % of an NaCl solution were added at a fixed adding rate over a period of 6 minutes. At this time, $K_3IrCl_5$ ($H_2O$) was added to the NaCl solution in an amount of $5\times10^{-7}$ mol based on the total mol of silver, so as to dope aquated iridium into the silver halide grains.

Further added to the resultant mixture were 0.2 mol of silver nitrate, 0.18 mol of NaCl and 0.02 mol of a KBr solution over a period of 6 minutes. At this time, $K_4Ru(CN)_6$ and $K_4Fe(CN)_6$ in a respective amount equivalent to $0.5\times10^{-5}$ mol based on the total mol of silver were dissolved in the aqueous halogen solution, so as to be added to the silver halide grains.

Furthermore, in the final stage of grain growth, an aqueous KI solution in an amount equivalent to 0.001 mol based on the total mol of silver was added to the reaction vessel over a period of 1 minute. The addition was started when the whole grain formation was accomplished 93%.

Thereafter, a compound Y as a precipitating agent was added at 40° C. with pH adjusted approximately to 3.5 and then, desalting and water rinsing were carried out.

Compound X

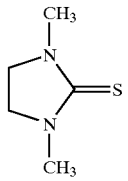

Compound Y

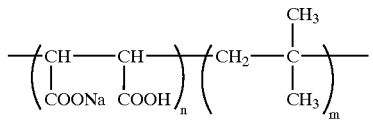

n and m are an integer.

Deionized gelatin, an aqueous NaCl solution and an aqueous NaOH solution were added to the emulsion thus desalted and water-rinsed. The emulsion temperature was elevated to 50° C., and adjusted to a pAg of 7.6 and a pH of 5.6.

Thus was obtained gelatin containing cubic silver halide grains having a halogen composition of 98.9 mol % of silver nitrate, 1 mol % of silver bromide and 0.1 mol % of silver iodide, and having an average side length of 0.70 μm and a side length variation coefficient of 8%.

To the resultant emulsion, there were added a spectral sensitizing dye-1 and a spectral sensitizing dye-2 in a respective amount of $2.5\times10^{-4}$ mol per mol of Ag and $2.0\times10^{-4}$ mol per mol of Ag with the emulsion temperature maintained at 60° C. There was further added $1\times10^{-5}$ mol, per mol of Ag, of thiosulfonate compound-1 and a fine grain emulsion of 90 mol % of silver bromide and 10 mol % of silver chloride, having an average size of 0.05 μm and doped with iridium hexachloride, and then, ripening was carried out for 10 minutes. The resultant emulsion was further admixed with fine grains of 40 mol % of silver bromide and 60 mol % of silver chloride, having an average size of 0.05 μm, and subjected to ripening for 10 minutes. The fine grains were dissolved so that the content percentage of silver bromide in the cubic host grains was increased to 1.3 mol %. On the other hand, iridium hexachloride wad doped in an amount of $1\times10^{-7}$ mol per mol of Ag.

Subsequently, sodium thiosulfate and a gold sensitizer-1 were added in a respective amount of $1\times10^{-5}$ mol and $2\times10^{-5}$ mol, per mol of Ag. Immediately thereafter, the temperature was elevated to 60° C., followed by ripening for 40 minutes. Then, the emulsion temperature was lowered to 50° C., immediately followed by adding a mercapto compound-1 and a mercapto compound-2 in a respective amount of $6\times10^{-4}$ mol per mol of Ag. After 10-minute ripening, an aqueous KBr solution was added in an amount to constitute 0.008 mol based on silver and then ripening was carried out for 10 minutes followed by cooling. The resultant product was stored. In this manner, an emulsion of higher sensitivity A-1 was prepared.

Cubic grains having an average side length of 0.55 μm and a side length variation coefficient of 9% were prepared in the same manner as the above except for the preparation of the above emulsion and the temperature control during the grain growth. The temperature during the grain growth was maintained at 55° C.

Spectral sensitization and chemical sensitization were carried out using sensitizers in amounts based on a correction (side length ratio 0.7/0.55=1.27) for agreement of a surface area ratio. Thus was prepared an emulsion of lower sensitivity A-2.

Spectral Sensitizing Dye-1

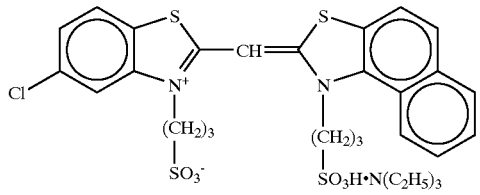

Spectral Sensitizing Dye-2

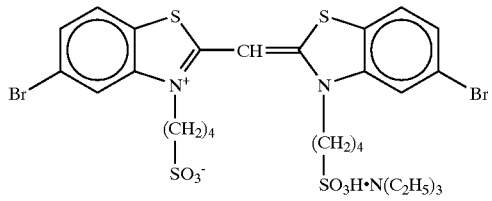

-continued

Thiosulfate Compound-1

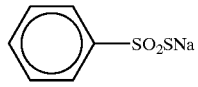

Mercapto Compound-1

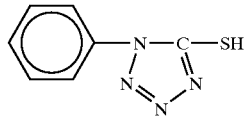

Mercapto Compound-2

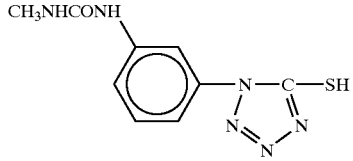

Gold Sensitizer-1

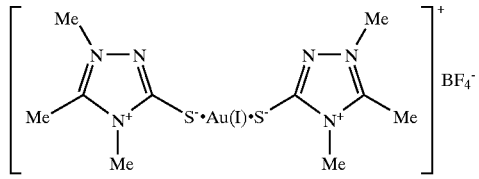

Preparation of Blue-Sensitive Emulsion B

Of the conditions for preparation of the emulsion A-1, the temperature during the grain formation was changed. That is, the grain formation was carried out at 68° C., thereby obtaining grains having an average side length of 0.85 μm. The side length variation coefficient was 12%. In the final stage of grain formation, C1 ions were doped in place of iodine ions. At completion of the grain formation, therefore, a halogen composition comprised 99 mol % of silver chloride and 1 mol % of silver bromide.

The spectral sensitizing dye-1 and dye-2 were added in respective amounts 1.25 times those used in the preparation of the emulsion A-1. The thiosulfonate compound-1 was used in the same amount.

The chemical sensitization process was changed as follows.

A fine grain emulsion of 90 mol % of silver bromide and 10 mol % of silver chloride, having an average size of 0.05 μm and doped with iridium hexachloride, was added and ripening was carried out for 10 minutes. The resultant emulsion was further admixed with fine grains having an average size of 0.05 μm and including 40 mol % of silver bromide and 60 mol % of silver chloride and subjected to ripening for 10 minutes. The fine grains were dissolved so that the content percentage of silver bromide in the cubic host grains was increased to 2.0 mol %. On the other hand, iridium hexachloride wad doped in an amount of $2\times10^{-7}$ mol per mol of Ag.

Subsequently, sodium thiosulfate was added in an amount of $1\times10^{-5}$ mol per mol of Ag. The gold sensitizer was not added. Immediately thereafter, the temperature was elevated to 55° C., followed by ripening for 70 minutes. Then, the temperature was lowered to 50° C., immediately followed by adding the mercapto compound-1 and compound-2 in a respective amount of$4\times10^{-4}$ mol per mol of Ag. After 10-minute ripening, an aqueous KBr solution was added in an amount to constitute 0.010 mol based on silver and then, ripening was carried out for 10 minutes followed by cooling. The resultant product was stored.

Thus was obtained an emulsion of higher sensitivity B-1.

Grains having an average side length of 0.68 μm and a side length variation coefficient of 12% were formed in the same manner as the preparation of the emulsion B-1, except in that the temperature during the grain formation was lowered.

The spectral sensitizer and the chemical sensitizer were used in amounts 1.25 times those of the emulsion B-1 in consideration of the surface area ratio.

In this manner, an emulsion of lower sensitivity B-2 was prepared.

Preparation of Green-Sensitive Emulsion C

An emulsion of higher sensitivity C-1 and an emulsion of lower sensitivity C-2 were prepared under the same conditions as in the preparation of the emulsions A-1 and A-2, except that the temperatures during the preparation of the emulsion A-1 and the grain formation were lowered and that the types of sensitizing dyes were changed as below.

Sensitizing Dye D

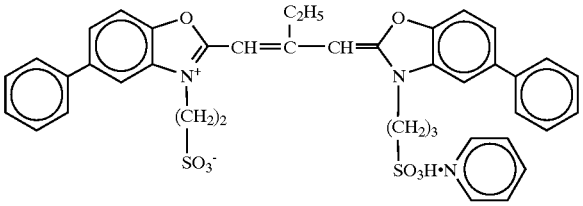

Sensitizing Dye E

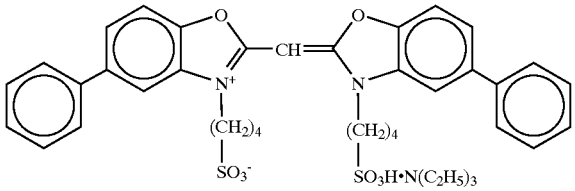

The grains in the emulsion of higher sensitivity had an average side length of 0.40 μm, whereas the grains in the emulsion of lower sensitivity had an average side length of 0.30 μm. Both the grains in the emulsions of higher and lower sensitivities had a side length variation coefficient of 8%.

The sensitizing dye D was added to the emulsion of greater grain size in an amount of $3.0\times10^{-4}$ mol per mol of silver halide, and to the emulsion of smaller grain size in an amount of $3.6\times10^{-4}$ mol per mol of silver halide. The sensitizing dye E was added to the emulsion of greater grain size in an amount of $4.0\times10^{-5}$ mol per mol of silver halide, and to the emulsion of smaller grain size in an amount of $7.0\times10^{-5}$ mol per mol of silver halide.

Preparation of Green-Sensitive Emulsion D

An emulsion of higher sensitivity D-1 and an emulsion of lower sensitivity D-2 were prepared under the same conditions as in the preparation of the emulsions B-1 and B-2, except that the temperatures during the preparation of the emulsion B-1 and the grain formation were lowered and that the types of sensitizing dyes were changed as below.

The grains in the emulsion of higher sensitivity had an average side length of 0.50 μm, whereas the grains in the emulsion of lower sensitivity had an average side length of 0.40 μm. Both the grains in the emulsions of higher and lower sensitivities had a side length variation coefficient of 10%.

The sensitizing dye D was added to the emulsion of greater grain size in an amount of $4.0\times10^{-4}$ mol per mol of silver halide, and to the emulsion of smaller grain size in an amount of $4.5\times10^{-4}$ mol per mol of silver halide. The sensitizing dye E was added to the emulsion of greater grain size in an amount of $5.0\times10^{-5}$ mol per mol of silver halide, and to the emulsion of smaller grain size in an amount of $8.8\times10^{-5}$ mol per mol of silver halide.

Preparation of Red-Sensitive Emulsion E

An emulsion of higher sensitivity E-1 and an emulsion of lower sensitivity E-2 were prepared under the same conditions as in the preparation of the emulsions A-1 and A-2, except that the temperatures during the preparation of the emulsion A-1 and the grain formation were lowered and that the types of sensitizing dyes were changed as below.

Sensitizing Dye G

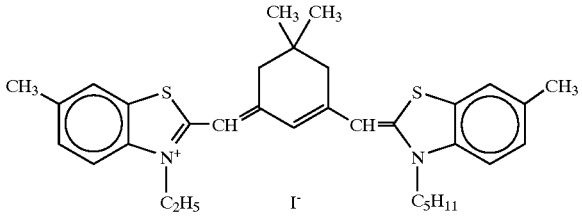

Sensitizing Dye H

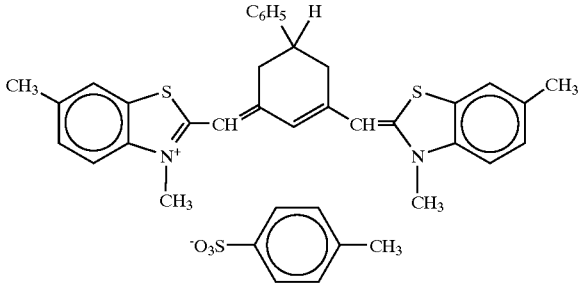

The grains in the emulsion of higher sensitivity had an average side length of 0.38 μm, whereas the grains in the emulsion of lower sensitivity had an average side length of 0.32 μm. The grains in the emulsions of higher and lower sensitivities had side length variation coefficients of 9% and 10%, respectively.

The sensitizing dyes G and H were each added to the emulsion of greater grain size in an amount of 8.0×10−5 mol per mol of silver halide, and to the emulsion of smaller grain size in an amount of $10.7\times10^{-5}$ mol per mol of silver halide.

Furthermore, the following compound I was added to a red-sensitive emulsion layer in an amount of $3.0\times10^{-3}$ mol per mol of silver halide.

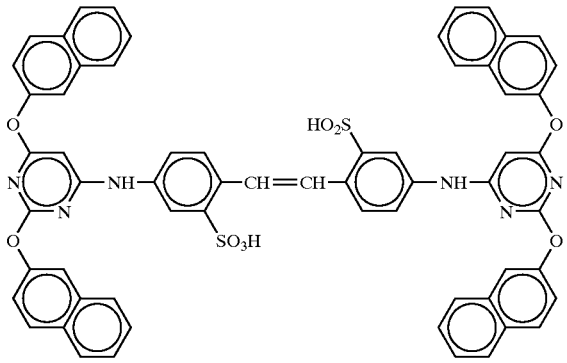

Preparation of Red-Sensitive Emulsion F

An emulsion of higher sensitivity F-1 and an emulsion of lower sensitivity F-2 were prepared under the same conditions as in the preparation of the emulsions B-1 and B-2, except that the temperatures during the preparation of the emulsion B-1 and the grain formation were lowered and that the types of sensitizing dyes were changed as below.

The grains in the emulsion of higher sensitivity had an average side length of 0.57 $\mu$m, whereas the grains in the emulsion of lower sensitivity had an average side length of 0.43 $\mu$m. The grains in the emulsions of higher and lower sensitivities had side length variation coefficients of 9% and 10%, respectively.

The sensitizing dyes G and H were each added to the emulsion of greater grain size in an amount of $1.0\times10^{-4}$ mol per mol of silver halide, and to the emulsion of smaller grain size in an amount of $1.34\times10^{-4}$ mol per mol of silver halide.

Furthermore, the compound I was added to a red-sensitive emulsion layer in an amount of $3.0\times10^{-3}$ mol per mol of silver halide.

Preparation of Coating Solution for First Layer

Into 21 g of a solvent (Solv-1) and 80 ml of ethyl acetate, dissolved were 57 g of yellow coupler (ExY), 7 g of color image stabilizer (Cpd-1), 4 g of color image stabilizer (Cpd-2), 7 g of color image stabilizer (Cpd-3) and 2 g of color image stabilizer (Cpd-8). The resultant solution was emulsified/dispersed in 220 g of a 23.5% by mass aqueous solution of gelatin containing 4 g of sodium dodecylbenzenesulfonate using a high-speed stirrer/emulsifier (Dissolver) followed by adding water thereto. Thus was obtained 900 g of emulsified dispersion A.

On the other hand, the emulsified dispersion A and the emulsions A-1 and A-2 were mixed and dissolved to give a first layer coating solution of the following compositions. A coating amount of the emulsion is given on the basis of the amount of silver applied.

Preparation of Coating Solutions for Second to Seventh Layers

Coating solutions for second to seventh layers were prepared in the same manner as that of the first layer coating solution. There was used 1-oxy-3,5-dichloro-s-triazine sodium salt (H-1), (H-2) or (H-3) as a gelatin hardening agent for each layer. To the individual layers, Ab-1, Ab-2, Ab-3 and Ab-4 were added in respective total amounts of 15.0 mg/m$^2$, 60.0 mg/m$^2$, 5.0 mg/m$^2$ and 10.0 mg/m$^2$.

(H-1) Film hardening Agent

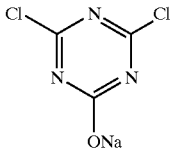

(used at an amount of 1.4% by mass based on gelatin)

(H-2) Film hardening Agent

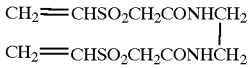

(H-3) Film hardening Agent

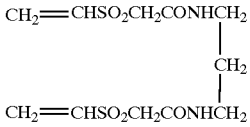

-continued (Ab-1) Preservative

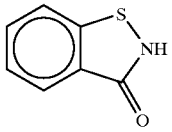

(Ab-2) Preservative

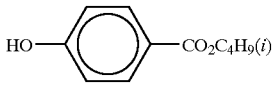

(Ab-3) Preservative

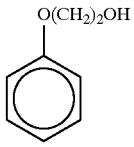

(Ab-4) Preservative

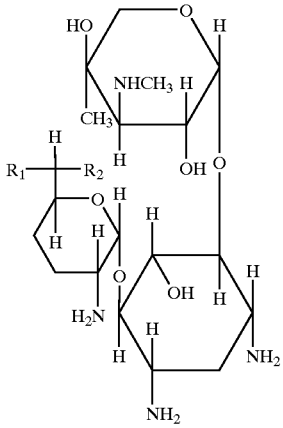

| | $R_1$ | $R_2$ |
|---|---|---|
| a | $CH_3$ | $NHCH_3$ |
| b | $CH_3$ | $NH_2$ |
| c | H | $NH_2$ |
| d | H | $NHCH_3$ |

Mixing ratio of a,b,c, and d is 1:1:1:1 (molar ratio)

Furthermore, 1-(3-methylureidophenyl)-5-mercaptotetrazole was added to the second, fourth, sixth and seventh layers in a respective amount of 0.2 mg/m$^2$, 0.2 mg/m$^2$, 0.6 mg/m$^2$ and 0.1 mg/m$^2$.

On the other hand, 4-hydroxy-6-methyl-1,3,3a,7-tetrazaindene was added to the blue-sensitive emulsion layer and the green-sensitive emulsion layer in a respective amount of $1\times10^{-4}$ mol and $2\times10^{-4}$ mol per mol of silver halide.

A copolymer latex of methacrylic acid and butyl acrylate (ratio by mass: 1:1, average molecular weight: 200000 to 400000) was added to the red-sensitive emulsion layer in an amount of 0.05 g/m$^2$.

In addition, disodium catechol-3,5-disulfonate was added to the second, fourth and sixth layers in a respective amount of 6 mg/m$^2$, 6 mg/m$^2$ and 18 mg/m$^2$.

For the purpose of irradiation inhibition, the following dyes (numbers in parentheses indicate the coating amount) were added.

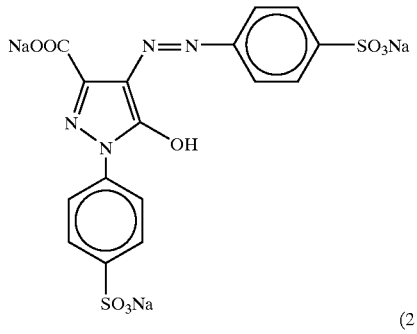

(2 mg/m$^2$)

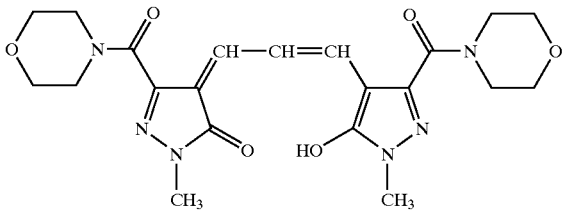

(2 mg/m$^2$)

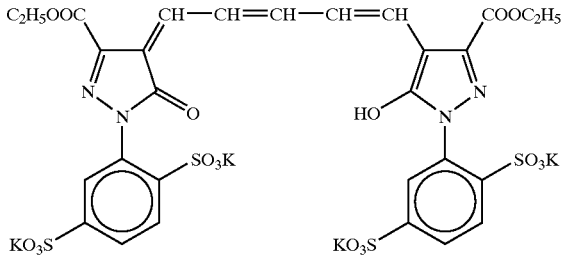

(3 mg/m$^2$)

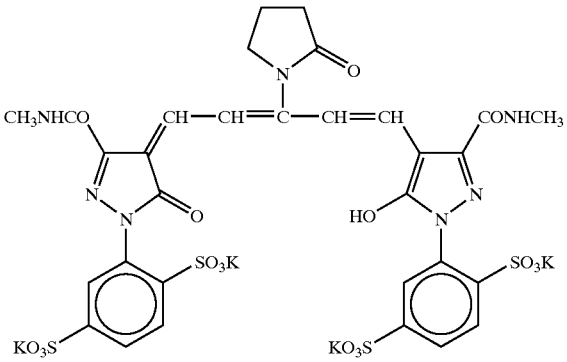

(7 mg/m$^2$)

Preparation of Sample 101

(Layer Structure)

The structure of each layer is set forth as below. The numbers in parentheses indicate coating amount (g/m$^2$). The coating amount of silver halide is represented based on the amount of silver. As to the sample, the total coating amount of gelatin, the total coating amount of silver, and the ratio of dissolved components in non-volatile oil versus gelatin in each of the fifth and third layers are listed in Table 2.

Support

Paper Laminated with Polyethylene Resin

A polyethylene resin on the first-layer side contained a white pigment ($TiO_2$: 16% by mass, ZnO: 4% by mass); a fluorescent brightener (4,4'-bis(5-methylbenzoxazolyl) stilbene: 0.03% by mass); and a bluing dye (ultramarine blue: 0.33% by mass). The amount of polyethylene resin was 29.2 g/m$^2$.

| | |
|---|---|
| First Layer (Blue-Sensitive Emulsion Layer) | |
| Silver chloride emulsion A (cubes sensitized with gold and sulfur; emulsion mixture containing the large grain emulsion A-1 and the small grain emulsion A-2 in a ratio of 3:7 (in terms of a molar ratio of silver); an average grain size of 0.15 μm, | 0.20 |
| Gelatin | 1.31 |
| Yellow coupler (Y-1) | 0.42 |
| Color image stabilizer (ST-23) | 0.48 |
| Tributyl citrate | 0.48 |
| Color image stabilizer (ST-24) | 0.12 |
| Color image stabilizer (ST-16) | 0.01 |
| Piperidinohexose reducton | 0.002 |
| Surfactant (SF-1) | 0.02 |
| Potassium chloride | 0.02 |
| Dye-1 | 0.01 |
| Second Layer (Color Mixing Inhibiting Layer) | |
| Gelatin | 0.75 |
| Color mixing inhibitor (ST-4) | 0.10 |
| Solvent (diundecyl phosphate) | 0.11 |
| Surfactant (SF-1) | 0.008 |
| Third Layer (Green-Sensitive Emulsion Layer) | |
| Silver chlorobromide emulsion C (cubes sensitized with gold and sulfur; emulsion mixture containing the large grain emulsion C-1 and the small grain emulsion C-2 in a ratio of 1:3 (in terms of a molar ratio of silver); an average grain size of 0.25 μm, | 0.10 |
| Gelatin | 1.19 |
| Magenta coupler (Ma-48) | 0.21 |
| Oleyl alcohol | 0.22 |
| Solvent (diundecyl phosphate) | 0.11 |
| Color image stabilizer (St-21) | 0.04 |
| Color image stabilizer (St-22) | 0.28 |
| Dye-2 | 0.007 |
| Surfactant (SF-1) | 0.023 |
| Potassium Chloride | 0.02 |
| Sodium phenyl mercaptotetrazole | 0.0007 |
| Fourth Layer (Color Mixing Inhibiting Layer) | |
| Gelatin | 0.75 |
| Color mixing inhibitor (ST-4) | 0.11 |
| Solvent (diundecyl phosphate) | 0.20 |
| Acrylamide/t-butylacrylamide sulfonate copolymer | 0.05 |
| Bis-vinylsulfonylmethane | 0.14 |
| Catechol disulfonate | 0.03 |
| Fifth Layer (Red-Sensitive Emulsion Layer) | |
| Silver chlorobromide emulsion E (cubes sensitized with gold and sulfur; emulsion mixture containing the large grain emulsion E-1 and the small grain emulsion E-2 in a ratio of 5:5 (in terms of a molar ratio of silver); an average grain size of 0.19 μm, | 0.19 |
| Gelatin | 1.36 |
| Cyan coupler (IC-23) | 0.23 |
| Cyan coupler (IC-24) | 0.02 |
| UV absorber (UV-2) | 0.36 |
| Dibutyl cebacate | 0.44 |
| Solvent (tris(2-ethylhexyl)phosphate) | 0.15 |
| Dye-3 | 0.02 |
| Sodium phenyl mercaptotetrazole | 0.0005 |
| Surfactant (SF-1) | 0.05 |
| Sixth Layer (UV Absorbing Layer) | |
| Gelatin | 0.82 |
| UV absorber (UV-1) | 0.035 |
| UV absorber (UV-2) | 0.20 |
| Solvent (tris(2-ethylhexyl)phosphate) | 0.08 |
| Surfactant (SF-1) | 0.01 |
| Seventh Layer (Protective Layer) | |
| Gelatin | 0.64 |
| Ludox AM ™ (colloidal silica) | 0.16 |
| Polydimethylsiloxane (DC200 ™) | 0.02 |
| Surfactant (SF-2) | 0.003 |

-continued

| | |
|---|---|
| Surfactant (SF-13) | 0.003 |
| Surfactant (Tergitol 15-S-5 ™) | 0.002 |
| Surfactant (SF-1) | 0.008 |
| Surfactant (Aerosol OT ™) | 0.003 |

The sample 101 was prepared in this manner.

Preparation of Sample 001

A sample 001 was prepared in the same manner as the sample 101 except for chaning the composition of the third and fifth layers as below. As to this sample, the total coating amount of gelatin, the total coating amount of silver, and the ratio of dissolved components in non-volatile oil versus gelatin in each of the fifth and third layers are listed in Table 2.

| | |
|---|---|
| Third Layer (Green-Sensitive Emulsion Layer) | |
| Silver chlorobromide emulsion C (cubes sensitized with gold and sulfur; emulsion mixture containing the large grain emulsion C-1 and the small grain emulsion C-2 in a ratio of 1:3 (in terms of a molar ratio of silver); an average grain size of 0.25 μm, | 1.10 |
| Gelatin | |
| Magenta coupler (Ma-7) | 0.27 |
| Solvent (dibutyl phosphate) | 0.08 |
| Solvent (diundecyl phosphate) | 0.03 |
| Color image stabilizer (ST-8) | 0.02 |
| Color image stabilizer (ST-21) | 0.17 |
| Color image stabilizer (ST-22) | 0.53 |
| Dye-2 | 0.007 |
| Surfactant (SF-1) | 0.023 |
| Potassium chloride | 0.02 |
| Sodium phenyl mercaptotetrazole | 0.0007 |
| Fifth Layer (Red-Sensitive Emulsion Layer) | |
| Silver chlorobromide emulsion E (cubes sensitized with gold and sulfur; emulsion mixture containing the large grain emulsion E-1 and the small grain emulsion E-2 in a ratio of 5:5 (in terms of a molar ratio of silver); an average grain size of 0.19 μm, | 0.18 |
| Gelatin | 1.20 |
| Cyan coupler (C-1) | 0.37 |
| UV absorber (UV-2) | 0.24 |
| Solvent (dibutyl phosphate) | 0.36 |
| Solvent (2(2-butoxyethoxy) ethyl acetate | 0.03 |
| Dye-3 | 0.02 |
| Sodium phenyl mercaptotetrazole | 0.0005 |
| Surfactant (SF-1) | 0.05 |

Preparation of Sample 102

A sample 102 was prepared in the same manner as the sample 101, except for changing the composition of the third and fifth layers as below. As to this sample, the total coating amount of gelatin, the total coating amount of silver, and the ratio of dissolved components in non-volatile oil versus gelatin in each of the fifth and third layers are listed in Table 2.

| | |
|---|---|
| Third Layer (Green-Sensitive Emulsion Layer) | |
| Silver chlorobromide emulsion C (cubes sensitized with gold and sulfur; emulsion mixture containing the large grain emulsion C-1 and the small grain emulsion C-2 in a ratio of 1:3 (in terms of a molar ratio of silver); an average grain size of 0.25 μm, | 0.08 |
| Gelatin | 1.25 |
| Magenta coupler (Ma-48) | 0.21 |
| Oleyl alcohol | 0.33 |

-continued

| | |
|---|---|
| Color image stabilizer (ST-21) | 0.04 |
| Color image stabilizer (ST-22) | 0.28 |
| Dye-2 | 0.007 |
| Surfactant (SF-1) | 0.035 |
| Potassium chloride | 0.02 |
| Sodium phenyl mercaptotetrazole | 0.0007 |
| Fifth Layer (Red-Sensitive Emulsion Layer) | |
| Silver chlorobromide emulsion E (cubes sensitized with gold and sulfur; emulsion mixture containing the large grain emulsion E-1 and the small grain emulsion E-2 in a ratio of 5:5 (in terms of a molar ratio of silver); an average grain size of 0.19 μm, | 0.14 |
| Gelatin | 1.36 |
| Cyan coupler (IC-23) | 0.30 |
| UV absorber (UV-2) | 0.36 |
| Dibutyl cebacate | 0.44 |
| Solvent (tris(2-ethylhexyl)phosphate) | 0.15 |
| Dye-3 | 0.02 |
| Sodium phenyl mercaptotetrazole | 0.0005 |
| Surfactant (SF-1) | 0.05 |
| Preparation of Sample 103 | |

A sample 103 was prepared in the same manner as the sample 102, except for changing the composition of the third layer as below. As to this sample, the total coating amount of gelatin, the total coating amount of silver, and the ratio of dissolved components in non-volatile oil versus gelatin in each of the fifth and third layers are listed in Table 2.

| | |
|---|---|
| Third Layer (Green-Sensitive Emulsion Layer) | |
| Silver chlorobromide emulsion C (cubes sensitized with gold and sulfur; emulsion mixture containing the large grain emulsion C-1 and the small grain emulsion C-2 in a ratio of 1:3 (in terms of a molar ratio of silver); an average grain size of 0.25 μm, | 0.08 |
| Gelatin | 1.25 |
| Magenta coupler (ExM) | 0.15 |
| Oleyl alcohol | 0.55 |
| Color image stabilizer (ST-21) | 0.04 |
| Color image stabilizer (ST-22) | 0.28 |
| Dye-2 | 0.007 |
| Surfactant (SF-1) | 0.040 |
| Potassium chloride | 0.02 |
| Sodium phenyl mercaptotetrazole | 0.0007 |

Preparation of Samples 101-a to 101-d, 103-a

Samples 101-a to 101-d and 103-a were prepared based on the sample 101 and 103. The ratio of dissolved components in non-volatile oil versus gelatin was changed by altering the coating amounts of gelatin and dissolved components in the non-volatile oil as listed in Table 2. Where the amount of dissolved components in non-volatile oil was changed, the other additives than the coupler were increased in the same proportions.

The compounds used in the samples are shown as below.
Y-1
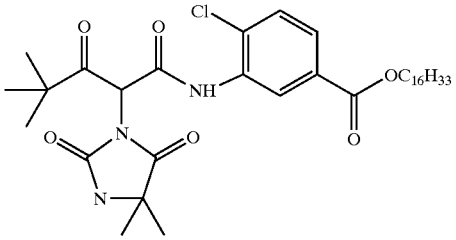
C-1
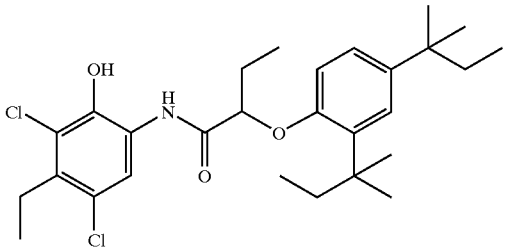
(EXM) Magenta Coupler
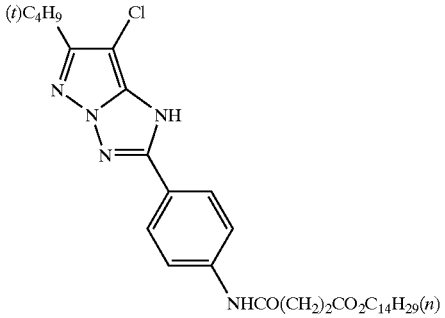
and
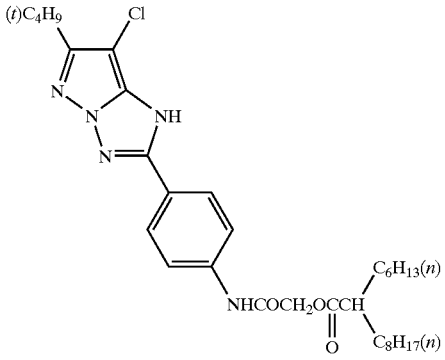
50:50 mixture (molar ratio)
ST-4
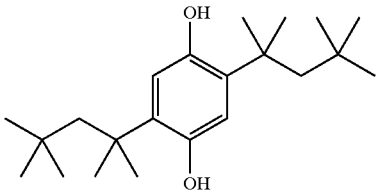
ST-8
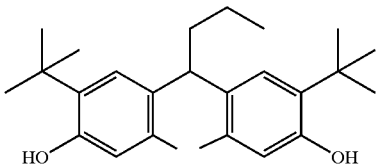
-continued
ST-16
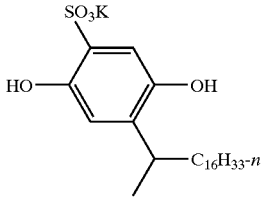
ST-21
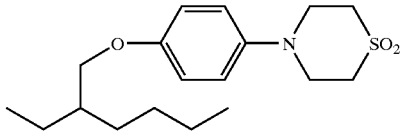
ST-22
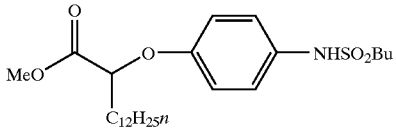
ST-23
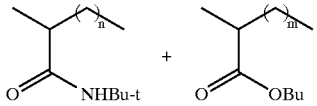
n:m 1:1 mw = 75–100,000
ST-24
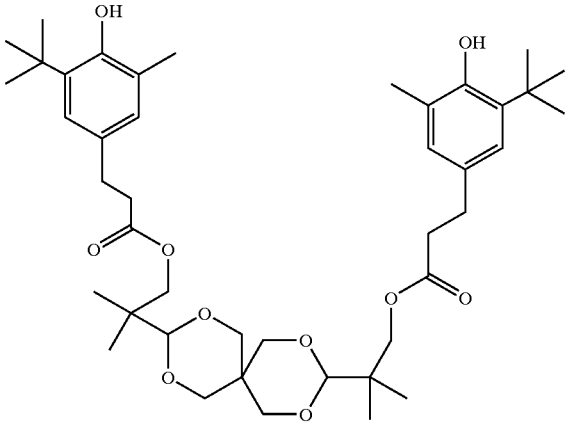
UV-1
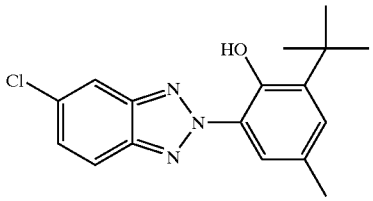
UV-2
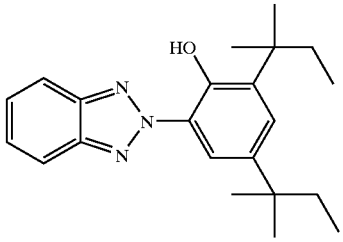

-continued

SF-1

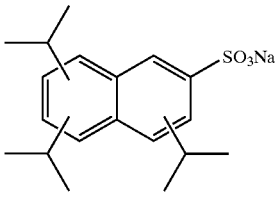

SF-2

$CF\bullet(CF_2)_7\bullet SO_3Na$

SF-13

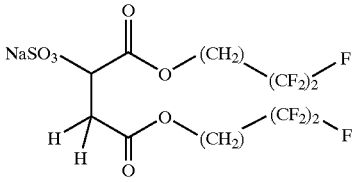

Dye-1

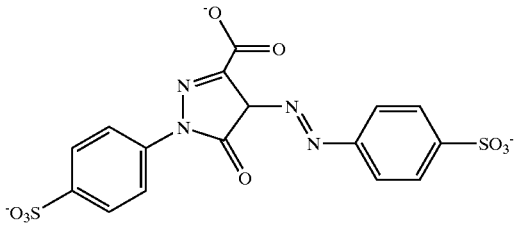

Dye-2

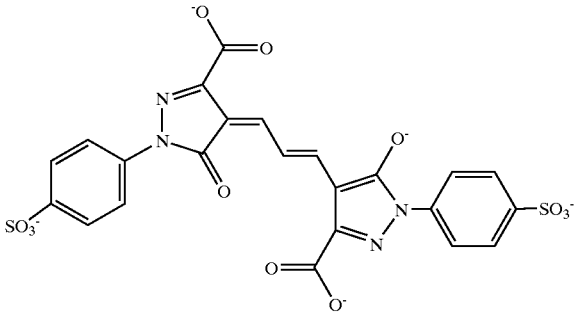

Dye-3

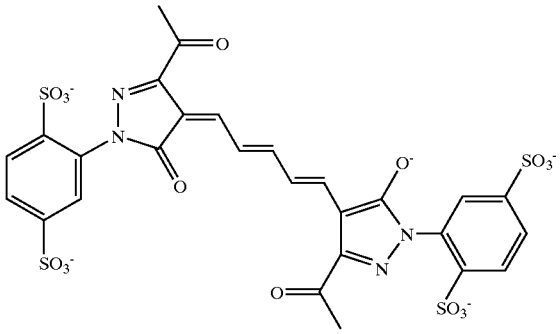

Evaluation (1)

The samples thus prepared were subjected to exposure and development processes in the following manner and evaluated for color bleeding. The results are listed in Table 2.

In the final processing bath of the development process, each of the samples was rinsed with a rinsing fluid (Rinse (4)) wherein the content of calcium was adjusted to each value listed in Table 2 in the following manner. The rinsing fluid used well water, which was softened by being passed through columns charged with an H-type strongly acidic cation exchange resin (DIAION SK-1B commercially available from Mitsubishi Chemical Corporation) and an OH-type strongly basic anion exchange resin (DIAION SA-10A commercially available from Mitsubishi Chemical Corporation) and which was adjusted for the content of calcium by addition of calcium chloride ($CaCl_2.2H_2O$).

| Water Properties | Before ion exchange | After ion exchange |
|---|---|---|
| pH | 6.8 | 6.8 |
| Calcium ions | 38 mg/L | 0.4 mg/L |
| Magnesium ions | 11 mg/L | 0.1 mg/L |
| Chlorine ions | 32 mg/L | 3.3 mg/L |
| Residue product | 185 mg/L | 20.4 mg/L |

Exposure/Development Processes

The samples thus prepared were allowed to stand at 25° C.-55% RH for 10 days and then shaped into a roll having a width of 127 mm. A laboratory processor, a MINI-LABO PRINTER PROCESSOR FRONTIER 330 (available from Fuji Photo Film Co., Ltd.) adapted for change of process time and temperature, was operated to perform imagewise exposure of each sample (photosensitive material) via a negative film having an average density and to carry out a continuous processing (running test) until a replenished amount of color developing solution, as used in the following processing steps, reached double the capacity of the color developer tank. The processing using the running processing solution is referred to as "color development process A". Subsequently, the processing was conducted for 2 days in a manner to accomplish a Ta value of 100.

Color Development Process A

| Step | Temperature | Time | Replenished amount* |
|---|---|---|---|
| Color development | 38.5° C. | 45 sec | 45 mL |
| Bleach-fixing | 38.0° C. | 45 sec | 35 mL |
| Rinse (1) | 38.0° C. | 20 sec | — |
| Rinse (2) | 38.0° C. | 20 sec | — |
| Rinse (3)** | 38.0° C. | 20 sec | — |
| Rinse (4)** | 38.0° C. | 30 sec | 121 mL |
| Drying | 80° C. | | |

Note

*a replenished amount per 1 $m^2$ of photosensitive material

**The rinse tank (3) was provided with a rinse cleaning system RC50D, available from Fuji Photo Film Co., Ltd., such as to pump a drawn rinsing fluid from Rinse (3) into a reverse osmosis module (RC50D). Permeated water thus obtained was fed to the rinse (4), while concentrated water was returned to the rinse (3). The pump pressure was adjusted so that the amount of permeated water fed to the reverse osmosis module was maintained at 50 to 300 mL/min. and the circulation at a controlled temperature was carried out for 10 hours per day. The rinsing fluid was circulated from the rinse tank (1) to the rinse tank (4) based on four-tank counter flow system.

The compositions of each processing solution are listed as below.

| | [Tank] | [Replenisher] |
|---|---|---|
| [Color developer] | | |
| Water | 800 mL | 800 mL |
| Fluorescent brightener (FL-1) | 2.2 g | 5.1 g |
| Fluorescent brightener (FL-2) | 0.35 g | 1.75 g |
| Tri(isopropanol)amine | 8.8 g | 8.8 g |
| Polyethylene glycol (average melecular weight: 300) | 10.0 g | 10.0 g |
| Ethylenediaminetetraacetate | 4.0 g | 4.0 g |
| Sodium sulfite | 0.10 g | 0.20 g |
| Potassium chloride | 10.0 g | — |
| Sodium 4,5-dihydroxybenzene-1,3-disulfonate | 0.50 g | 0.50 g |
| Disodium-N,N-bis(sulfonateethyl)hydroxylamine | 8.5 g | 14.0 g |
| 4-amino-3-methyl-N-ethyl-N-(β-methanesulfonamidoethyl)aniline-3/2 sulfate-monohydrate | 4.8 g | 14.0 g |
| Potassium carbonate | 26.3 g | 26.3 g |
| Water to make | 1000 mL | 1000 mL |
| pH (adjusted at 25° C., using sulfuric acid and KOH) | 10.15 | |
| [Bleach-fixing solution] | | |
| Water | 800 mL | 800 mL |
| Ammonium thiosulfate (750 g/mL) | 107 mL | 214 mL |
| m-carboxybenzensulfinate | 8.3 g | 16.5 g |
| Iron(III) ammonium ethylenediaminetetraacetate | 47.0 g | 94.0 g |
| Ethylenediaminetetraacetate | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 mL | 1000 mL |
| pH (adjusted at 25° C., using nitric acid and ammonia water) | 6.5 | 6.5 |
| [Rinsing fluid] | | |
| Chlorinated sodium isocyanate | 0.02 g | 0.02 g |
| Water | 1000 mL | 1000 mL |

FL-1

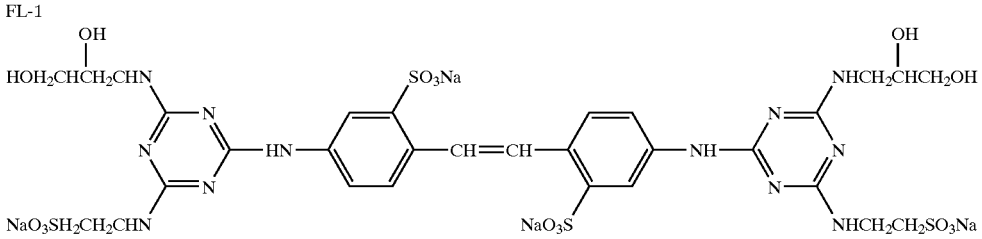

FL-2

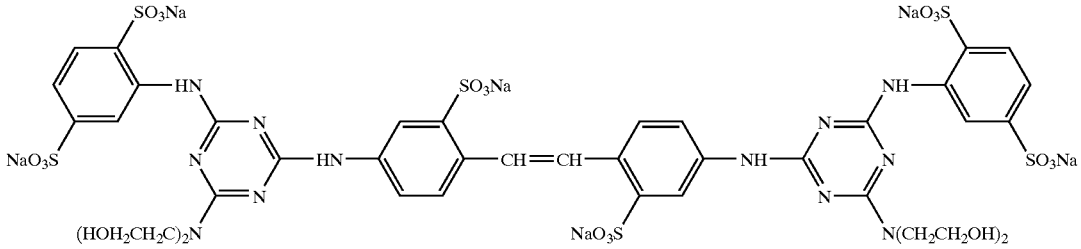

Evaluation of Color Bleeding

A rectangular pattern having a spatial frequency of 6 cycles was formed based on a bmp-format file by means of Adobe Photoshop™. Input values of the rectangular pattern were (R,G,B)=(0, 255, 255) for a cyan color forming portion; (R,G,B)=(255, 0, 255) for a magenta color forming portion; and (R,G,B)=(255, 255, 255) for a white portion. Each of the samples processed by the aforesaid Frontier 330 laboratory processor was measured for the magenta color by means of a densitometer, Microphotometer MPM No.150 available from Union Inc., using a green light (545 nm, a half-width: 30 nm) per aperture area of 5×200 μm. Thus was determined the density DL (Fr) of a low-density portion. The smaller the DL value, the higher the reproducibility of white line in a high-density solid portion. The samples were allowed to stand at 80° C. and 70% RH for 30 days and then, determined for the DL value (30d) in the same manner, in order to determine the density variation percentage ΔDm (%) after the storage period.

$$\Delta Dm\ (\%) = DL(30d)/DL(Fr) \times 100 \qquad \text{Equation:}$$

In a similar manner, each of the samples was measured for the cyan color density using a red light (645 nm, half-width: 30 nm) thereby determining the density DL (Fr) on the low-density portion. After storage at 80° C. and 70% RH for 30 days, the DL (30d) was determined in the same manner as the above in order to calculate the density variation percentage ΔDc (%) after the storage period.

It is noted that the density variation percentages ΔDm (%) and ΔDc (%) increase in correspondence with the DL (30 d) value increased with an increasing degree of color bleeding during the storage time. This will result in a density variation percentage ΔD (%) in excess of 100. The smaller ΔD (%) value means lower degree of color bleeding.

Evaluation (2)

The samples thus prepared were subjected to exposure and development processes in the following manner and evaluated for the aptitude to high-speed/high-throughput processing. The results are listed in Table 2.

In the final processing bath of the development process, each of the samples was rinsed with the rinsing fluid (Rinse(4)) wherein the content of calcium was adjusted in the same manner as in the evaluation (1).

Exposure/Development Processes

The samples thus coated were allowed to stand at 25° C.-55% RH for 10 days and then shaped into a roll having a width of 127 mm. Each of the samples was exposed through red, green and blue filters and a 20-stepped exposure wedge to light from a standard Xe light at 200000 Lux/sec (1×/sec) for 0.0001 second using a HIE-type sensitometer commercially available from Fuji Photo Film Co., Ltd. and a voltage of 1000 V applied to a capacitor. Then, the samples were allowed to stand for 30 minutes under the conditions of 25° C.-55% RH. A laboratory processor, a MINI-LABO PRINTER PROCESSOR PP350 (available from Fuji Photo Film Co., Ltd.) adapted for change of process time and temperature, was operated to perform a continuous processing (running test) until a replenished amount of color developing solution, as used in the following processing steps, reached double the capacity of the color developer tank. The processing using the running processing solution is referred to as "color development process B".

Color Development Process B

| Step | Temperature | Time | Replenished amount* |
|---|---|---|---|
| Color development | 45.0° C. | 15 sec | 45 mL |
| Bleach-fixing | 40.0° C. | 15 sec | 35 mL |
| Rinse (1) | 40.0° C. | 6 sec | — |
| Rinse (2) | 40.0° C. | 6 sec | — |
| Rinse (3)** | 40.0° C. | 6 sec | — |
| Rinse (4)** | 38.0° C. | 6 sec | 121 mL |
| Drying | 80° C. | | |

Note

*a replenished amount per 1 $m^2$ of photosensitive material

**The rinse tank (3) was provided with a rinse cleaning system RC50D, available from Fuji Photo Film Co., Ltd., such as to pump a drawn rinsing fluid from the rinse (3) into a reverse osmosis module (RC50D). Permeated water thus obtained was fed to the rinse (4), while concentrated water was returned to the rinse (3). The pump pressure was adjusted so that the amount of permeated water to the reverse osmosis module was maintained at 50 to 300 mL/min. and the circulation at a controlled temperature was carried out for 10 hours per day. The rinsing fluid was circulated from the rinse tank (1) to the rinse tank (4) based on four-tank counter flow system.

The compositions of the processing solutions are listed as below.

| | [Tank] | [Replenisher] |
|---|---|---|
| [Color developer] | | |
| Water | 800 mL | 800 mL |
| Fluorescent brightener (FL-3) | 4.0 g | 8.0 g |
| Residual color suppressor (SR-1) | 3.0 g | 5.5 g |
| Tri(isopropanol)amine | 8.8 g | 8.8 g |
| Sodium p-toluenesulfonate | 10.0 g | 10.0 g |
| Ethylenediaminetetraacetate | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium-N,N-bis(sulfonateethyl)hydroxylamine | 8.5 g | 14.0 g |
| 4-amino-3-methyl-N-ethyl-N-(β-methanesulfonamidoethyl)aniline-3/2 sulfate-monohydrate | 7.0 g | 19.0 g |
| Potassium carbonate | 26.3 g | 26.3 g |
| Water to make | 1000 mL | 1000 mL |
| pH (adjusted at 25° C., using sulfuric acid and KOH) | 10.15 | 12.5 |
| [Bleach-fixing solution] | | |
| Water | 800 mL | 800 mL |
| Ammonium thiosulfate (750 g/mL) | 107 mL | 214 mL |
| Succinic acid | 29.5 g | 59.0 g |
| Iron(III) ammonium ethylenediaminetetraacetate | 47.0 g | 94.0 g |
| Ethylenediaminetetraacetate | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 mL | 1000 mL |
| pH (adjusted at 25° C., using nitric acid and ammonia water) | 6.00 | 6.00 |
| [Rinsing fluid] | | |
| Chlorinated sodium isocyanate | 0.02 g | 0.02 g |
| Water | 1000 mL | 1000 mL |
| pH (25° C.) | 6.5 | 6.5 |

-continued

| | [Tank] | [Replenisher] |
|---|---|---|

FL-3

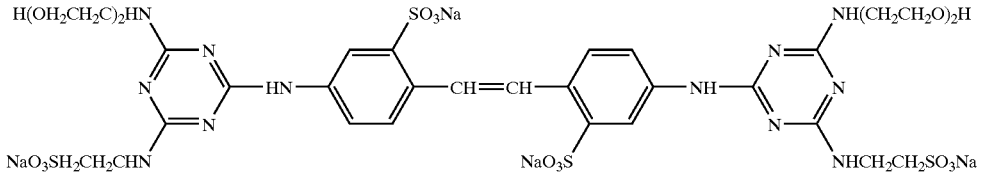

SR-1

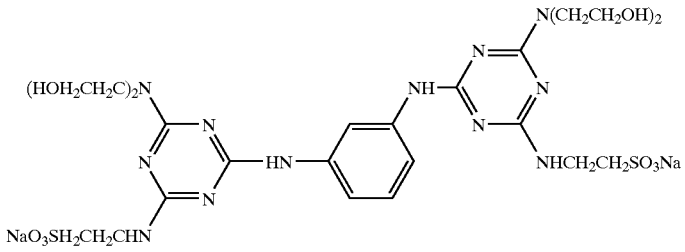

Evaluation Method for High-Speed/High-Throughput Processing

Each of the processed samples was measured for the densities of respective patch areas subjected to gradation exposure using X-rite, so as to determine the yellow component density Dy, the magenta component density Dm and the cyan component density Dc. Then, a sensitometry curve was obtained by interpolating intermediate points between measurement points. On the other hand, the samples were also subjected to gray gradation exposure in a manner that the exposure light was adjusted by means of gelatin color filters rather than by color separation and that a neutral tone at a density of 0.7 was attained by subjecting the samples to the color development process B. The samples thus exposed were subjected to the color development process B and measured for the density using X-rite. Thus were determined the yellow component density Dgy, the magenta component density Dgm and the cyan component density Dgc.

As an index for the aptitude to high-speed/high-throughput processing, a linear speed scale for color development process was defined from 10 seconds to 30 seconds on a per-second basis. The samples were determined for the $t_{2.0}$ until all the values of Dgy, Dgm, Dgc reached 2.0 at a maximum density portion. The smaller the value $t_{2.0}$, the greater the aptitude to the high-speed/high-throughput processing. The value $t_{2.0}$ was regressively determined on a per-0.1-sec. basis by interpolating experiment values.

TABLE 2

| | Photosensitive Material | | | | | | | | | |
|---|---|---|---|---|---|---|---|---|---|---|
| Image Formation No. | Sample No. | Total coated amount of silver ($g/m^2$) | Total coated amount of gelatin ($g/m^2$) | Fifth layer in-oil/gelatin | Third layer in-oil/gelatin | Rinse $Ca^{2+}$ (mg/L) | ΔDc(%) | ΔDm(%) | $T_{20}$ | Note |
| 001-1 | 001 | 0.51 | 6.57 | 0.85 | 1.00 | 20.0 | 121 | 141 | 19.3 | Comparative Example |
| 001-2 | 001 | 0.51 | 6.57 | 0.85 | 1.00 | 10.0 | 122 | 140 | 19.3 | Comparative Example |
| 001-3 | 001 | 0.51 | 6.57 | 0.85 | 1.00 | 2.0 | 120 | 128 | 19.3 | Comparative Example |
| 101-1 | 101 | 0.49 | 6.82 | 0.88 | 0.72 | 20.0 | 120 | 139 | 16.3 | Comparative Example |
| 101-2 | 101 | 0.49 | 6.82 | 0.88 | 0.72 | 10.0 | 122 | 141 | 16.3 | Comparative Example |
| 101-3 | 101 | 0.49 | 6.82 | 0.88 | 0.72 | 2.0 | 104 | 107 | 16.3 | Present Invention |
| 101-4 | 101-a | 0.49 | 6.82 | 0.88 | 0.82 | 2.0 | 106 | 110 | 15.8 | Present Invention |
| 101-5 | 101-b | 0.49 | 6.82 | 0.88 | 1.00 | 2.0 | 108 | 111 | 14.7 | Present Invention |
| 101-6 | 101-c | 0.49 | 7.15 | 0.88 | 0.64 | 2.0 | 108 | 109 | 21.1 | Comparative Example |
| 101-7 | 101-d | 0.49 | 6.42 | 0.88 | 1.23 | 2.0 | 122 | 152 | 13.9 | Comparative Example |
| 102-1 | 102 | 0.42 | 6.88 | 0.92 | 0.72 | 2.0 | 103 | 104 | 13.9 | Present Invention |
| 102-2 | 102 | 0.42 | 6.88 | 0.92 | 0.72 | 3.0 | 105 | 105 | 13.9 | Present Invention |
| 103-1 | 103 | 0.42 | 6.88 | 0.92 | 0.82 | 3.0 | 104 | 106 | 13.1 | Present Invention |
| 103-2 | 103 | 0.42 | 6.88 | 0.92 | 0.82 | 2.0 | 103 | 103 | 13.1 | Present Invention |
| 103-3 | 103-a | 0.42 | 6.88 | 0.92 | 0.92 | 2.0 | 103 | 101 | 13.1 | Present Invention |

As seen from the results listed in Table 2, the comparison among the image forming methods Nos.001-1 to 001-3 shows that both the aptitude to the high-speed/high-throughput processing and a notable reduction of color bleeding can be achieved by decreasing the concentration of $Ca^{2+}$ in the final bath of the rinsing process and employing the specific cyan coupler. As demonstrated by the image forming methods Nos.101-4 and 101-5, the samples having the changed ratios of the dissolved components in oil versus gelatin achieves higher aptitude to the high-speed/high-throughput processing. As indicated by the image forming method No.101-6, however, an increased color bleeding and a decreased aptitude to the high-speed/high-throughput processing results when the ratio of dissolved components in oil versus gelatin and the coating amount of gelatin are out of the ranges defined by the invention. The image forming method No.101-7 indicates a lowered effect of the invention with respect to the magenta color bleeding. The results of the image forming methods Nos.102-1, 2 and 103-1, 2 show that the specific type of magenta coupler and the reduced coating amount of silver contribute to the further improvement in the color image bleeding and the aptitude to the high-speed/high-throughput processing.

These examples demonstrate that the image formation according to the method of the invention affords a much greater working effect than expected in the achievement of the aptitude to the high-speed/high-throughput processing and the excellent storability of color image.

As described above, the invention provides the image forming method which offers color images featuring high color purity, high aptitude to high-speed/high-throughput processing and good post-process storability. More specifically, the invention provides the image forming method adapted to improve the cyan color purity and to suppress the color bleedings on the color images during storage.

Examples for Fifth Embodiment of Image Forming Method

Now, description will be made on the examples of the fifth embodiment of the image forming method and the first embodiment of the silver halide color photographic photosensitive material.

Example 2

Preparation of Blue-Sensitive Emulsion A

An emulsion of higher sensitivity A-1 and an emulsion of lower sensitivity A-2 were prepared using the same compositions and method as in the preparation of the blue-sensitive emulsion A of Example 1.

Preparation of Blue-Sensitive Emulsion B

An emulsion of higher sensitivity B-1 and an emulsion of lower sensitivity B-2 were prepared using the same compositions and method as in the preparation of the blue-sensitive emulsion B of Example 1.

Preparation of Green-Sensitive Emulsion C

An emulsion of higher sensitivity C-1 and an emulsion of lower sensitivity C-2 were prepared using the same compositions and method as in the preparation of the green-sensitive emulsion C of Example 1.

The grains in the emulsion of higher sensitivity had an average side length of 0.40 $\mu$m, whereas the grains in the emulsion of lower sensitivity had an average side length of 0.30 $\mu$m. Both the grains in the emulsions of higher and lower sensitivities had a side length variation coefficient of 8%.

The sensitizing dye D was added to the emulsion of greater grain size in an amount of $3.0\times10^{-4}$ mol per mol of silver halide, and to the emulsion of smaller grain size in an amount of $3.6\times10^{-4}$ mol per mol of silver halide. The sensitizing dye E was added to the emulsion of greater grain size in an amount of $4.0\times10^{-5}$ mol per mol of silver halide, and to the emulsion of smaller grain size in an amount of $7.0\times10^{-5}$ mol per mol of silver halide.

Preparation of Green-Sensitive Emulsion D

An emulsion of higher sensitivity D-1 and an emulsion of lower sensitivity D-2 were prepared using the same compositions and method as in the preparation of the green-sensitive emulsion D of Example 1.

The grains in the emulsion of higher sensitivity had an average side length of 0.50 $\mu$m, whereas the grains in the emulsion of lower sensitivity had an average side length of 0.40 $\mu$m. Both the grains in the emulsions of higher and lower sensitivities had a side length variation coefficient of 10%.

The sensitizing dye D was added to the emulsion of greater grain size in an amount of $4.0\times10^{-4}$ mol per mol of silver halide, and to the emulsion of smaller grain size in an amount of $4.5\times10^{-4}$ mol per mol of silver halide. The sensitizing dye E was added to the emulsion of greater grain size in an amount of $5.0\times10^{-5}$ mol per mol of silver halide, and to the emulsion of smaller grain size in an amount of $8.8\times10^{-5}$ mol per mol of silver halide.

Preparation of Red-Sensitive Emulsion E

An emulsion of higher sensitivity E-1 and an emulsion of lower sensitivity E-2 were prepared using the same compositions and method as in the preparation of the red-sensitive emulsion E of Example 1.

The grains in the emulsion of higher sensitivity had an average side length of 0.38 $\mu$m, whereas the grains in the emulsion of lower sensitivity had an average side length of 0.32 $\mu$m. The grains in the emulsions of higher and lower sensitivities had a side length variation coefficient of 9% and 10%, respectively.

The sensitizing dyes G and H were each added to the emulsion of greater grain size in an amount of $8.0\times10^{-5}$ mol per mol of silver halide, and to the emulsion of smaller grain size in an amount of $10.7\times10^{-5}$ mol per mol of silver halide.

Furthermore, the aforesaid compound I used in Example 1 was added to the red-sensitive emulsion layer in an amount of $3.0\times10^{-3}$ mol per mol of silver halide.

Preparation of Red-Sensitive Emulsion F

An emulsion of higher sensitivity F-1 and an emulsion of lower sensitivity F-2 were prepared using the same compositions and method as in the preparation of the red-sensitive emulsion F of Example 1.

The grains in the emulsion of higher sensitivity had an average side length of 0.57 $\mu$m, whereas the grains in the emulsion of lower sensitivity had an average side length of 0.43 $\mu$m. The grains in the emulsions of higher and lower sensitivities had a side length variation coefficient of 9% and 10%, respectively.

The sensitizing dyes G and H were each added to the emulsion of greater grain size in an amount of $1.0\times10^{-4}$ mol per mol of silver halide, and to the emulsion of smaller grain size in an amount of $1.34\times10^{-4}$ mol per mol of silver halide.

Furthermore, the aforesaid compound I was added to the red-sensitive emulsion layer in an amount of $3.0\times10^{-3}$ mol per mol of silver halide.

Preparation of Coating Solution for First Layer

A coating solution for first layer was prepared using the same compositions and method as in the preparation of the coating solution for first layer of Example 1.

Preparation of Coating Solutions for Second to Seventh Layers

Coating solutions for second to seventh layers were prepared using the same compositions and methods as in the preparation of the coating solutions for second to seventh layers of Example 1, respectively. The same additives as in Example 1 were added to the individual layers in the same mixing ratios as in Example 1.

Preparation of Sample 101

Sample 101 was prepared in the same layer structure and in the same manner as those of the sample 101 of Example 1.

Preparation of Sample 001

Sample 001 was prepared in the same layer structure and in the same manner as those of the sample 001 of Example 1.

Preparation of Sample 102

A sample 102 was prepared in the same layer structure and in the same manner as those of the sample 102 of Example 1.

Preparation of Sample 103

Sample 103 was prepared in the same layer structure and in the same manner as those of the sample 103 of Example 1.

Color Development Process A

The samples thus prepared were allowed to stand at 25° C.-55% RH for 10 days and then shaped into a roll having a width of 127 mm. A laboratory processor, a MINI-LABO PRINTER PROCESSOR FRONTIER 330 (available from Fuji Photo Film Co., Ltd.) adapted for change of process time and temperature, was operated to perform imagewise exposure of each sample (photosensitive material) via a negative film having an average density and to carry out a continuous processing (running test) until a replenished amount of color developing solution, as used in the following processing steps, reached double the capacity of the color developer tank. The processing using the running processing solution is referred to as "color development process A". Subsequently, the process was conducted for 2 days to accomplish a Ta value of 100.

| Step | Temperature | Time | Replenished amount* |
|---|---|---|---|
| Color development | 38.5° C. | 45 sec | 45 mL |
| Bleach-fixing | 38.0° C. | 45 sec | 35 mL |
| Rinse (1) | 38.0° C. | 20 sec | — |
| Rinse (2) | 38.0° C. | 20 sec | — |
| Rinse (3)** | 38.0° C. | 20 sec | — |
| Rinse (4)** | 38.0° C. | 30 sec | 121 mL |
| Drying | 80° C. | | |

Note

*a replenished amount per 1 $m^2$ of photosensitive material

**The rinse tank (3) was provided with a rinse cleaning system RC50D, available from Fuji Photo Film Co., Ltd., such as to pump a drawn rinsing fluid from the rinse (3) into a reverse osmosis module (RC50D). Permeated water thus obtained was fed to the rinse (4), while concentrated water was returned to the rinse (3). The pump pressure was adjusted so that the amount of permeated water to the reverse osmosis module was maintained at 50 to 300 mL/min. and the circulation at a controlled temperature was carried out for 10 hours per day. The rinsing fluid was circulated from the rinse tank (1) to the rinse tank (4) based on four-tank counter flow system.

The compositions of the processing solutions are listed as below.

| | [Tank] | [Replenisher] |
|---|---|---|
| [Color developer] | | |
| Water | 800 mL | 800 mL |
| Fluorescent brightener (FL-1) | 2.2 g | 5.1 g |
| Fluorescent brightener (FL-2) | 0.35 g | 1.75 g |
| Tri(isopropanol)amine | 8.8 g | 8.8 g |
| Polyethylene glycol(average melecular weight: 300) | 10.0 g | 10.0 g |
| Ethylenediaminetetraacetate | 4.0 g | 4.0 g |
| Sodium sulfite | 0.10 g | 0.20 g |
| Potassium chloride | 10.0 g | — |
| Sodium 4,5-dihydroxybenzene-1,3-disulfonate | 0.50 g | 0.50 g |
| Disodium-N,N-bis(sulfonateethyl)hydroxylamine | 8.5 g | 14.0 g |
| 4-amino-3-methyl-N-ethyl-N-(β-methanesulfonamidoethyl)aniline-3/2 sulfate-monohydrate | 4.8 g | 14.0 g |
| Potassium carbonate | 26.3 g | 26.3 g |
| Water to make | 1000 mL | 1000 mL |
| pH (adjusted at 25° C., using sulfuric acid and KOH) | 10.15 | |
| [Bleach-fixing solution] | | |
| Water | 800 mL | 800 mL |
| Ammonium thiosulfate (750 g/mL) | 107 mL | 214 mL |
| m-carboxybenzensulfinate | 8.3 g | 16.5 g |
| Iron(III) ammonium ethylenediaminetetraacetate | 47.0 g | 94.0 g |
| Ethylenediaminetetraacetate | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 mL | 1000 mL |
| pH (adjusted at 25° C., using nitric acid and ammonia water) | 6.5 | 6.5 |
| [Rinsing fluid] | | |
| Chlorinated sodium isocyanate | 0.02 g | 0.02 g |
| Deionized water (conductivity: 5 μS/cm or less) | 1000 mL | 1000 mL |
| pH (25° C.) | 6.5 | 6.5 |

-continued

| | [Tank] | [Replenisher] |
|---|---|---|

FL-1

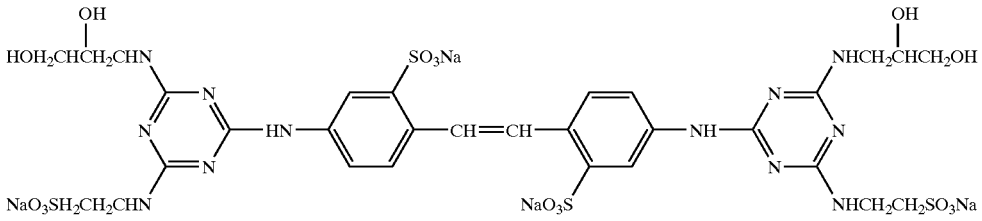

FL-2

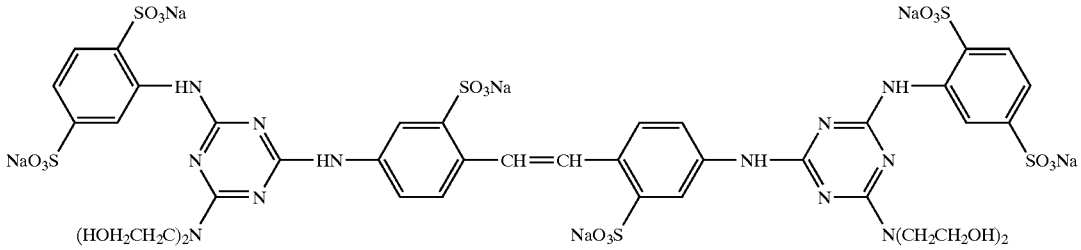

FRONTIER 330 (available from Fuji Photo Film Co., Ltd.) was subjected to 5 calibration operations for correction of a calibration pattern.

Subsequently, the calibration pattern was outputted again. In the pattern, the density of a patch area having the highest value of cyan X-rite measurement was measured over 10 times within a period of 3 minutes after the drying step, thereby to determine an average density Dc (Fr). The patch was allowed to stand at well ventilated dark place at 30° C.-55% RH for 3 months. Then, the patch was subjected to the same measurement as that for the Dc (Fr) so as to find the value Dc (3m). These measurement values were applied to an equation ΔDc=Dc(3 m)−Dc(Fr) so as to find ΔDc.

A numerical aperture K of a desilvering/fixing bath P2 of Frontier 330 was adjusted to each value listed in Table 3 by providing a perforated floating cover on the liquid surface before each of the samples 001, 101, 102 and 102 was processed. Prior to the processing, the running processing solution was regulated so as to accomplish an average replacement rate of the bleach-fixing solution or a Ta value thereof as listed in Table 3 in one day. The processing was carried out and measurement was taken on the Dc (Fr). Furthermore, the samples were allowed to stand under given conditions and then, measurement was taken on the Dc (3m) to calculate ΔDc. The results are listed in Table 3.

TABLE 3

| Image Formation | Photosensitive mat. | | Bleach/ fixing conditions | | Post development | |
|---|---|---|---|---|---|---|
| No. | Sample | Silver(g/m$^2$) | Ta | K | ΔDc of sample | Note |
| 001-1 | 001 | 0.51 | 14.0 | 0.012 | 0.034 | Comparative Example |
| 001-2 | 001 | 0.51 | 5.0 | 0.004 | 0.055 | Comparative Example |
| 001-3 | 001 | 0.51 | 3.0 | 0.003 | 0.072 | Comparative Example |
| 101-1 | 101 | 0.49 | 14.0 | 0.012 | 0.033 | Comparative Example |
| 101-2 | 101 | 0.49 | 5.0 | 0.012 | 0.032 | Comparative Example |
| 101-3 | 101 | 0.49 | 14.0 | 0.004 | 0.033 | Comparative Example |
| 101-4 | 101 | 0.49 | 5.0 | 0.004 | 0.018 | Present Invention |
| 101-5 | 101 | 0.49 | 3.0 | 0.003 | 0.019 | Present Invention |
| 102-1 | 102 | 0.42 | 5.0 | 0.004 | 0.013 | Present Invention |
| 102-2 | 102 | 0.42 | 3.0 | 0.003 | 0.012 | Present Invention |
| 103-1 | 103 | 0.42 | 5.0 | 0.004 | 0.009 | Present Invention |
| 103-2 | 103 | 0.42 | 3.0 | 0.003 | 0.010 | Present Invention |
| 103-3 | 103 | 0.42 | 2.8 | 0.001 | 0.011 | Present Invention |

As seen from the results of Table 3, when subjected to the continuous processing with the Ta value decreased and the K value decreased to decrease the amount of evaporated water, the sample 001 is more increased in the cyan density during storage after the processing. In contrast, where the sample 101 is processed in the same manner as the above, the sample 101 surprisingly presents a much smaller increase in the cyan density during storage and also smaller density fluctuations when the processing volume is varied. It is also found that the working effect of the invention is notably increased by the use of the sample 102 reduced in the coating amount of silver or the use of the sample 103 employing the different type of magenta coupler. Thus, the image formation according to the image forming method of the invention can achieve high productivity and ensure post-process stability of the cyan color.

Example 3

The samples prepared in Example 2 were subjected to color development process B described as below. The samples were tested in the same manner as in Example 2 and similar results were obtained.

Color Development Process B

The samples thus prepared were shaped into a roll having a width of 127 mm. A laboratory processor, a MINI-LABO PRINTER PROCESSOR FRONTIER PP 350 (available from Fuji Photo Film Co., Ltd.) adapted for change of process time and temperature, was operated to perform imagewise exposure of each sample via a negative film having an average density and to carry out a continuous processing (running test) until a replenished amount of color developing solution, as used in the following processing steps, reached double the capacity of the color developer tank. The processing using the running processing solution is referred to as "color development process B".

| Step | Temperature | Time | Replenished amount* |
|---|---|---|---|
| Color development | 45.0° C. | 15 sec | 45 mL |
| Bleach-fixing | 40.0° C. | 15 sec | 35 mL |
| Rinse (1) | 40.0° C. | 6 sec | — |
| Rinse (2) | 40.0° C. | 6 sec | — |
| Rinse (3)** | 40.0° C. | 6 sec | — |
| Rinse (4)** | 38.0° C. | 6 sec | 121 mL |
| Drying | 80° C. | 15 sec | |

Note

*a replenished amount per 1 $m^2$ of photosensitive material

**The rinse tank (3) was provided with a rinse cleaning system RC50D, available from Fuji Photo Film Co., Ltd., such as to pump a drawn rinsing fluid from the rinse (3) into a reverse osmosis module (RC50D). Permeated water thus obtained was fed to the rinse (4), while concentrated water was returned to the rinse (3). The pump pressure was adjusted so that the amount of permeated water to the reverse osmosis module was maintained at 50 to 300 mL/min. and the circulation at a controlled temperature was carried out for 10 hours per day. The rinsing fluid was circulated from the rinse tank (1) to the rinse tank (4) based on four-tank counter flow system.

The compositions of the processing solutions are listed as below.

| | [Tank] | [Replenisher] |
|---|---|---|
| [Color developer] | | |
| Water | 800 mL | 800 mL |
| Fluorescent brightener (FL-3) | 4.0 g | 8.0 g |
| Residual color suppressor(SR-1) | 3.0 g | 5.5 g |
| Tri(isopropanol)amine | 8.8 g | 8.8 g |
| Sodium p-toluenesulfonate | 10.0 g | 10.0 g |
| Ethylenediaminetetraacetate | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium-N,N-bis(sulfonateethyl)hydroxylamine | 8.5 g | 14.0 g |
| 4-amino-3-methyl-N-ethyl-N-(β-methanesulfonamidoethyl)aniline-3/2 sulfate-monohydrate | 7.0 g | 19.0 g |
| Potassium carbonate | 26.3 g | 26.3 g |
| Water to make | 1000 mL | 1000 mL |
| pH (adjusted at 25° C., using sulfuric acid and KOH) | 10.25 | 12.6 |
| [Bleach-fixing solution] | | |
| Water | 800 mL | 800 mL |
| Ammonium thiosulfate(750 g/mL) | 107 mL | 214 mL |
| Succinic acid | 29.5 g | 59.0 g |
| Iron(III) ammonium ethylenediaminetetraacetate | 47.0 g | 94.0 g |
| Ethylenediaminetetraacetate | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 mL | 1000 mL |
| pH (adjusted at 25° C., using nitric acid and ammonia water) | 6.00 | 6.00 |
| [Rinsing fluid] | | |
| Chlorinated sodium isocyanate | 0.02 g | 0.02 g |
| Deionized water (conductivity: 5 μS/cm or less) | 1000 mL | 1000 mL |
| pH (25° C.) | 6.5 | 6.5 |

-continued

| | [Tank] | [Replenisher] |
|---|---|---|

FL-3

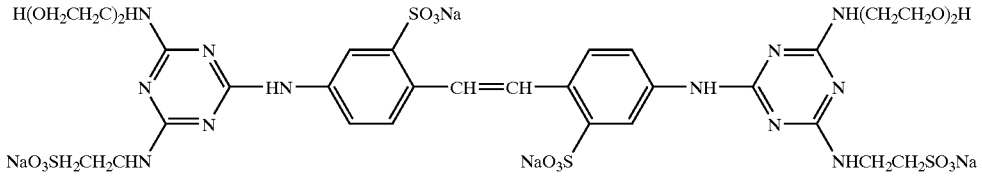

SR-1

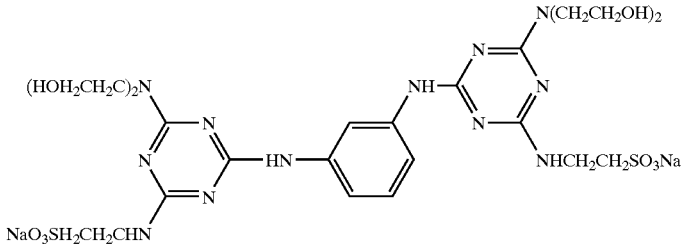

These examples demonstrate that the silver halide color photographic photosensitive material and the image forming method according to the invention achieve a far more excellent working effect than expected, ensuring high productivity and post-process stability of the cyan color density by preventing the developed cyan color from deteriorated by blix discoloration.

As described above, the invention provides the image forming method and the silver halide color photographic photosensitive material adapted to stabilize the cyan density of the color image developed on the silver halide color photographic photosensitive material by preventing the deterioration of the cyan color density due to blix discoloration.

Examples for Tenth Embodiment of Image Forming Method

Now, description will be made on the examples of the tenth embodiment of the image forming method and the sixth embodiment of the silver halide color photographic photosensitive material.

Example 4

Preparation of Blue-Sensitive Emulsions A-1, A-2

A blue-sensitive emulsion of higher sensitivity A-1 and a blue-sensitive emulsion of lower sensitivity A-2 were prepared using the same compositions and method as in the preparation of the blue-sensitive emulsion A of Example 1.

Preparation of Green-Sensitive Emulsions C-1, C-2

A green-sensitive emulsion of higher sensitivity C-1 and a green-sensitive emulsion of lower sensitivity C-2 were prepared using the same compositions and method as in the preparation of the green-sensitive emulsion C of Example 1.

The grains in the emulsion of higher sensitivity had an average side length of 0.40 $\mu$m, whereas the grains in the emulsion of lower sensitivity had an average side length of 0.30 $\mu$m. Both the grains in the emulsions of higher and lower sensitivities had a side length variation coefficient of 8%.

The sensitizing dye D was added to the emulsion of greater grain size in an amount of $3.0\times10^{-4}$ mol per mol of silver halide, and to the emulsion of smaller grain size in an amount of $3.6\times10^{-4}$ mol per mol of silver halide. The sensitizing dye E was added to the emulsion of greater grain size in an amount of $4.0\times10^{-5}$ mol per mol of silver halide, and to the emulsion of smaller grain size in an amount of $7.0\times10^{-5}$ mol per mol of silver halide.

Preparation of Red-Sensitive Emulsions E-1, E-2

A red-sensitive emulsion of higher sensitivity E-1 and a red-sensitive emulsion of lower sensitivity E-2 were prepared using the same compositions and method as in the preparation of the red-sensitive emulsion E of Example 1.

The grains in the emulsion of higher sensitivity had an average side length of 0.38 $\mu$m, whereas the grains in the emulsion of lower sensitivity had an average side length of 0.32 $\mu$m. The grains in the emulsions of higher and lower sensitivities had a side length variation coefficient of 9% and 10%, respectively.

The sensitizing dyes G and H were each added to the emulsion of greater grain size in an amount of $8.0\times10^{-5}$ mol per mol of silver halide, and to the emulsion of smaller grain size in an amount of $10.7\times10^{-5}$ mol per mol of silver halide.

Furthermore, the compound I used in Example 1 was added to the red-sensitive emulsion layer in an amount of $3.0\times10^{-3}$ mol per mol of silver halide.

The emulsions A-1, A-2, C-1, C-2, E-1 and E-2 were analyzed for the concentration distributions of iodide ions and bromide ions by the etching/TOF-SIMS. In all the emulsions, the concentration of iodide ions was the greatest at the grain surface and progressively decreased toward the grain core. That is, the analysis revealed that the grain comprises multiple layers of silver iodide formed about the grain core and under layers of silver bromide lying under the layers of silver iodide and surrounding the grain core.

Preparation of Coating Solution for First Layer

Into 21 g of a solvent (Solv-1) and 80 ml of ethyl acetate, dissolved were 57 g of yellow coupler (ExY), 7 g of color image stabilizer (Cpd-1), 4 g of color image stabilizer (Cpd-2), 7 g of color image stabilizer (Cpd-3) and 2 g of color image stabilizer (Cpd-8). The resultant solution was emulsified/dispersed in 220 g of a 23.5% by mass aqueous solution of gelatin containing 4 g of sodium dodecylbenzenesulfonate using a high-speed stirrer/emulsifier (Dissolver) followed by adding water thereto. Thus was obtained 900 g of emulsified dispersion A.

On the other hand, the emulsified dispersion A and the emulsions A-1 and A-2 were mixed and dissolved to give a first layer coating solution having the following compositions. A coating amount of the emulsion represents an applied amount of silver.

Preparation of Coating Solutions for Second to Seventh Layers

Coating solutions for second to seventh layers were prepared in the same manner as the first layer coating solution. There was used 1-oxy-3,5-dichloro-s-triazine sodium salt (H-1), (H-2) or (H-3) as a gelatin hardening agent for each layer. To the individual layers, Ab-1, Ab-2, Ab-3 and Ab-4 were added in respective total amounts of 15.0 mg/m$^2$, 60.0 mg/m$^2$, 5.0 mg/m$^2$ and 10.0 mg/m$^2$.

(H-1) Film hardening Agent

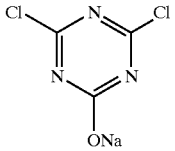

(used at an amount of 1.4% by mass based on gelatin)

(H-2) Film hardening Agent

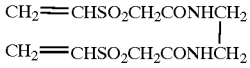

(H-3) Film hardening Agent

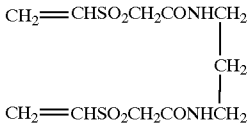

(Ab-1) Preservative

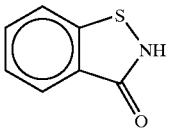

(Ab-2) Preservative

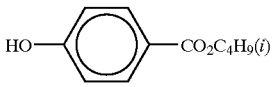

(Ab-3) Preservative

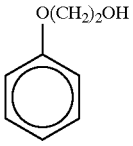

(Ab-4) Preservative

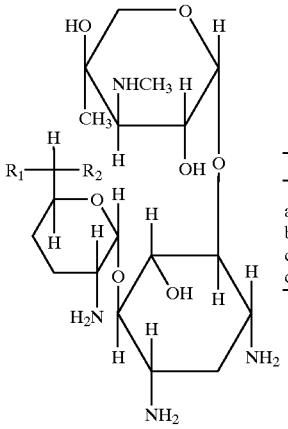

| | $R_1$ | $R_2$ |
|---|---|---|
| a | $CH_3$ | $NHCH_3$ |
| b | $CH_3$ | $NH_2$ |
| c | H | $NH_2$ |
| d | H | $NHCH_3$ |

Mixing ratio of a,b,c, and d is 1:1:1:1 (molar ratio)

In addition, 1-(3-methylureidophenyl)-5-mercaptotetrazole was added to the second, fourth, sixth and seventh layers in a respective amount of 0.2 mg/m$^2$, 0.2 mg/m$^2$, 0.6 mg/m$^2$ and 0.1 mg/m$^2$.

On the other hand, 4-hydroxy-6-methyl-1,3,3a,7-tetrazaindene was added to the blue-sensitive emulsion layer and the green-sensitive emulsion layer in a respective amount of $1\times10^{-4}$ mol and $2\times10^{-4}$ mol per mol of silver halide.

A copolymer latex of methacrylic acid and butyl acrylate (ratio by mass: 1:1, average molecular weight: 200000 to 400000) was also added to the red-sensitive emulsion layer in an amount of 0.05 g/m$^2$.

In addition, disodium catechol-3,5-disulfonate was added to the second, fourth and sixth layers in a respective amount of 6 mg/m$^2$, 6 mg/m$^2$ and 18 mg/m$^2$.

For the purpose of irradiation inhibition, the following dyes (numbers in parentheses indicate coating amount) were added.

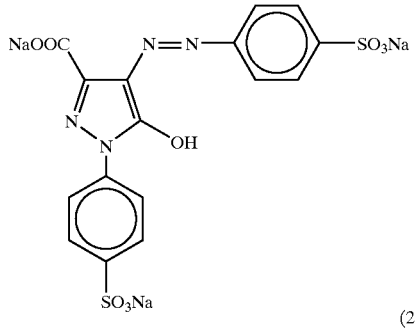

(2 mg/m$^2$)

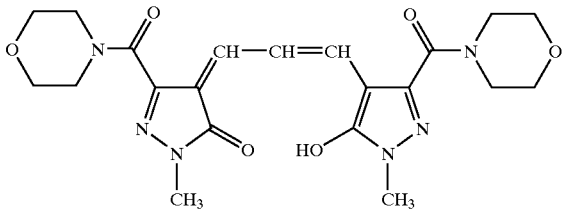

(2 mg/m$^2$)

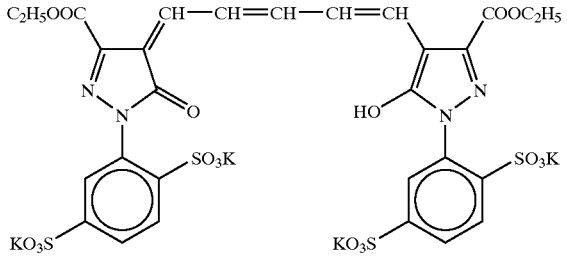

(24 mg/m$^2$)

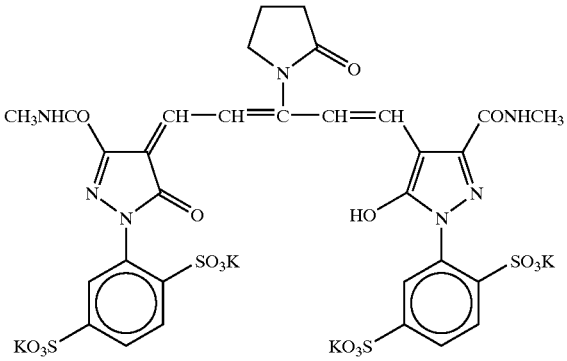

(3 mg/m$^2$)

The composition of each layer is set forth as below. The number in parentheses indicate coating amounts (g/m$^2$). The coating amount of silver halide is represented based on the amount of silver.

Support

Paper Laminated with Polyethylene Resin

The polyethylene resin on the first-layer side contained a white pigment ($TiO_2$: 16% by mass, ZnO: 4% by mass); a fluorescent brightener (4,4'-bis(5-methylbenzoxazolyl) stilbene: 0.03% by mass); and a bluing dye (ultramarine blue: 0.33% by mass). The amount of polyethylene resin is 29.2 g/$m^2$.

| First Layer (Blue-Sensitive Emulsion Layer) | |
|---|---|
| Silver chloro(iodo)bromide emulsion A (cubes sensitized with gold and sulfur; emulsion mixture of the large grain emulsion A-1 and the small grain emulsion A-2 in a ratio of 3:7 (in terms of a molar ratio of silver) | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| **Second Layer (Color Mixing Inhibiting Layer)** | |
| Gelatin | 1.15 |
| Color mixing inhibitor (Cpd-4) | 0.10 |
| Color image stabilizer (Cpd-5) | 0.018 |
| Color image stabilizer (Cpd-6) | 0.13 |
| Color image stabilizer (Cpd-7) | 0.07 |
| Solvent (Solv-1) | 0.04 |
| Solvent (Solv-2) | 0.12 |
| Solvent (Solv-5) | 0.11 |
| **Third Layer (Green-Sensitive Emulsion Layer)** | |
| Silver chloro(iodo)bromide emulsion C (cubes sensitized with gold and sulfur; emulsion mixture of the large grain emulsion C-1 and the small grain emulsion C-2 in a ratio of 1:3 (in terms of a molar ratio of silver) | 0.14 |
| Gelatin | 1.21 |
| Magenta coupler (ExM) | 0.15 |
| UV absorber (UV-A) | 0.14 |
| Color image stabilizer (Cpd-2) | 0.003 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.01 |
| Color image stabilizer (Cpd-10) | 0.01 |
| Color image stabilizer (Cpd-11) | 0.0001 |
| Solvent (Solv-3) | 0.09 |
| Solvent (Solv-4) | 0.18 |
| Solvent (Solv-5) | 0.17 |
| **Fourth Layer (Color Mixing Inhibiting Layer)** | |
| Gelatin | 0.68 |
| Color mixing inhibitor (Cpd-4) | 0.06 |
| Color mixing inhibitor (Cpd-5) | 0.011 |
| Color mixing inhibitor (Cpd-6) | 0.08 |
| Color mixing inhibitor (Cpd-7) | 0.04 |
| Solvent (Solv-1) | 0.02 |
| Solvent (Solv-2) | 0.07 |
| Solvent (Solv-3) | 0.065 |
| **Fifth Layer (Red-Sensitive Emulsion Layer)** | |
| Silver chloro(iodo)bromide emulsion E (cubes sensitized with gold and sulfur; emulsion mixture of the large grain emulsion E-1 and the small gain emulsion E-2 in a ratio of 5:5 (in terms of a molar ratio of silver) | 0.16 |
| Gelatin | 0.95 |
| Cyan coupler (ExC-1) | 0.023 |
| Cyan coupler (ExC-2) | 0.05 |
| Cyan coupler (ExC-3) | 0.17 |
| UV absorber (UV-A) | 0.055 |
| Color image stabilizer (Cpd-1) | 0.22 |
| Color image stabilizer (Cpd-7) | 0.003 |
| Color image stabilizer (Cpd-9) | 0.01 |
| Color image stabilizer (Cpd-12) | 0.01 |
| Solvent (Solv-8) | 0.05 |

-continued

| Sixth Layer (UV Absorbing Layer) | |
|---|---|
| Gelatin | 0.46 |
| UV absorber (UV-B) | 0.35 |
| Compound (S1-4) | 0.0015 |
| Solvent (Solv-7) | 0.18 |
| **Seventh Layer (Protective Layer)** | |
| Gelatin | 1.00 |
| Acryl-modified copolymer of polyvinyl alcohol (degree of modification: 17%) | 0.4 |
| Liquid paraffin | 0.02 |
| Surfactant (Cpd-13) | 0.02 |

(ExY) Yellow Coupler

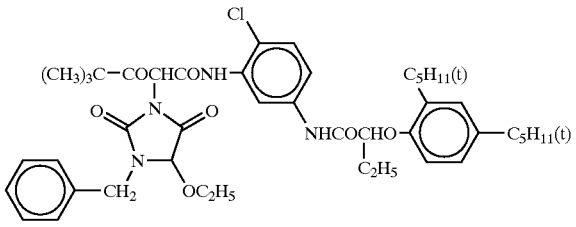

(ExM) Magenta Coupler

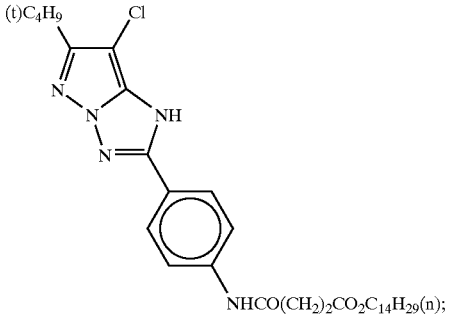

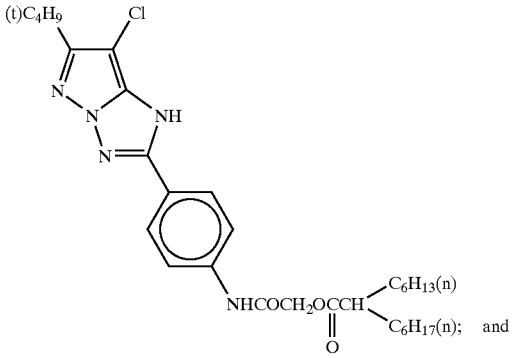

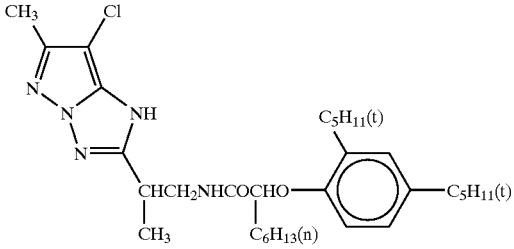

40:40:20 mixture (molar ratio)

-continued (ExC-1) Cyan Coupler

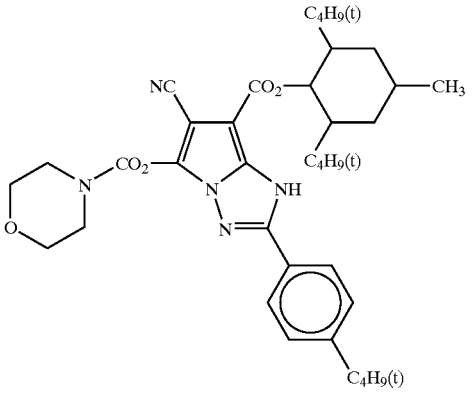

(ExC-2) Cyan Coupler

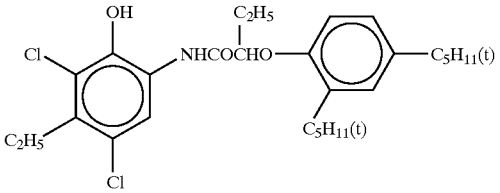

(ExC-3) Cyan Coupler

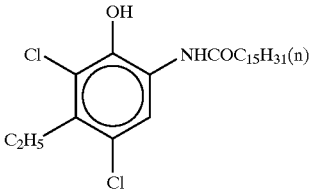

(Cpd-1) Color Image Stabilizer

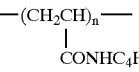

number average molecular weight: 60,000

(Cpd-2) Color Image Stabilizer

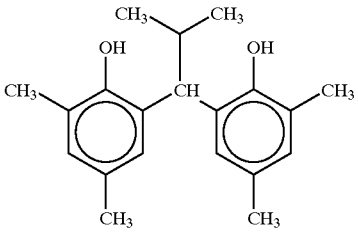

(Cpd-3) Color Image Stabilizer

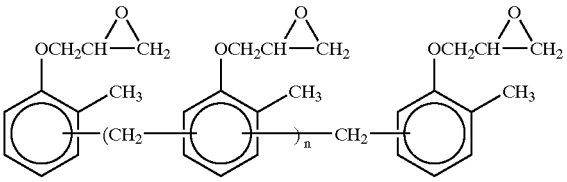

n = 7–8 (mean value)

(Cpd-4) Color Mixing Inhibitor

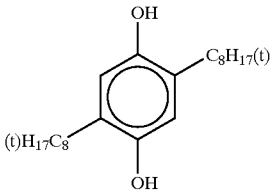

-continued (Cpd-5) Color Image Stabilizer

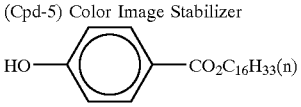

(Cpd-6) Color Image Stabilizer

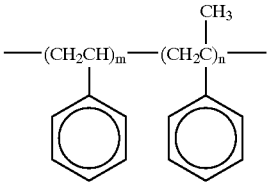

number average molecular weight: 600 m/n = 10/90

(Cpd-7) Color Image Stabilizer

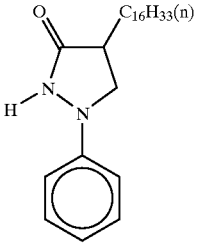

(Cpd-8) Color Image Stabilizer

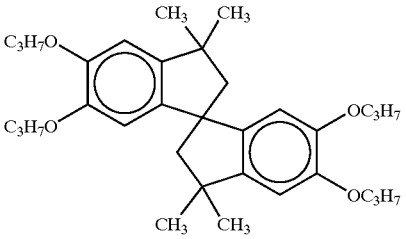

(Cpd-9) Color Image Stabilizer

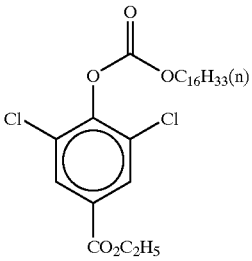

(Cpd-10) Color Image Stabilizer

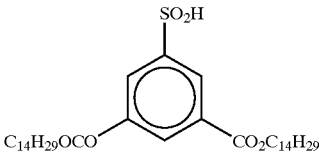

(Cpd-11)

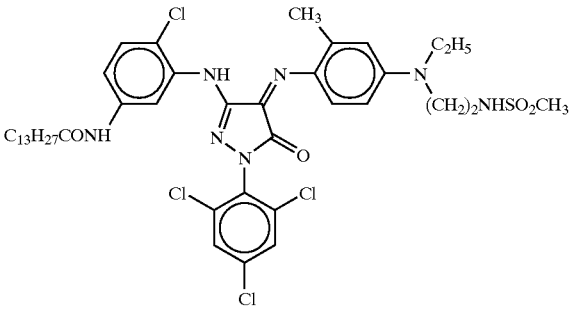

-continued
(Cpd-12)
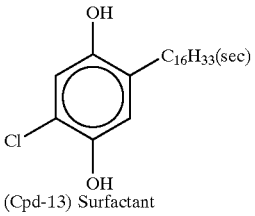
(Cpd-13) Surfactant
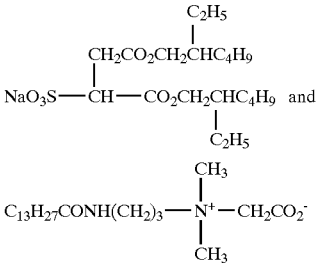
7:3 mixture (molar ratio)
(Cpd-14)
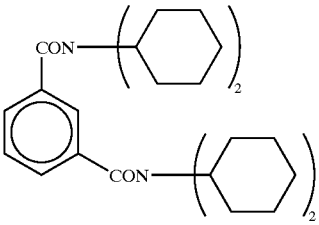
(Cpd-15)
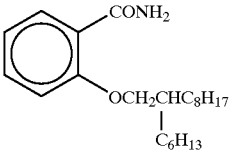
(Cpd-16)
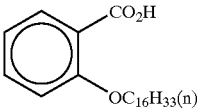
(Cpd-17)
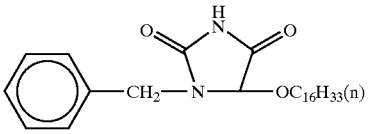
(Cpd-18)
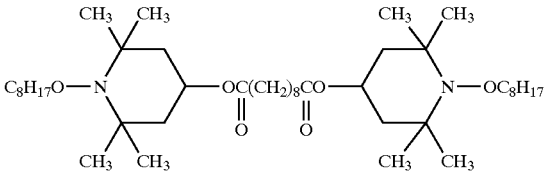
(Cpd-19) Color Mixing Inhibitor
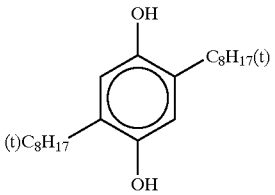
-continued
(Cpd-20)
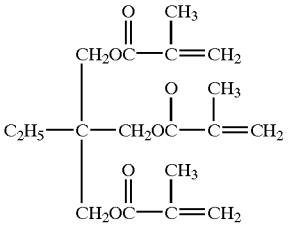
(UV-1) UV Absorber
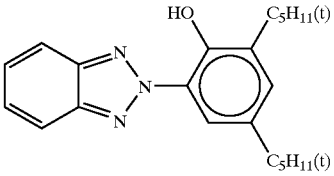
(UV-2) UV Absorber
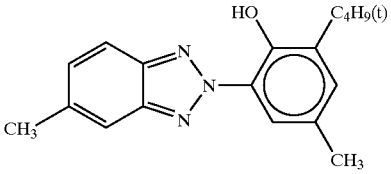
(UV-3) UV Absorber
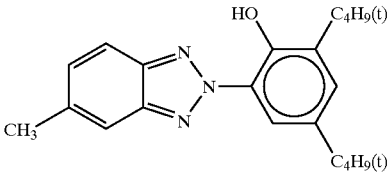
(UV-5) UV Absorber
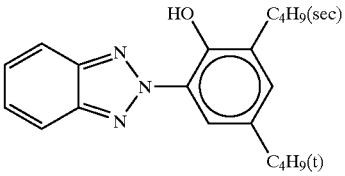
(UV-6) UV Absorber
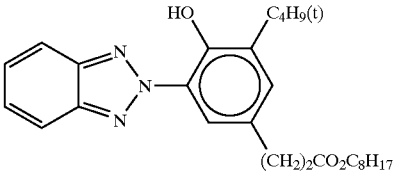
(UV-7) UV Absorber
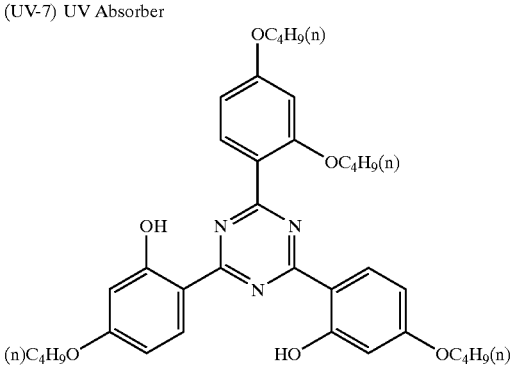
UV-A: a mixture of UV-1/UV-2/UV-3 = 7/2/2 (ratio by mass)
UV-B: a mixture of UV-1/UV-2/UV-3/UV-5/UV-6 = 13/3/3/5/3 (ratio by mass)
UV-C: a mixture of UV-1/UV-3 = 9/1 (ratio by mass)

-continued (Solv-1)

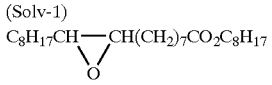

(Solv-2)

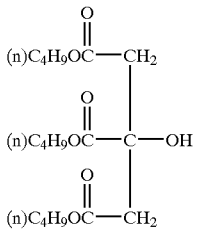

(Solv-3)

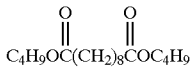

(Solv-4)

$O{=}P(OC_6H_{13}(n))_3$ (Solv-5)

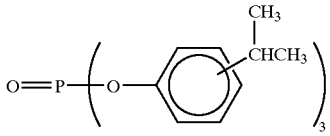

(Solv-7)

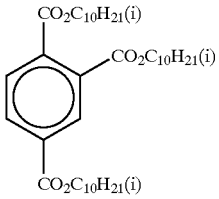

(Solv-8)

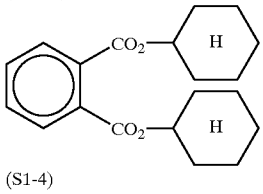

(S1-4)

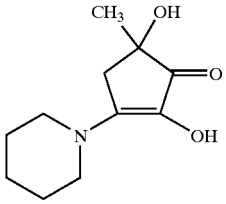

The sample 201 was prepared in this manner. Based on the sample 201, samples 202 to 216 were prepared by changing the type of cyan-dye forming coupler and the coating density thereof, respectively. Each of the samples were determined for the thickness of the red-sensitive emulsion layer by means of a scanning electron microscope so as to calculate a coating density of the coupler.

Exposure/Development Processes

The resultant samples were each subjected to the following scanning exposure based on digital information supplied from a scanner which read a negative image, and then to the color development process A.

Exposure

The scanning exposure process used a scanning exposure system illustrated in FIG. 1 of JP-A No.8-16238. As the light source, there were used a semiconductor laser for emitting light having a wavelength of 688 nm (R-light); and a combination of a solid laser and SHG for emitting light having a wavelength of 532 nm (G-light) and light having a wavelength of 473 nm (B-light). The intensity of light was modulated using an external modulator. The resultant light was reflected by a polygon mirror so as to scan the sample moved perpendicularly to a scanning direction. The scanning exposure rate was 400 dpi and an average exposure time per pixel was $8\times10^{-8}$ seconds. The semiconductor laser was maintained at a constant temperature by means of a Peltier element such as to obviate light intensity variations associated with temperature variations.

Color Development Process A

A process using the following running processing solutions is defined as "Color Development Process A".

| Step | Temperature | Time | Replenished amount* |
|---|---|---|---|
| Color development | 38.5° C. | 45 sec | 45 mL |
| Bleach-fixing | 38.0° C. | 45 sec | 35 mL |
| Rinse (1) | 38.0° C. | 20 sec | — |
| Rinse (2) | 38.0° C. | 20 sec | — |
| Rinse (3)** | 38.0° C. | 20 sec | — |
| Rinse (4)** | 38.0° C. | 20 sec | 121 mL |
| Drying | 80° C. | | |

Note

*a replenished amount per 1 $m^2$ of photosensitive material

**The rinse tank (3) was provided with a rinse cleaning system RC50D, available from Fuji Photo Film Co., Ltd., such as to pump a drawn rinsing fluid from the rinse (3) into a reverse osmosis module (RC50D).Permeated water thus obtained was fed to the rinse (4), while concentrated water was returned to the rinse (3). The pump pressure was adjusted so that the amount of permeated water to the reverse osmosis module was maintained at 50 to 300 mL/min. and the circulation at a controlled temperature was carried out for 10 hours per day.The rinsing fluid was circulated from the rinse tank (1) to the rinse tank (4) based on four-tank counter flow system.

The compositions of the processing solutions are listed as below.

| | [Tank] | [Replenisher] |
|---|---|---|
| [Color developer] | | |
| Water | 800 mL | 800 mL |
| Fluorescent brightener (FL-1) | 2.2 g | 5.1 g |
| Fluorescent brightener (FL-2) | 0.35 g | 1.75 g |
| Tri(isopropanol)amine | 8.8 g | 8.8 g |
| Polyethylene glycol (average melecular weight: 300) | 10.0 g | 10.0 g |
| Ethylenediaminetetraacetate | 4.0 g | 4.0 g |
| Sodium sulfite | 0.10 g | 0.20 g |
| Potassium chloride | 10.0 g | — |

-continued

| | [Tank] | [Replenisher] |
|---|---|---|
| Sodium 4,5-dihydroxybenzene-1,3-disulfonate | 0.50 g | 0.50 g |
| Disodium-N,N-bis(sulfonateethyl)hydroxylamine | 8.5 g | 14.0 g |
| 4-amino-3-methyl-N-ethyl-N-(β-methanesulfonamidoethyl)aniline-3/2 sulfate-monohydrate | 4.8 g | 14.0 g |
| Potassium carbonate | 26.3 g | 26.3 g |
| Water to make | 1000 mL | 1000 mL |
| pH (adjusted at 25° C., using sulfuric acid and KOH) | 10.15 | |
| [Bleach-fixing solution] | | |
| Water | 800 mL | 800 mL |
| Ammonium thiosulfate(750 g/mL) | 107 mL | 214 mL |
| m-carboxybenzensulfinate | 8.3 g | 16.5 g |
| Iron(III) ammonium ethylenediaminetetraacetate | 47.0 g | 94.0 g |
| Ethylenediaminetetraacetate | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 mL | 1000 mL |
| pH (adjusted at 25° C., using nitric acid and ammonia water) | 6.5 | 6.5 |
| [Rinsing fluid] | | |
| Chlorinated sodium isocyanate | 0.02 g | 0.02 g |
| Deionized water (conductivity: 5 μS/cm or less) | 1000 mL | 1000 mL |
| pH (25° C.) | 6.5 | 6.5 |

FL-1

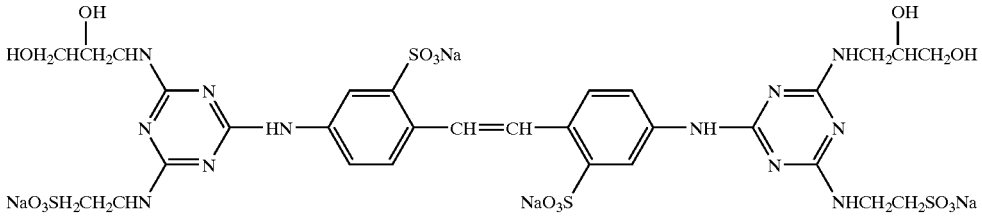

FL-2

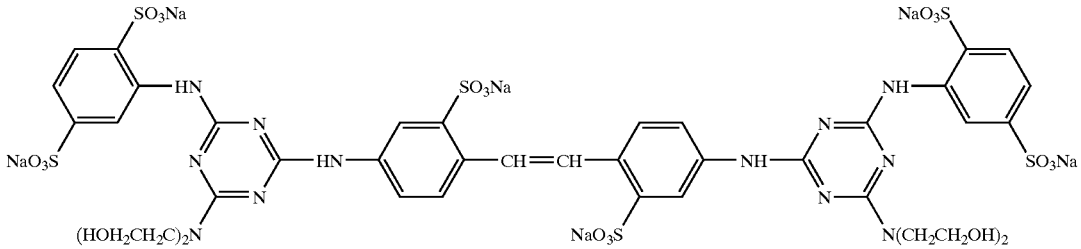

The above exposure and development processes were carried out to produce a solid image of neutral gray at an average density of 1.0 (size: 8.9 cm×12.7 cm). The textures of the resultant images were evaluated organoleptically. The results are listed in Table 4.

The organoleptical evaluation was based on the following criteria of four ranks. That is, OO represents texture substantially free from roughness; O represents texture with negligible roughness; Δ represents texture with an allowable degree of roughness; and × represents texture with an unacceptable degree of roughness. Ten examiners rated the images based on the scale of OO to ×, and averaged the ranks given to each image.

TABLE 4

| | Red Sensitive Layer | | | | |
|---|---|---|---|---|---|
| Sample No. | Cyan coupler (amount g/m$^2$) | Thickness | Coupler coated density | Texture | Note |
| 101 | ExC-1/ExC-2/ExC-3 (0.023/0.05/0.17) | 1.2 μm | 203 mg/cm$^3$ | X | Comparative Example |
| 102 | ExC-1/ExC-2/ExC-3 (0.023/0.05/0.17) | 1.5 μm | 162 mg/cm$^3$ | X | Comparative Example |

TABLE 4-continued

| Sample No. | Red Sensitive Layer: Cyan coupler (amount g/m$^2$) | Thickness | Coupler coated density | Texture | Note |
|---|---|---|---|---|---|
| 103 | ExC-1/ExC-2/ExC-3 (0.023/0.05/0.17) | 2.0 μm | 83 mg/cm$^3$ | ○ | Present Invention |
| 104 | ExC-1/ExC-2/ExC-3 (0.022/0.048/0.16) | 1.5 μm | 153 mg/cm$^3$ | Δ | Present Invention |
| 105 | ExC-1/ExC-2/ExC-3 (0.021/0.045/0.15) | 1.5 μm | 144 mg/cm$^3$ | ○ | Present Invention |
| 106 | ExC-1/ExC-2/ExC-3 (0.021/0.045/0.15) | 2.0 μm | 108 mg/cm$^3$ | ○ | Present Invention |
| 107 | ExC-1/ExC-2/ExC-3 (0.020/0.042/0.14) | 1.5 μm | 135 mg/cm$^3$ | ○ | Comparative Example |
| 108 | ExC-1/ExC-2/ExC-3 (0.095/0.042/0.012) | 1.0 μm | 149 mg/cm$^3$ | ○ | Present Invention |
| 109 | PTA-7 (0.100) | 1.5 μm | 67 mg/cm$^3$ | ○○ | Present Invention |
| 110 | PTA-7 (0.100) | 1.0 μm | 100 mg/cm$^3$ | ○ | Present Invention |
| 111 | PTA-14 (0.085) | 0.95 μm | 89 mg/cm$^3$ | ○○ | Present Invention |
| 112 | PTA-33 (0.100) | 1.5 μm | 67 mg/cm$^3$ | ○○ | Present Invention |
| 113 | PTA-33 (0.100) | 1.0 μm | 100 mg/cm$^3$ | ○ | Present Invention |
| 114 | IA-20 (0.258) | 1.9 μm | 136 mg/cm$^3$ | Δ | Present Invention |
| 115 | IA-20 (0.240) | 1.9 μm | 127 mg/cm$^3$ | ○ | Present Invention |
| 116 | IA-23 (0.232) | 1.7 μm | 136 mg/cm$^3$ | Δ | Present Invention |
| 117 | IA-23/IA-24 (0.232/0.026) | 1.8 μm | 143 mg/cm$^3$ | Δ | Present Invention |
| 118 | IA-23/IA-24 (0.216/0.024) | 1.8 μm | 133 mg/cm$^3$ | ○ | Present Invention |
| 119 | IA-23/IA-24 (0.216/0.024) | 1.9 μm | 127 mg/cm$^3$ | ○○ | Present Invention |
| 120 | PTA-7 (0.100) | 2.0 μm | 50 mg/cm$^3$ | ○○ | Present Invention |
| 121 | PTA-7 (0.100) | 3.0 μm | 33 mg/cm$^3$ | ○○ | Present Invention |
| 122 | PTA-7 (0.070) | 3.5 μm | 20 mg/cm$^3$ | ○○ | Present Invention |

As seen from the results of Table 4, when the samples including the cyan couplers out of the specified range are scan exposed with light from the solid and/or the semiconductor laser and developed at a low rate of replenishing solution, the unfavorable images with significantly rough texture result (samples 201, 202, 207). In contrast, the samples including the cyan couplers in the specified range produce the favorable images with texture of small roughness. Particularly, the samples employing the specific cyan couplers (those represented by the general formulae (PTA-I) or (PTA-II) and (IA)) are more preferred, producing the images with negligible roughness. Among the samples 109 to 122, those including the specific cyan couplers within the desired range are particularly preferred, producing the images with unnoticeable roughness (samples 209, 211, 212, 219–222).

As described above, the invention provides the silver halide color photographic photosensitive material and the image forming method therefor adapted for the image output on the basis of image information (digital data, in particular) and for the reproduction of images with high chroma. More specifically, the invention provides the silver halide color photographic photosensitive material and the image forming method therefor adapted to produce the solid image having high chroma and less density variations by performing the scanning exposure using the solid and/or semiconductor laser and the development process at the low replenishing rate.

What is claimed is:

1. A silver halide color photographic photosensitive material which comprises, on a support, photographic constituent layers including at least one blue sensitive silver halide emulsion layer containing a yellow dye forming coupler, at least one green sensitive silver halide emulsion layer containing a magenta dye forming coupler, at least one red sensitive silver halide emulsion layer containing a cyan dye forming coupler, and at least one non-photosensitive hydrophilic colloid layer, and undergoes an imagewise exposure step, a color developing step, a bleach-fixing step and a rinsing step, wherein:

at least one of the at least one red sensitive silver halide emulsion layer contains at least one compound represented by the following general formula (IA); and the silver halide color photographic photosensitive material shows a photographic characteristic such that a cyan density change ΔDc after development processing is 0.02 or less when the bleach-fixing step is conducted under the conditions that an average replacement rate Ta of a bleach-fixing solution is 12.0 or less and an opening degree K of a bleach-fixing bath is 0.007 (cm$^{-1}$) or less, General formula (IA)

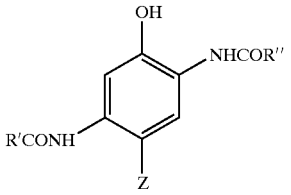

wherein R' and R" each independently represent a substituent; and Z represents a hydrogen atom or a group capable of being removed by coupling reaction with an oxidant of an aromatic primary amine color developing agent.

2. A silver halide color photographic photosensitive material according to claim 1, wherein the silver halide color photographic photosensitive material is subjected to scanning exposure for an exposure time of $10^{-3}$ sec or less per pixel.

3. A silver halide color photographic photosensitive material according to claim 1, wherein a total coating amount of silver in the silver halide color photographic photosensitive material is 0.47 g/$m^2$ or less.

4. A silver halide color photographic photosensitive material according to claim 1, wherein at least one of the at least one green sensitive silver halide emulsion layer contains at least one compound represented by the following general formula (M-II), General formula (M-II)

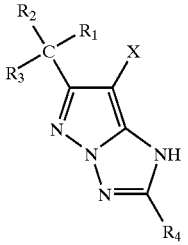

wherein $R_1$, $R_2$, $R_3$ and $R_4$ each independently represent a hydrogen atom or a substituent; and X represents a hydrogen atom or a group capable of being removed by coupling reaction with an oxidant of an aromatic primary amine color developing agent.

5. A silver halide color photographic photosensitive material according to claim 1, wherein the bleach-fixing step is conducted for 45 sec or less.

6. An image forming method comprising:

a step of imagewise exposing s silver halide color photogaphic material according to claim 1;

a color developing step;

a bleach-fixing step; and a rinsing step.

7. An image forming method according to claim 6, wherein the silver halide color photographic photosensitive material is subjected to scanning exposure for an exposure time of $10^{-3}$ sec or less per pixel.

8. An image forming method according to claim 6, wherein a total coating amount of silver in the silver halide color photographic photosensitive material is 0.47 g/$m^2$ or less.

9. An image forming method according to claim 6, wherein at least one of the at least one green sensitive silver halide emulsion layer contains at least one compound represented by the following general formula (M-II), General formula (M-II)

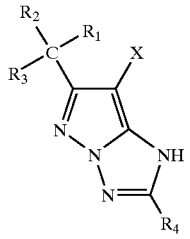

wherein $R_1$, $R_2$, $R_3$ and $R_4$ each independently represent a hydrogen atom or a substituent; and X represents a hydrogen atom or a group capable of being removed by reaction with an oxidant of an aromatic primary amine color developing agent.

10. An image forming method according to claim 6, wherein the bleach-fixing step is conducted for 45 sec or less.

* * * * *